US008403723B1

(12) United States Patent
Haner

(10) Patent No.: US 8,403,723 B1
(45) Date of Patent: Mar. 26, 2013

(54) PATTERN MAKING AND CONSTRUCTION KIT

(76) Inventor: Gregory Lee Haner, Mahwah, NJ (US)

( * ) Notice: Subject to any disclaimer, the term of this patent is extended or adjusted under 35 U.S.C. 154(b) by 488 days.

(21) Appl. No.: 12/457,126

(22) Filed: Jun. 2, 2009

Related U.S. Application Data

(60) Provisional application No. 61/195,224, filed on Oct. 3, 2008.

(51) Int. Cl.
*A63H 33/08* (2006.01)
*A63H 23/00* (2006.01)

(52) U.S. Cl. ..... 446/120; 446/124; 446/153

(58) Field of Classification Search ..... 446/71, 446/85, 120–122, 124, 125, 153, 486; 403/300, 403/305, 308
See application file for complete search history.

(56) References Cited

U.S. PATENT DOCUMENTS

| | | | | | |
|---|---|---|---|---|---|
| 3,195,266 | A | * | 7/1965 | Onanian | 446/86 |
| 3,815,281 | A | * | 6/1974 | Kander | 446/77 |
| 4,253,268 | A | * | 3/1981 | Mayr | 446/104 |
| 4,358,866 | A | * | 11/1982 | Rhodes | 114/363 |
| 4,582,447 | A | * | 4/1986 | Itoh | 403/305 |
| 4,947,527 | A | * | 8/1990 | Hennig | 24/586.11 |
| 5,015,117 | A | * | 5/1991 | Pawlicki | 403/300 |
| 5,098,328 | A | * | 3/1992 | Beerens | 446/128 |
| 5,110,315 | A | * | 5/1992 | Zawitz | 446/102 |
| 5,964,635 | A | | 10/1999 | Krog | |
| 5,971,823 | A | * | 10/1999 | Sanso | 441/88 |
| 6,050,873 | A | | 4/2000 | Reisman | |
| 6,132,276 | A | * | 10/2000 | Leemon | 441/129 |
| 6,250,986 | B1 | | 6/2001 | Sorensen | |
| 6,402,581 | B1 | | 6/2002 | Podgaiz | |
| 6,461,215 | B1 | | 10/2002 | Kunz et al. | |
| 6,482,058 | B2 | * | 11/2002 | Sanso et al. | 441/56 |
| 6,554,677 | B2 | * | 4/2003 | Leemon | 446/122 |
| 6,648,715 | B2 | | 11/2003 | Wiens et al. | |
| 6,679,780 | B1 | * | 1/2004 | Shih | 273/157 R |
| 6,843,695 | B1 | * | 1/2005 | Jackson et al. | 441/129 |
| D501,670 | S | * | 2/2005 | Landi, Jr. | D21/803 |
| 7,040,949 | B2 | * | 5/2006 | Slocum | 446/122 |
| 7,052,347 | B2 | | 5/2006 | Goldmeier | |
| 7,063,587 | B1 | * | 6/2006 | Lin | 446/124 |
| 7,318,762 | B2 | * | 1/2008 | Goldmeier | 441/129 |
| 7,364,487 | B2 | * | 4/2008 | Evans et al. | 446/108 |
| 7,481,692 | B2 | * | 1/2009 | Bruder | 446/122 |
| 2005/0148278 | A1 | * | 7/2005 | Drobinski et al. | 446/227 |

* cited by examiner

*Primary Examiner* — Gene Kim
*Assistant Examiner* — Alyssa Hylinski
(74) *Attorney, Agent, or Firm* — Ash Tankha; Lipton, Weinberger & Huscik

(57) ABSTRACT

A construction kit of modular components including rigid and flexible foam bars with endcaps designed to be joined together by snap-fit connections to define three-dimensional, adult-sized playing fields which float in aquatic settings such as swimming pools. The connectivity of the modular components is characterized by manual assembly, a high resistance to separation during active play by teams of adults participating in vigorous athletic activities, and tool-assisted disassembly.

71 Claims, 48 Drawing Sheets

PATTERN MAKING AND CONSTRUCTION KIT

CROSS-REFERENCES TO RELATED APPLICATIONS

Provisional Patent Application No. 61/195,224 filed on Oct. 3, 2008. Confirmation No. 7428

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable.

REFERENCE TO A "SEQUENCE LISTING"

Not Applicable.

BACKGROUND OF THE INVENTION (1) Field of the Invention

This invention relates to equipment and accessories which promote activities and games in aquatic settings, such as swimming pools, and to a construction Kit capable of configuring its component modules into a multitude of patterns.

(2) Description of Related Art Including Information Disclosed Under 37 CFR 1.97 AND 1.98

Summer camps, resorts, cruise lines, country clubs, day care centers, and other businesses, organizations, groups, and clubs enlist volunteers and employ professional staff who are expected to regularly create appealing schedules of interesting games, contests, and activities to entertain their guests. One of the most difficult challenges is to create stimulating activities that encourage inclusive participation of a group that may include members of varying age, gender or athletic ability. It is common that these organized activities include water related games or exercise programs conducted in a pool, lake, or other suitable aquatic setting. Currently, activity directors and coordinators are limited in the tools they have to perform their duties in an aquatic environment. The disclosed invention is directed to providing them with a multitude of patterns which will solve most of their pool-related problems and greatly enhance their productivity, and a Kit for constructing the patterns.

Most commercially available pool-related accessories are bulky, difficult to handle and store, and, worst of all, have only a single function. A pool tic-tac-toe board disclosed in U.S. Pat. No. 5,318,307 to Bouchard et al. (FIGS. 6-7) fits in this category. Basketball backboards, volleyball nets, water polo goals, golf "greens", and a variety of targets and nets, any of which are either free-standing alongside the pool, float in the pool, or are stretched across the pool from side to side, are other well known prime examples. While they promote aquatic activities, they tend to attract younger, stronger, more athletic participants. Those less skilled or gifted tend to be pushed aside, watch from the sidelines, or become too discouraged to participate at all. None of these accessories really fulfill the activity director's desire for full, all-inclusive participation.

Other types of smaller accessories, such as beach balls, noodles, pool horseshoes, water "Frisbees", and underwater hoops are fun to use, but they too are limited to a single use and are difficult to transport and/or store. See U.S. Pat. Nos. 5,971,823 (Sanso) and 7,052,347 (Goldmeier).

The last generic category of pool accessories are floatation devices. Chairs, rafts, and simulated animals or toys are usually inflatable but are also made from foam and foam bars. Again, they are limited to a single use and are difficult to transport and/or store. Representative are the devices shown in U.S. Pat. Nos. 5,120,253 (Gelardi), 5,833,511 (Outman), and 6,843,695 (Jackson et al.).

The concept of a plurality of patterns which can be easily configured for a concomitant plurality of distinctly different aquatic activities is sadly missing from the prior art. There exists a strong need for an activity director and the staff to be able to provide a large number of different patterns for a like number of games, exercises, and activities. A modular pattern-making Kit having the capacity to create those patterns is equally needed.

It is not enough to provide just a pattern-making Kit, however. It must meet a long list of criteria unavailable in the prior art. It must be buoyant so that the game patterns can float. It must be easy to assemble, easy to disassemble and store, and easy to reconfigured into other activity formations. And, at the same time, the connections between modular components must be rugged enough to maintain the pattern's structural integrity during active use by children and adults. Any Kit capable of forming such an array of floating boundaries and formations in and around a swimming pool provides an incomparable level of capability and versatility for organizing innovative group activities, as compared to the options available to the same group that does not have access to such a buoyant, modular pattern-making Kit. The instant invention fulfills that need.

The broad concept of a construction Kit for assembling various structures, simulations, and two- or three-dimensional, geometric frameworks are known, mainly for use by children. Not only do the known children's Kits not meet the definition of "adult-sized," the trend has been to make them easier to assemble and disassemble, so that they are within the child's capabilities to use the Kit. Representative are the U.S. Pat. Nos. 4,947,527 (Hennig), 5,098,328 (Beerens), 5,120,253 (Gelardi), 5,839,938 (Manthei et al.), 5,928,051 and 5,964,635 (Krog), 6,050,873 (Reisman), and 7,063,587 (Lin). Most do not meet any of the criteria needed for the inventive patterns; none meet them all.

BRIEF SUMMARY OF THE INVENTION

The present invention overcomes the difficulties described above by providing an Olympic Game Kit capable of producing a plurality of game patterns, said Olympic Game Kit comprising a plurality of modular components easily joined together to form a selected pattern defining a playing field for adult-sized activities, said pattern being buoyant enough to float on a body of water, and said pattern having sufficient structural integrity to maintain its configuration even when subjected to rough use by human adults at play, while being capable of being easily disassembled and easily rejoined into any one of a vast multitude of other stable patterns. For the purpose of the disclosure and claims, "adult-sized", "adult-sized playing fields", "human scale", and similar, equivalent terms refer to patterns of such a size, i.e., scale that human beings, children, teens, and adults alike, can comfortably fit within them for play or other functions.

The present invention overcomes the difficulties described above by providing a modular pattern-making "Kit" system of interconnecting plastic, rubber and foam components that may be regularly assembled, disassembled and re-assembled in a plurality of configurations to construct simple and complex shapes, patterns, formations and boundaries that facilitate active in-water participation in a multitude of organizational, educational and entertainment activities, events, sports, games and tournaments. Several of the details of the Kit are also considered inventive, including but not limited to, the rigid and flexible bars with endcaps, the endcaps per se, the various Hubs, and the disconnect tools.

The Olympic Game Kit is a pattern making system, which is specifically designed to simplify and streamline the process of repeated construction of human scale playing fields that are assembled so that players can participate in games and contests that occur within the formation. The half-cube snap fit joinery simplifies the assembly and construction process for repetitive use in the creation of numerous formations. The development of the standardized joinery throughout a variety of modular parts has reduced the number of different components needed so that the components would be manageable for real life use, easy to handle and snap together, yet strong enough to hold together and withstand reasonable play, and still easy to break down. The joinery has advanced capabilities, but it's development was all about accomplishing function so that it produced a solution for a comprehensive human scale pattern making system that makes it practical to organize group games and active play.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which:

FIGS. 1-10 show the best mode of the core components of the inventive Kit:

FIG. 1 is a perspective view of a core component of the pattern-making Kit, a rigid foam bar with connective joinery at both ends;

FIG. 2 is a cross-sectional view of the rigid foam bar of FIG. 1;

FIG. 3 shows the cross-sectional view of a connector designed to be inserted into each open end of the hollow spine of the rigid foam bar of FIG. 1;

FIG. 4 is an exploded, cross-sectional view of the connector inserted within the spine of the rigid foam bar;

FIGS. 11-19 depict various configurations illustrating the manner the inventive bars and Hubs can be joined together:

FIG. 12B shows the two bars of FIG. 11B snap-fit together bar-to-bar with the third bar being snap-fit to a coplanar pair of the side surfaces of the endcaps of said two bars;

FIG. 12C shows the third bar initially being snap-fit to a single Hub and the said two bars subsequently being snap-fit, respectively, to the opposing coplanar pairs of side surfaces of the combination of said third bar and Hub;

FIG. 12D shows the two bars initially being linearly joined to two Hubs end-to-end as in FIG. 11C with the third bar being snap-fit to a coplanar pair of the side surfaces of said two Hubs;

FIGS. 16-19 illustrate four examples of simple patterns capable of being produced by the joinery techniques previously shown, namely, a gate, an extended entryway, a tunnel, and a rigid superstructure, respectively.

FIGS. 20-25 disclose another core component comprising a flexible bar and a circular endcap designed therefor:

FIG. 20 shows a flexible bar with a circular endcap attached to each end;

FIG. 21 illustrates the flexible bar of FIG. 20 just prior to the assembly of a circular endcap and a flexible beam;

FIGS. 26-28 disclose flexible bars and examples of modes of joinery thereof:

FIG. 27A shows two flexible bars joined bar-to-bar;

FIG. 27B shows two flexible bars joined with two Hubs, bar-to-bar, and a rigid bar about to be joined orthogonally to a coplanar pair of the side surfaces of said two Hubs;

FIG. 27C shows a flexible bar joined to the corner shown in FIG. 13B comprising two rigid bars and a Hub;

FIGS. 29A-29B are top and bottom perspective views of the assembled octagon Hub;

FIGS. 29C-29D show a top perspective view and a bottom view of the top half of said octagon Hub; and FIGS. 29E-29F show a top perspective view and a bottom view of the bottom half of said octagon Hub.

FIGS. 32-34 disclose disconnect tools and their manner of use:

FIGS. 35-38 show adult-sized game fields enclosed by a perimeter:

FIG. 35 shows bars connected to form a basic perimeter which places a border around a designated area, creating a generic playing field;

FIG. 36 shows bars connected to form a Dodge Ball court;

FIG. 37 shows bars connected to form a playing field for the game of Battleship; and FIG. 38 shows bars connected to form a playing field for the game of Tag.

FIGS. 39-42 show rigid and flexible bars connected to form a variety of target matrices for Toss-In games, including the classic game of Tic-Tac-Toe (FIG. 41).

FIGS. 43-50 shows bars connected to form playing fields in combination with commercially available accessories:

FIG. 43 shows bars connected to form a playing field for a Volleyball game;

FIG. 44 shows bars connected to form a playing field for an in-pool football game;

FIGS. 45-47 show three types of basketball keys for use with a pool-side basketball stand;

FIG. 48 shows bars connected to form a playing field for a Toss-From basketball game of Horse;

FIG. 49 shows bars connected to form a playing field for a Horseshoe game; and FIG. 50 shows bars connected to form a playing field for an aquatic golf game.

FIGS. 51-55 show playing fields in which a through swim path is defined:

FIG. 51 shows bars connected to form a trio of lanes for swimming or other types of races;

FIG. 52 shows bars connected to form a convoluted race course, either for swimming competitions or for remote controlled toy boats;

FIG. 53 shows bars connected to form a maze-like race course;

FIG. 54 shows bars connected to form an obstacle course; and

FIG. 55 shows bars connected to form a playing field for a dice board game.

FIG. 57 is a top view of the preferred post;

FIG. 58 is a perspective view of the preferred post;

FIG. 59 is a side view of the preferred post;

FIG. 60 is another side view of the preferred post; and

FIG. 62 is a perspective view of an endcap including bulbous posts and multi-fingered ports;

FIG. 63 is a perspective view of an endcap including four-fingered posts and circular ports;

FIG. 64 is a perspective view of an endcap including square posts and ports; and FIG. 65 is a perspective view of an endcap including round posts with an axial opening in the dome and circular ports.

DETAILED DESCRIPTION OF THE INVENTION

The invention comprises a modular pattern-making Kit of interconnecting components for configuring and reconfiguring human scale formations large enough to facilitate active player participation, for adults or children, inside or outside of the assembled formations in a multitude of outdoor games and organized activities primarily in a swimming pool or other suitable aquatic environment.

Figure 1:
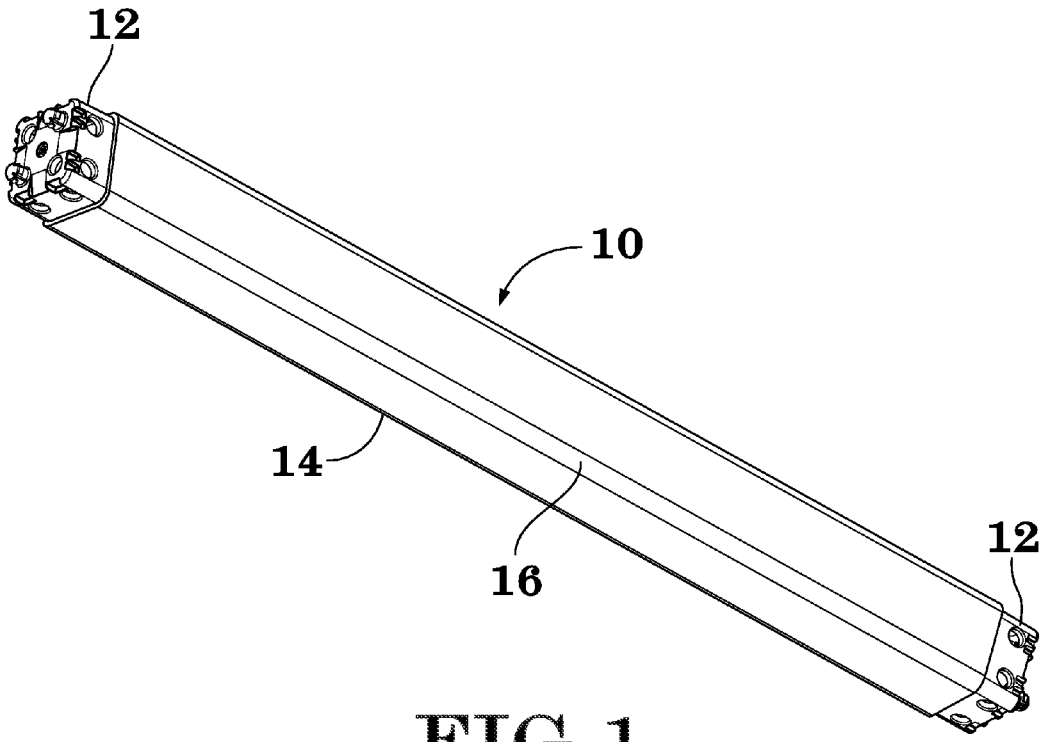

Turning to FIG. 1, the core component of the modular pattern-making Kit is a foam bar 10 comprising a pair of endcaps 12 attached to each end of an elongated beam 14. Bar 10 has a substantially square transverse cross-section with rounded corners 16. It is not critical that the transverse cross-section be perfectly square, just reasonably so to facilitate handling and storage. The rounded corners eliminate sharp edges for safety, for ease of handling, and for aesthetic reasons.

Figure 2:
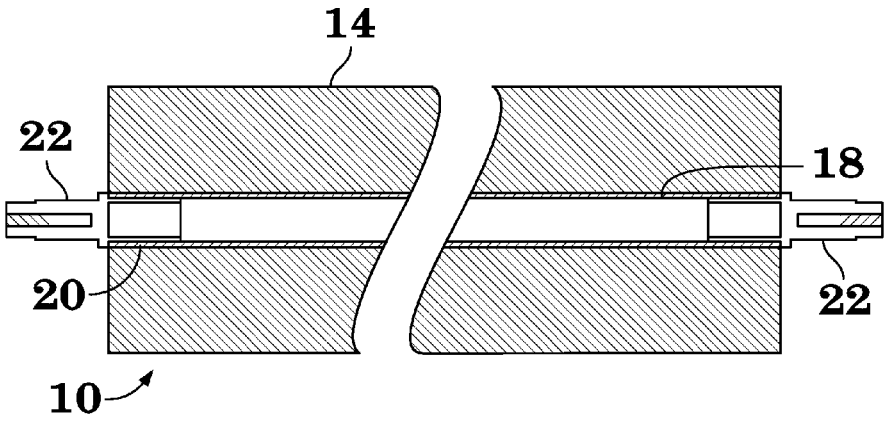

FIG. 2 illustrates a preferred embodiment of the components which make up bar 10. Bar 10 is shown in FIG. 2 in axial cross-section without endcaps 12. Beam 14 is made of any well-known closed-cell, foamed plastic material, preferably one with a smooth, tough outer skin formed naturally by the fabricating process, such as a closed-cell polyethylene, and which is formed in a variety of colors and/or patterns. Beam 14 has a central, circular channel 18 extending axially throughout its length. A relatively rigid, hollow spine 20, also shown in axial cross-section, is fit into the channel 18 and is glued therein. The rigid spine 20, made of hard rubber or plastic, preferably ABS, makes bar 10 rigid in the sense that bar 10 cannot bend transverse of its axis. Spine 20 is preferably bonded to the foam throughout its length, so that the foam will be completely anchored to the spine. If spine 20 were not adhered throughout channel 18, then when the bar is taken in hand and pushed axially to join two bars together, the foam would have a tendency to slide axially relative to the spine, bunching up into compression and rarefaction regions along the length of the bar. Not only is this unsightly, it is damaging to the foam itself, shortening the useful life of the bar. Completely anchoring the spine to the beam not only prevents bunching but also resists twisting of the endcaps relative to the foam, which would misalign the square endcaps relative to the square cross-section of the beam.

The essential characteristics of beam 14 is its ability to float (due to the closed-cell foam), its ability to maintain a straight, rigid configuration (due to the rigid spine), and its ease of handling, transport, and storage (due to its soft feel, its unbending construction, and its rectangular exterior shape). All of these characteristics render bar 10 ideal as a component for quickly and easily assembling and disassembling multiple configurations of patterns for fields of play.

Figure 3:
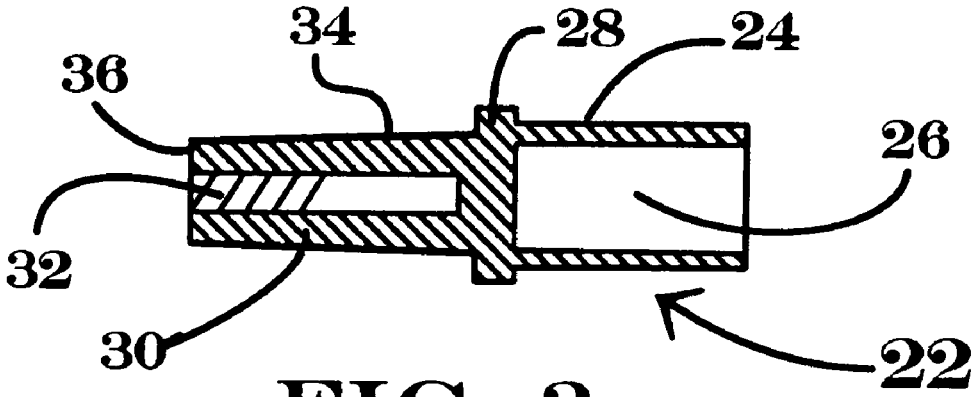

A tubular, plastic connector 22, also preferably made of ABS, is glued or otherwise bonded into each end of spine 20. Connector 22 is shown more clearly in axial cross-section in FIG. 3 and in perspective as inserted within the hollow interior of one end of spine 20 in FIG. 4. Connector 22 comprises a one piece, integral body including an insertion end 24 with a hollow interior 26, an insertion limiting flange 28, and an endcap connector end 30. Connector end 30 is internally threaded at 32 to receive an attachment screw which secures an endcap 12 to connector 22. Connector end 30 has a square cross-section whose side walls 34 taper outwardly from the tip 36 of connector 22 to flange 28; end 30 snugly fits within a complementary receptacle in endcap 12 (FIG. 5B). Tip 36 has a plurality of blind cavities 38 formed axially therein. Hollow interior 26 and cavities 38 are primarily the by-product of the molding process, but they serve useful functions, namely, they use less material, thereby lowering the costs of mass producing connectors 22, and they enhance the ability of bar 10 to float by reducing the weight of connectors 22.

Figure 4:
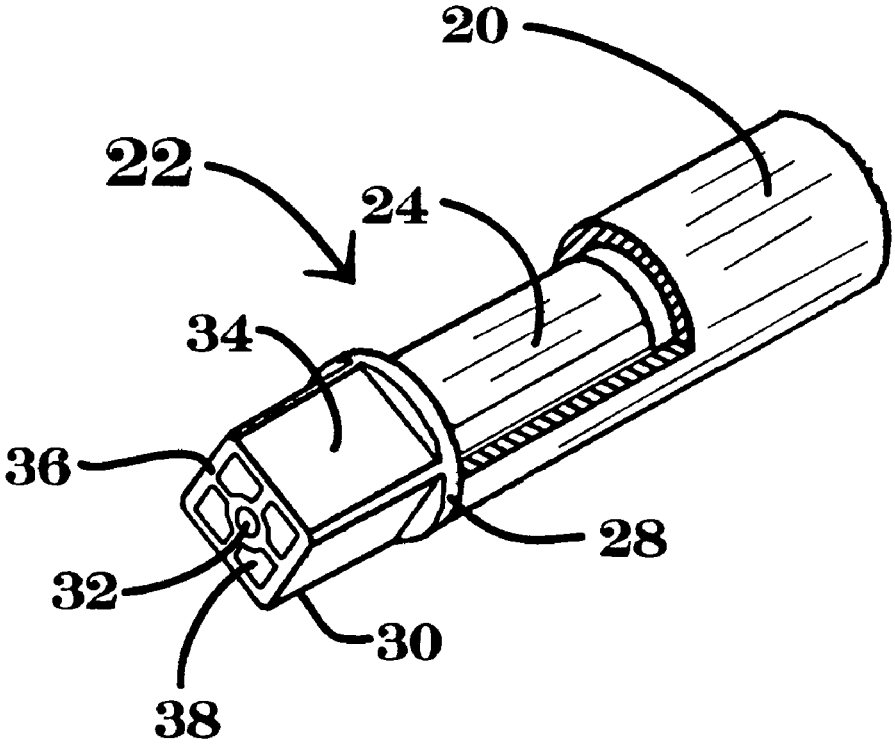

An exploded view of one end of spine 20 and a connector 22 inserted therein are shown in FIG. 4. Insertion end 24 is plugged into an open end of spine 20 where it is solvent bonded or sonically welded. When connectors 22 are permanently fixed in the ends of spine 20, the hollow interior thereof is sealed, trapping the air therein and preventing water from entering into spine 20, which further enhances the ability of bar 10 to float. An endcap 12 is then attached to each connector 22.

Figure 5A:
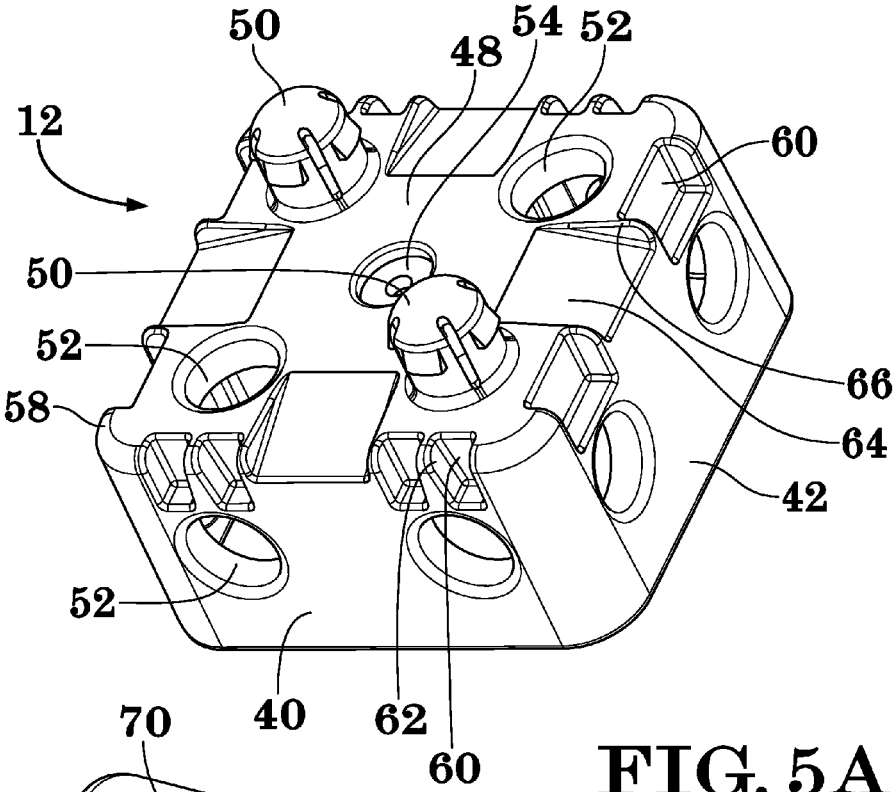
FIGS. 5A-5B show perspective views of the top and the bottom (inside), respectively, of a half-cube endcap.
Figure 5B:
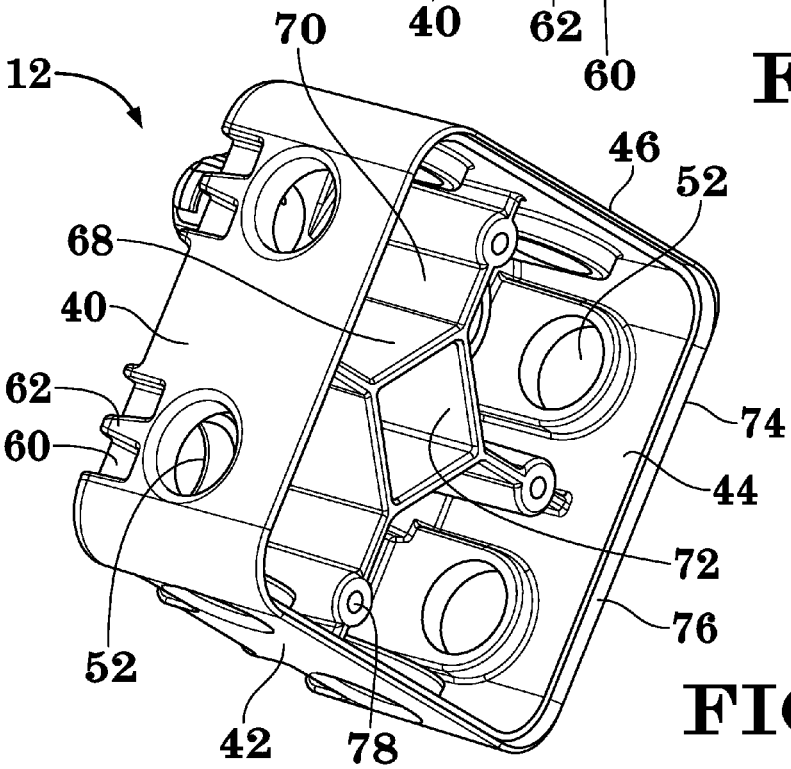

FIGS. 5A and 5B show perspective views of the top and bottom (inside), respectively, of the preferred endcap 12.

Endcap 12 is molded as a one-piece, integral body from a plastic material, preferably a durable polypropylene which is relatively soft and flexible, while maintaining is shape. The softness and flexibility of the endcap provides many advantageous benefits. The material's flexibility results in a much improved impact resistance, as compared to more rigid and brittle materials, when the bars are dropped or bounced on a pool deck, extending the useful life of bars 10. Its softness is a safety factor. The domed post's protrusions can be squeezed with the fingers and will collapse and, upon release, return to their shape. When coming in contact with children, the domed posts are softer and less likely to harm them, as the plastic parts have give. And, the flexibility to the walls and posts enhances the connectivity of joined endcaps and Hubs. Even the port holes in the half-cube's side walls flex when stressed, which extends their hold on the posts, thereby improving the connection. More importantly, the flexure of the materials of the endcap's side walls, posts, and ports increases the "moment arm" resistance to separating joined components. More details of the technical characteristics of endcap 12 will be given later.

Endcap 12 is cup-shaped with four side walls 40-46 (FIG. 5B) and a top or butt-end 48 (FIG. 5A). The side walls 40-46 each have a longitudinal length which is approximately half of its transverse width. Inasmuch as side walls 40-46 depend from the periphery of butt-end 48, their transverse width is the same as each side of the square butt-end. Thus, the surface area of each of side walls 40-46 is essentially half the surface area of butt-end 48. Therefore, each endcap 12 can legitimately be viewed as a half-cube.

Butt-end 48 has two diagonally oriented posts 50 and two diagonally oriented ports 52 formed thereon; the importance of this criss-cross diagonal arrangement of posts and ports will become increasingly clear as the disclosure unfolds. All of the posts and ports in all of the Olympic Game Kit's components and accessories are designed to be identically sized and shaped, within manufacturing tolerances, such that each of said ports 52 can universally receive and hold any of the posts 50 snugly therein.

A centrally located aperture 54 is recessed into butt-end 48 and slidingly receives a screw 56 (FIGS. 6A-6B) which is threaded into internal threads 32 of connector 22.

The edges 58 at the intersection of butt end 48 with side walls 40-46 are rounded for safety reasons. Each edge 58 has two recesses 60 formed therein. The recesses of two opposing side walls 40 and 44 of endcap 12 include a pair of indicators 62, each of which is illustrated as a ridge centrally located within its recess 60. The recesses 60 on the other two side walls 42 and 46 are empty, i.e., they do not have a ridge 62 formed therein. Indicator 62 is shown as a ridge, but it could be any type of textured surface area, a color-coded area, a decal, or any other mark which would visually, and preferably tactually as well, distinguish one set of opposing sides from the other set. A beveled slot 64 with substantially orthogonal side walls 66 is centrally located in each of the four intersection edges 58. Slots 64 are instrumental in disconnecting joined endcaps as will be described presently.

FIG. 5B shows the underside (inside) of endcap 12. A receptacle 68 and strengthening ribs 70 are molded integrally with the side walls 40-46 and butt-end 48. Receptacle 68 has a square cross-sectional shape, the side walls 72 of which taper slightly inwardly, corresponding in angle to the tapered side walls 34 of connector end 30 of connector 22, in order to snugly receive connector end 30 therein. The square cross-section prevents relative rotation between endcap 12 and connector 22, and therethrough between endcap 12 and beam 14; the mating tapered surfaces prevent adaptor and endcap from being loosely connected which could produce relative vibration and rattling between adaptor and endcap. The bottom edges of side walls 40-46 smoothly define an open bottom 74 which is substantially planar and is opposite and parallel to top 48. Open bottom 74 has a dual-stepped peripheral recess 76 molded therearound for a purpose to be described. Strengthening ribs 70 each include an enlarged post 78 which is internally threaded for a purpose to be described.

Figure 6A:
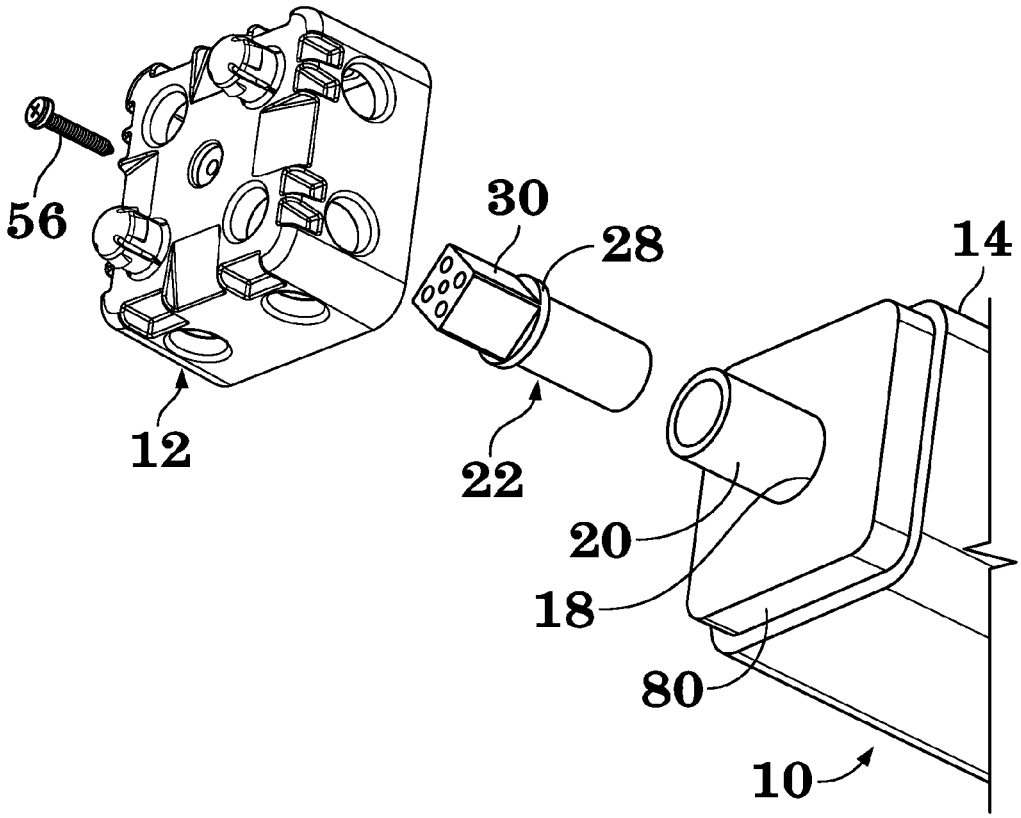
FIGS. 6A-6B are exploded perspective top and bottom (inside) views, respectively, depicting the attachment of an endcap to the foam bar.
Figure 6B:
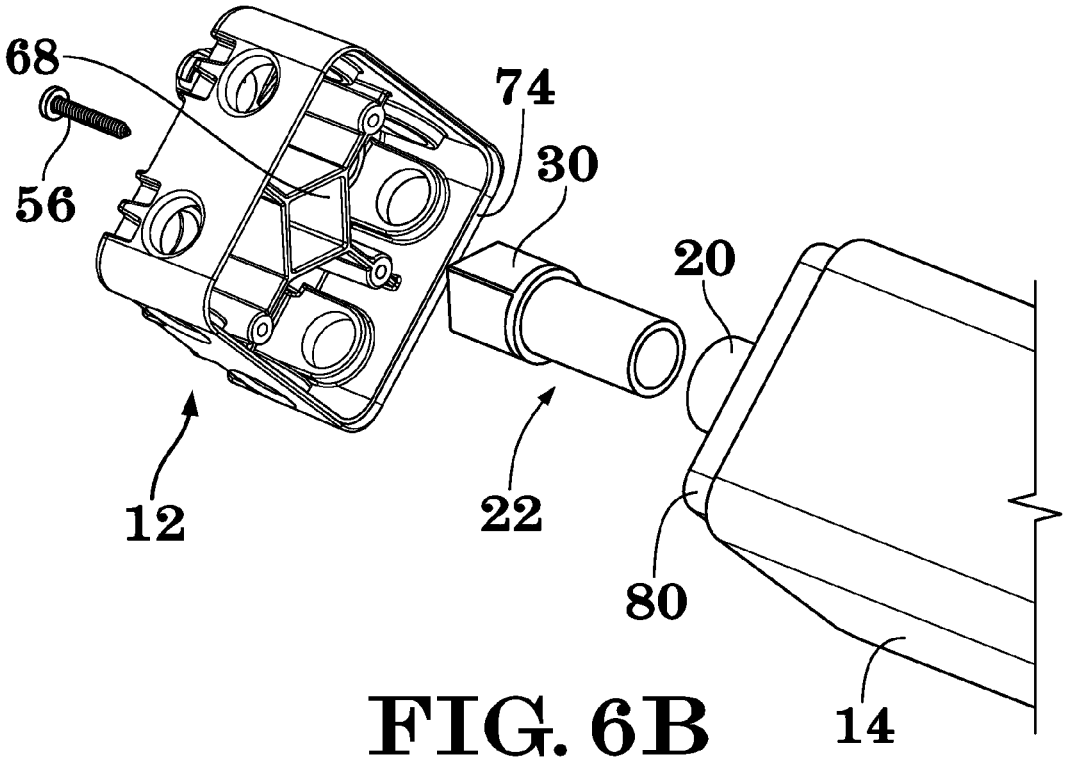

FIGS. 6A-6B are top and bottom perspectives, respectively, of the manner endcaps 12 are attached to the assembled beam 14 to form bar 10.

Bar 10 is assembled by fixedly securing spine 20 in circular channel 18 of beam 14, after ensuring that it extends substantially throughout the length of beam 14. Connector 22 is axially slid into spine 20 until limiting flange 28 abuts the end of spine 20 and is fixedly attached therein, taking care that connector 22 is rotationally oriented such that the rectangular cross-sections of endcap 12 and beam 14 are properly aligned. Receptacle 68 of endcap 12 is snugly fit on the connector end 30 of adaptor 22 and is removably secured in place by screw 56. It is within the scope of the claimed invention that endcap 12 be permanently attached to adaptor 22 by any known means, e.g., gluing or vibration bonding.

Figure 10A:
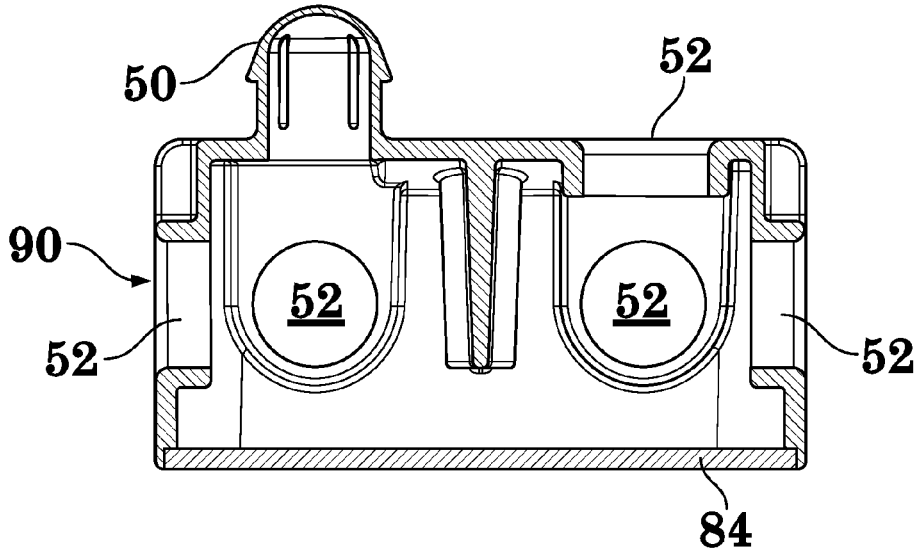
FIG. 10A is a transverse cross-sectional view of the Hub of FIG. 9A as taken through lines X-X of the endcap of FIG. 7A.
Figure 10B:
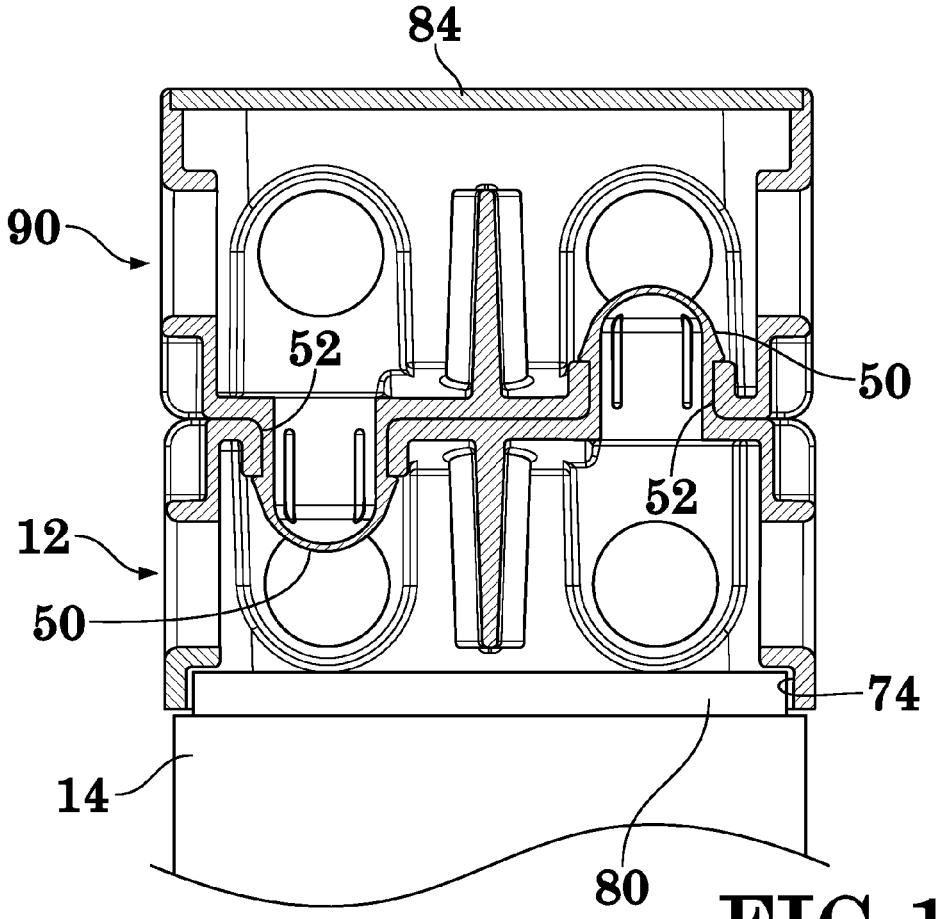
FIG. 10B is a transverse cross-sectional view of the Hub of FIG. 10A snap-fit to an endcap on the end of a rigid bar.

The end of beam 14 is stepped-down at 80 from the body of beam 14 an amount equal to the thickness of side walls 40-46, so that when bottom 74 snugly receives the stepped end 80 of beam 14 in the bottom step of peripheral recess 76, all exposed mating surfaces will be substantially flush (see FIG. 10B). The axial dimension of stepped end 80 is such that it does not block ports 52 in side walls 40-46 from receiving posts 50 therein. Beam 14 can be produced without stepped end 80, as a less expensive alternative, but doing so would require rounding the edge of open bottom 74 for comfort and safety.

The environment of use of the foam beam and the plastic endcap, namely, outdoors in the sun and in a chlorinated swimming pool, tends to deteriorate any material. Although the materials selected for the beam and endcap are particularly resistant to sun and chlorine, additives well known in the art can be added to them prior to their formation, in order to extend their life even further. In time, however, all materials will eventually lose their smooth feel, their vibrant colors, and their resiliency. When the foam material of beam 14 ultimately deteriorates due to sun, pool chemicals, and extended use, its endcaps 12 can be removed for recycling onto a new beam 14. Removably attaching endcap 12 to beam 14, instead of permanently fixing it thereto, also allows the endcap to be removed for cleaning, if needed.

Figure 7A:
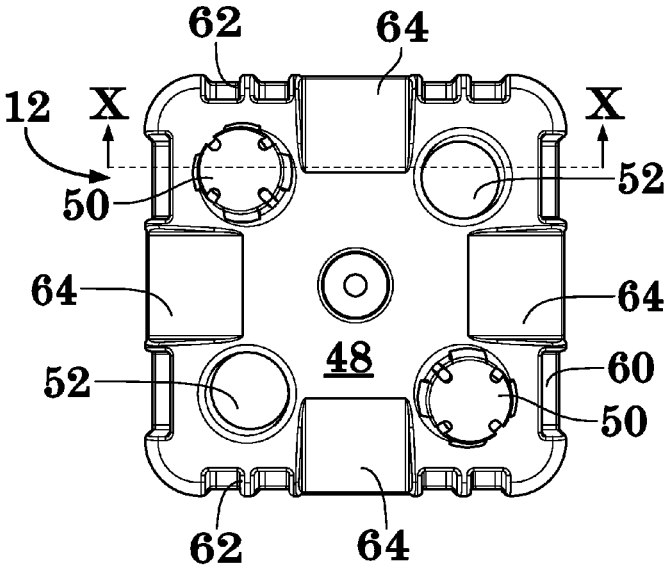
FIGS. 7A-7C are top, side, and bottom views, respectively, of the best mode of the endcap of the invention.
Figure 7B:
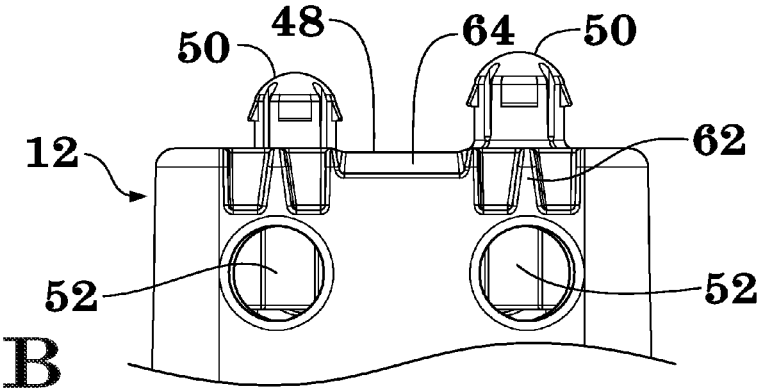
Figure 7C:
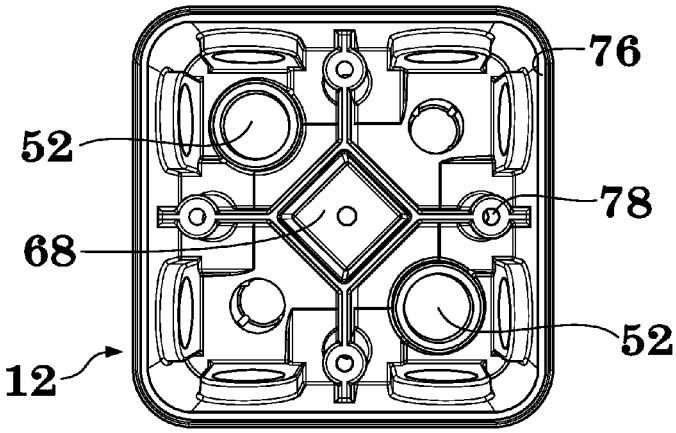

FIGS. 7A-7C show top, side, and bottom views, respectively, of endcap 12 where the salient features are referenced: Butt-end 48, posts 50, ports 52, blank recesses 60, indicator ridges 62, disconnect slots 64, side wall ports 52, receptacle 68, peripheral recess 76, and enlarged internally threaded posts 78.

As most clearly seen in FIG. 7A, posts 50 are centered on one of the diagonals of butt-end 48 and ports 52 are centered on the other of the diagonals of butt-end 48. For reasons which will become apparent, one of the posts 50 is consistently positioned visually at "10:30" on a clock face when indicators 62 are facing vertically (upwardly in the plane of the drawing in FIG. 7A).

The posts and ports are located at the corners of an imaginary square and are thereby spaced equidistant from their neighboring ports and posts, respectively. The sides of the imaginary square are about half the length of the sides of butt-end 48. For example, the adult-sized butt-end 48 is roughly four inches square, and the posts and ports are centered on a diagonal and spaced about one inch from each of their closest adjacent sides and about two inches from their nearest neighbor. While this set of approximate dimensions is the preferred, there is latitude in the specific dimensions.

This configuration comprising the relative positioning of the posts and ports will be referred to as "standard" hereinafter in this specification and the appended claims. That is, the width of the imaginary square is the same fixed dimension, and the posts and ports are centered on the corners thereof. It is irrelevant whether the four corners have alternating posts and ports, as is the case for the butt-end of the rigid bar endcap, or all four corners have posts centered thereon, or all four corners have ports centered thereon, the array is considered "standard." It is maintained throughout the various arrays of posts and ports on all of the components of the Olympic Game Kit. Being standard assures the interconnectivity of all components.

Each of the four side walls 40-46 have two ports 52 formed therethrough to provide connectivity on all four of the exposed sides of endcap 12. The two ports are spaced apart the standard distance of posts and ports, above, and the array is centered on its side surface. (In order to avoid cluttering the drawings, only representative ports are indicated by reference numerals. Other multiple features will also be sparingly referenced.)

Figure 8A:
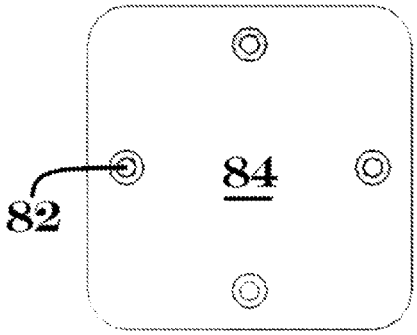
FIGS. 8A-8D show four embodiments of endcap cover plates, each of which, when affixed to the bottom of an endcap, closes the open end and creates a Hub.
Figure 8B:
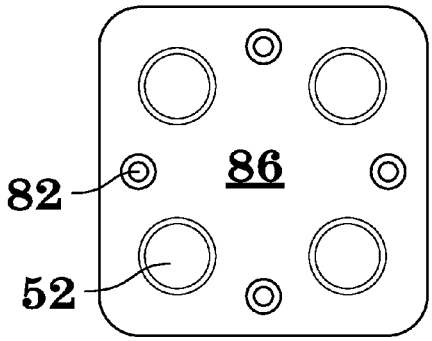
Figure 8C:
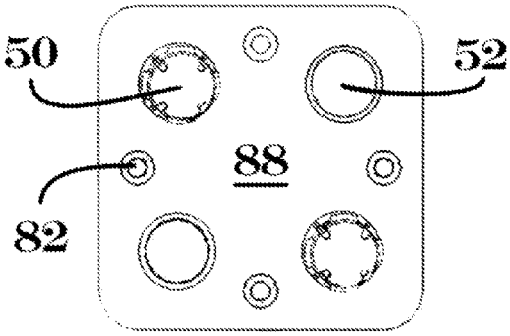
Figure 8D:
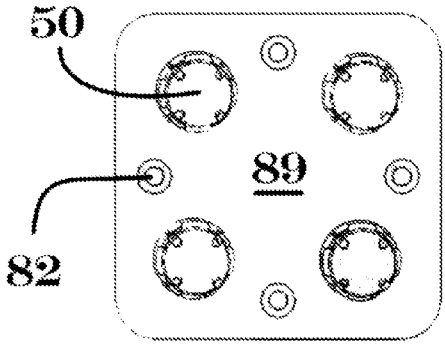
Figure 8E:
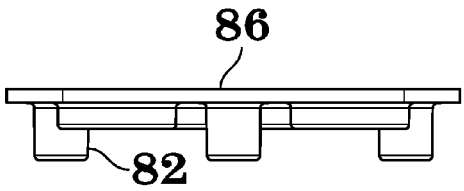
FIG. 8E shows a side view of the cover plate of FIG. 8B.
Figure 8F:
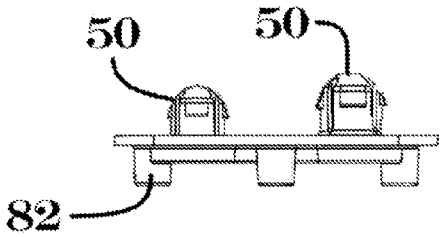
FIG. 8F shows a side view of the cover plate of FIG. 8C.
Figure 9A:
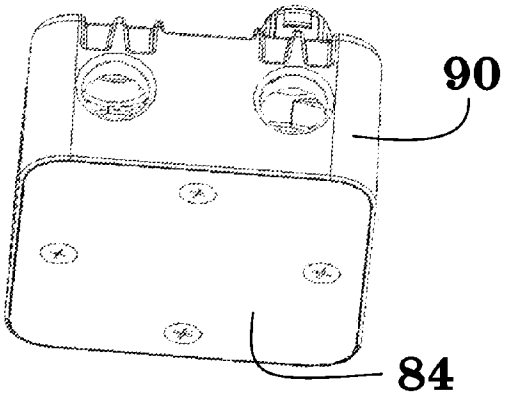
FIGS. 9A-9D are perspective views of four embodiments of Hubs illustrating the four cover plates of FIGS. 8A-8D, respectively, attached to the open ends of the endcaps shown in FIGS. 7A-7C to provide four unique adaptor Hubs for different environments.
Figure 9B:
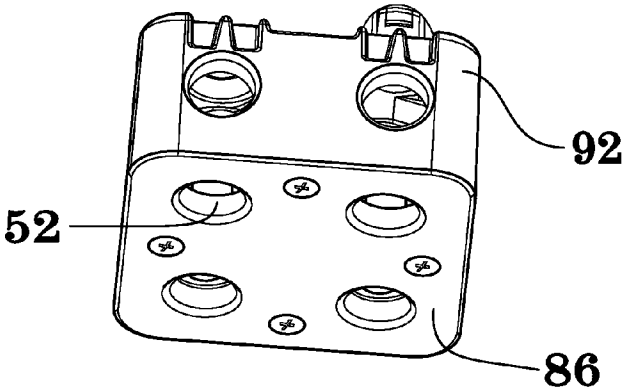
Figure 9C:
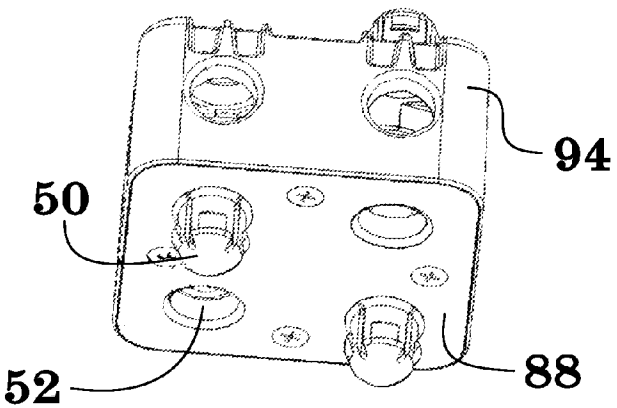
Figure 9D:
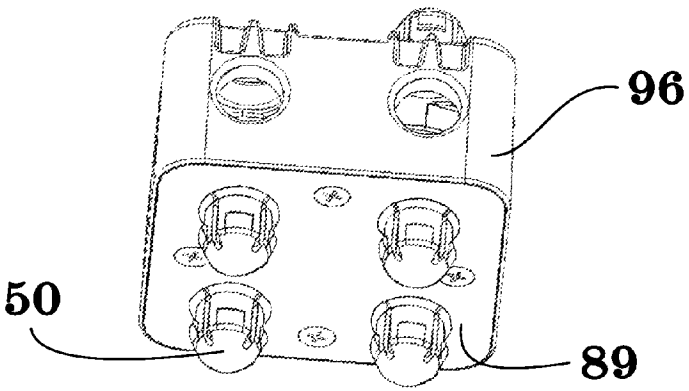

FIGS. 8A-8D are top views of four different cover plates for closing the open bottoms 74 of endcaps 12 in order to make Hubs. FIG. 8E is a side view of the cover plate of FIG. 8B; FIG. 8F is a side view of the cover plate of FIG. 8C.

All cover plates fit within the top step of peripheral recess 76 and are secured therein by screws (FIGS. 9A-9D) through four screw receiving apertures 82 spaced to mate with the four threaded posts 78 inside of endcap 12 (FIGS. 5B and 7C). As before; permanently fixing the cover plates to the endcap by gluing or ultrasonic bonding is within the scope of the claimed invention. Addition of a cover plate to an endcap converts the endcap into a Hub, an accessory whose structure and function is to be described in detail soon. A foam insert may be added to increase buoyancy. Each of these Hubs is considered as comprising a half-cube.

Four types of plates are contemplated. Plate 84 (FIG. 8A) is plain with no posts nor ports; when secured to an endcap 12, plate 84 closes open bottom 74 completely, presenting a smooth, unbroken surface. Plate 86 (FIG. 8B) has four ports 52 therethrough, oriented on the plate in the same standard configuration as the posts and ports of butt-end 48, which, when secured to an endcap 12, is capable of receiving posts of other endcaps or other Hubs. Note that the surface of plate 86 which is presented to the user has no projections extending away from it. Plate 88 (FIG. 8C) resembles a butt end 48 in that it has two posts 50 and two ports 52 diagonally oriented in the standard configuration. And, plate 89 (FIG. 8D) has four posts 50 arrayed in the standard configuration.

FIGS. 9A-9D are bottom perspective views of Hubs 90-94 after being fit with plates 84-88, respectively. Hubs function as spacers, connectors, support clips, anchors, and adaptors when joining bars together to form patterns. Hub 90 (FIG. 9A) has a smooth bottom 84, covering the rough internal surfaces of endcap 12. Hub 92 (FIG. 9B) has four ports in its bottom surface 86; posts of any endcap or Hub can be joined therewith in any rotational orientation. Hub 94 (FIG. 9C) has a bottom 88 with the standard diagonal presentation of post and ports; endcaps and other Hubs 94 can be joined thereto in only two rotational orientations, one hundred eighty degrees apart, wherein the indicators 62 of the joined components will be coplanar. Hub 96 (FIG. 9D) has a bottom 89 with four posts 50 arranged in the standard diagonal configuration. Hub 96 strengthens selected joints, as will become more apparent relative to FIGS. 12A-D. It is contemplated to also provide full cube Hubs in which the side surfaces 40-46 have four ports arranged as standard. Full cube Hubs find utility in connecting, separating, and properly spacing components in some patterns.

Hub 90 is shown in FIG. 10A in cross-section as seen along similar lines as lines X-X of FIG. 7A, i.e., as taken parallel to one edge through one of the posts 50 and its adjacent neighboring port 52. Also visible are ports 52 opening through the sides walls. Closure plate 84 covers the open bottom of endcap 12.

FIG. 10B depicts a linear bar-to-Hub connection shown in cross-section as taken along lines X-X of FIG. 7A through a post 50 and its neighboring port 52. A beam 14 extends downwardly in the drawing from the open bottom 74 of endcap 12 with stepped end 80 of beam 14 received within said open bottom, as shown. The butt-end of endcap 12 is snap-fitted into the butt-end, i.e., the top, of Hub 90. As clearly seen in FIG. 10B, one post 50 from each of endcap 12 and Hub 90 is snap-fit into one port 52 of the other component with the posts 50 pointing in opposite directions. The other post of endcap 12 and the other post of Hub 90, not seen in the FIG. 10B cross-section, simultaneously snap-fit into the other facing ports, so that the joining of the endcap and Hub comprises four posts being snap-fit within four ports, making for a very solid four post connection.

Figure 11A:
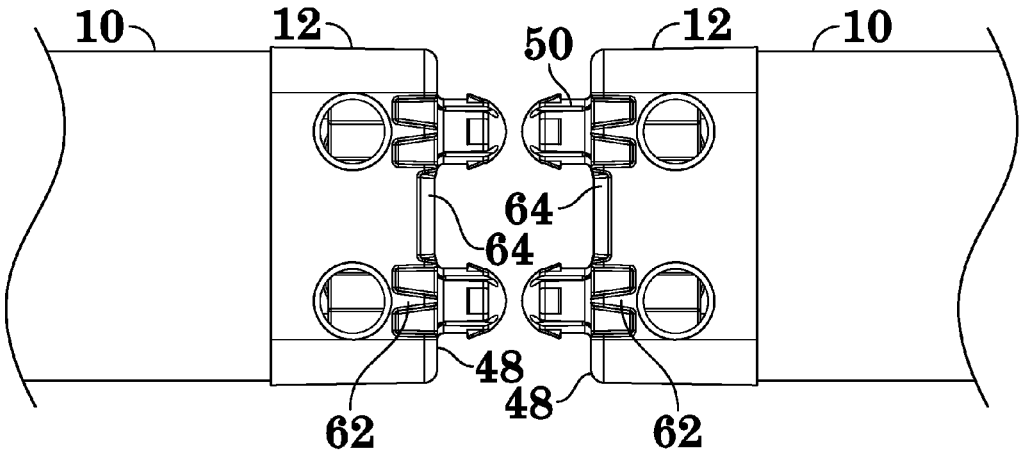
FIG. 11A is a top view of two opposed bars prior to being joined bar-to-bar, i.e., end-to-end.
Figure 11B:
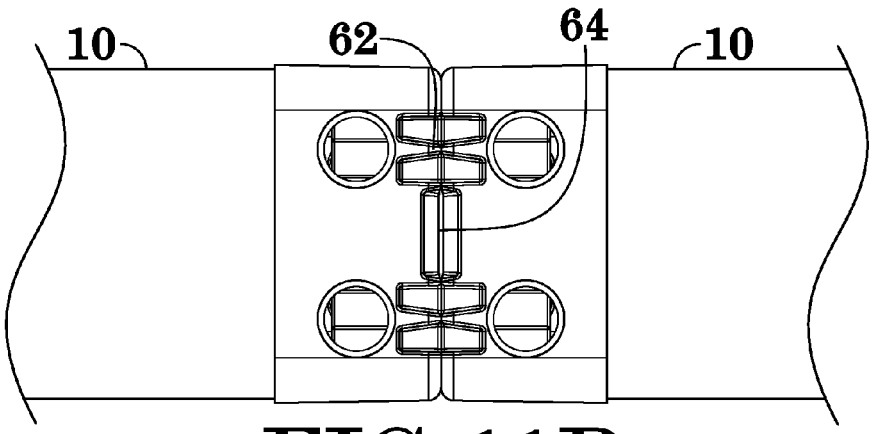
FIG. 11B is a top view of the two bars of FIG. 11A after being snap-fit together.
Figure 11C:
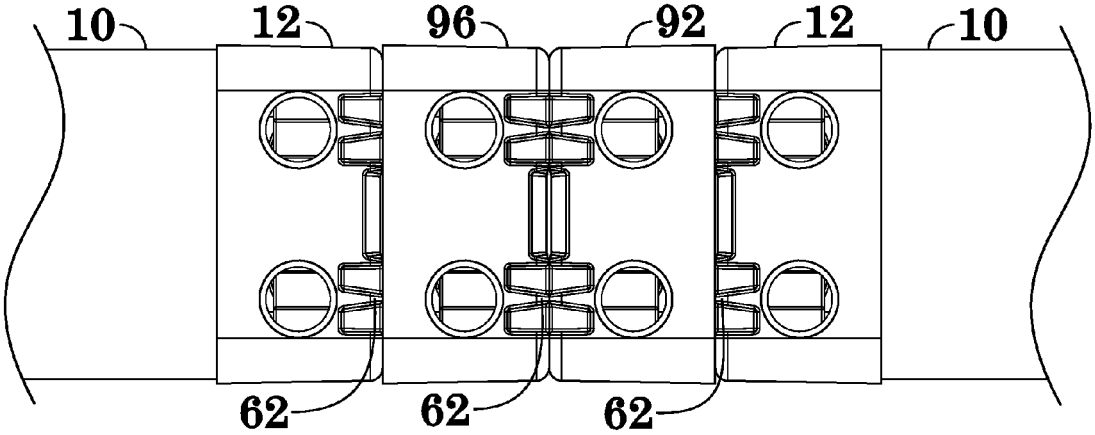
FIG. 11C is a top view of the two bars of FIG. 11A snap-fit together linearly, end-to-end, with two interposed Hubs.

Turning now to FIGS. 11A-11C where two bars 10 are joined together linearly, end-to-end, bar-to-bar.

When connecting two bars 10 together bar-to-bar, butt-end to butt-end, they are initially placed on a flat surface, for example resting on the ground or floating on the surface of water, with the butt-ends 48 of two endcaps 12 facing one another. The cubic shapes of beam 14 and endcaps 12 makes handling the rigid bars easy, since the bars rest on the flat surface without rolling or otherwise moving. If both indicators 62 on each confronting endcap 12 are both facing upwardly, or if the coplanar recesses 60 on each confronting endcap 12 are both blank (the blank sides are actually just another type of indicator), the two diagonally oriented posts 50 of each endcap will align with the two diagonally oriented ports 52 (not seen in FIGS. 11A-11B) of the other endcap. If the coplanar indicators 60 and 62 on each confronting endcap 12 are different, i.e., one is blank and the other has a ridge, then the posts on each will abut a post on the other, making it impossible to snap-fit them together. In that case, the alignment of indicators can be achieved easily by just rotating one of the bars ninety degrees. The handler need only rotate one bar until the indicators 60 or 62 on both confronting endcaps are on parallel surfaces to properly align the posts and ports. This can be accomplished while the bars are lying on the ground without the handler needing to lift one or both ends to visually confirm the locations of the posts and ports. Visual and preferably tactual indicators simplify making all connections, which saves the handler a considerable amount of time when assembling a large, complex pattern. Once similar indicators are facing upwardly, the handler then grasps the two bars 10 anywhere along their lengths where convenient and firmly pushes them together, forcing all four posts 50 into all four ports 52 by snap-fit (FIG. 11B). Posts 50 and ports 52 are resilient enough to deform sufficiently to allow entry of the posts into the ports, after which their joining will firmly hold the two bars together. (Detailed discussions of the specifics of the best mode of endcaps 12 will be given at the end of the specification, where various alternative embodiments of endcaps will be compared thereto.)

Note that when joined together as in FIG. 11B, the sides surfaces of the two endcaps mate to create a full-cube side, equal in size to the butt-end of an endcap. The four ports 52 are thereby oriented in the same standard configuration, ready for receiving another bar's butt-end or a Hub's butt-end, as will be disclosed soon.

In assembling some of the patterns which follow, spacers are often needed to make the pattern conform to particular design specifications. FIG. 11C shows the use of the combination of Hubs 92 and 96 (or two Hubs 94) acting as spacers; the use of either combination is preferred, since it is the strongest, having four post connectivity between both Hubs and between each Hub and each endcap. A full-cubed Hub (not shown) is particularly useful in this situation, since there are fewer components to handle in assembling the pattern. By paying attention to the indicators 62 and maintaining them upwardly for all components, as seen in FIGS. 11A-11C, consistency in post-and-port orientations can be maintained when assembling a large pattern.

Figure 11D:
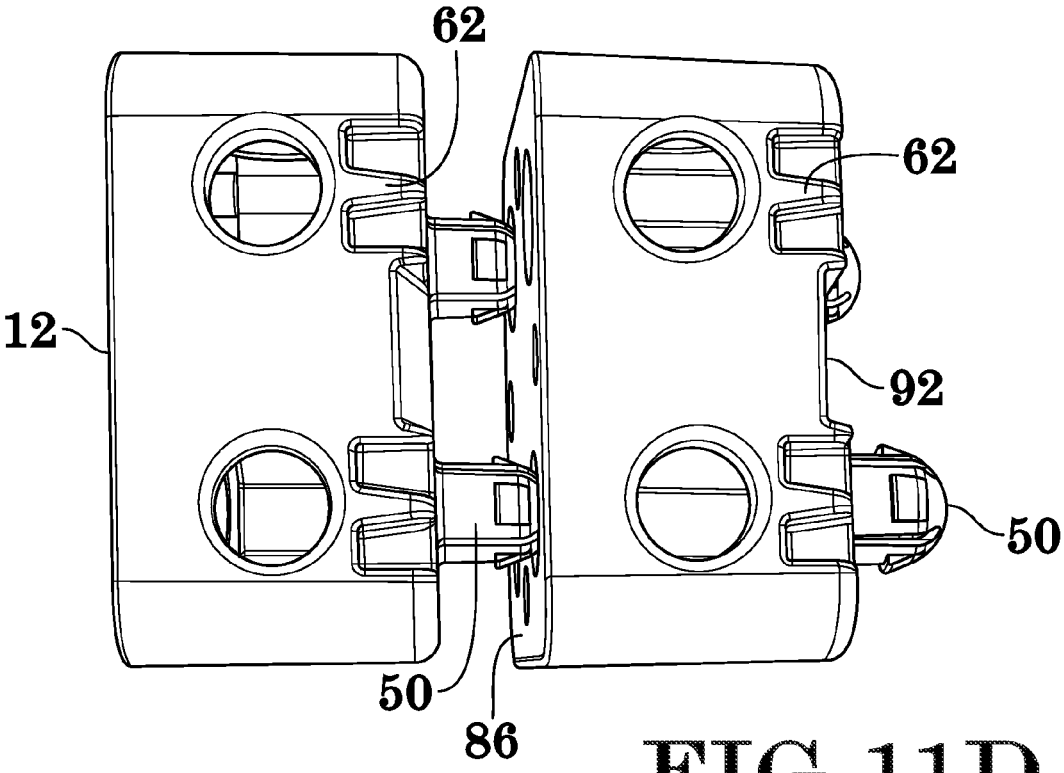
FIG. 11D shows two Hubs joined together such that the indicators are matched.
Figure 11E:
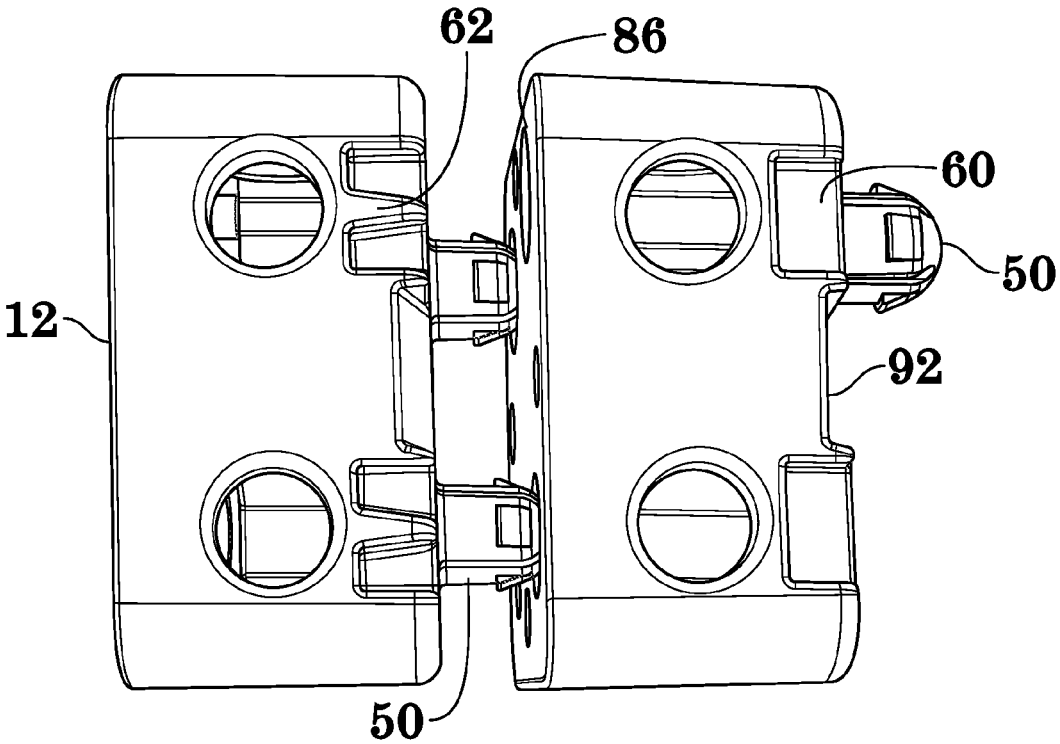
FIG. 11E shows two Hubs joined together such that the indicators are mismatched.

It often occurs, however, that two teams of handlers are needed to assemble a particularly large or complex pattern, with each team working on a different segment of the pattern. One team may find it has positioned all indicators 62 facing upwardly, as is always recommended, while the other team may have thoughtlessly positioned all smooth indicators 60 facing upwardly. When the time comes to join the two segments together, the posts and ports will be mismatched. FIGS. 11D and 11E show how the problem of joining them is easily resolved.

Assume in FIG. 11D a bar's endcap 12 of one segment is designed to be attached to a right-hand segment (not shown) through an interconnecting Hub 92. If both segments were assembled with all indicators 62 facing upwardly, a Hub 92 with its indicators 62 also facing upwardly is used as a connecting link between the two segments, as in FIG. 11D, and the two segments of the pattern would be successfully joined together. The posts and ports of both segments would match, and Hub 92 would merely translate the post and port orientations through from one segment to the other. (A Hub 94 with posts and ports on opposing ends could also be used, if a stronger joint is desired.) However, if the left-hand segment had been assembled with indicators 62 facing upwardly but the right-hand segment had been assembled with the smooth surfaced recesses 60 facing upwardly, when it comes time to join them together, the posts and ports would not match. A Hub 92 easily compensates for the mismatch. By rotating Hub 92 ninety degrees relative to its FIG. 11D orientation, thereby facing the smooth recess 60 upwardly as shown in FIG. 11E, the two segments are once again easily linked together. This is due to plate 86 on Hub 92 (FIG. 9B) presenting four ports 52 to endcap 12. There are no posts 50 on Hub 92 to abut the posts 50 on endcap 12 (FIG. 11E), so endcap 12 is capable of being snap-fit to Hub 92 regardless of the latter's relative rotational orientation. The "10:30" positioning of the post 50 on butt end 48 of Hub 92, however, has been rotated to "1:30" and can now mate with the posts and ports of the second segment. Hub 92, therefore, allows the joining of mismatched segments of a pattern without having to disassemble and reassemble one of the segments, a huge time-saver when dealing with large, complex patterns.

There will often be circumstances in which a Hub cannot be inserted between two mismatched segments of a pattern. Instead, all connections therebetween must be by means of rigid bars. In those situations, one of the endcaps 12 on the connecting rigid bars of one segment which are to be joined to the other segment are simply removed from their bars, rotated ninety degrees, and reattached to their bars. Rotation of only one of the two endcaps on a bar effects the same transmutation of the "10:30" positioning of the posts on one end to the "1:30" position on the other end.

Eight standard types of attachment joints are shown in FIGS. 12A-14B. All of these joints are two-dimensional. Patterns consisting of these types of joints will all lie in a single plane, such as floating on the surface of a swimming pool. Three dimensional joints and the patterns they make possible will be discussed later.

Figure 12A:
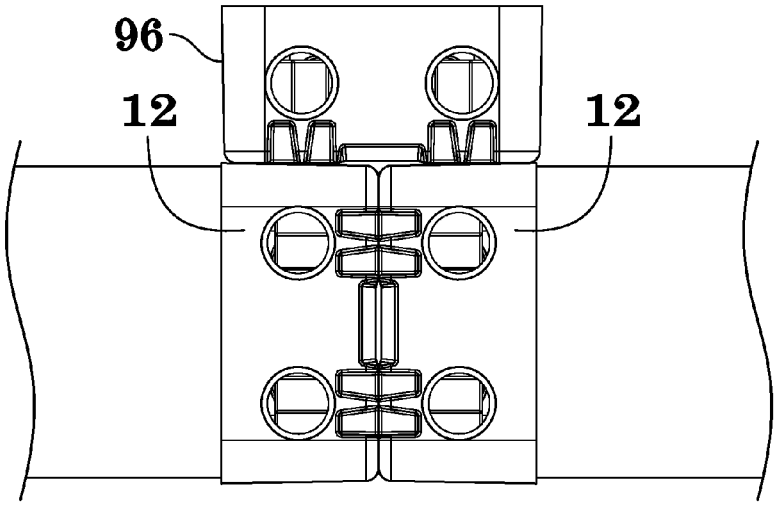
FIG. 12A is a top view of the two bars of FIG. 11B with the connection being strengthened by the Hub of FIG. 9D functioning as a support clip.

When required, the joint formed by snapping two endcaps 12 together can be strengthened considerably by snap-fitting a joint support clip 96 (FIG. 9D) to the side ports of both endcaps 12. The four diagonally arranged posts of support clip 96 are joined to the four ports in each of the side surfaces of the bar-to-bar connected endcaps 12, linking and locking the bars together in the same four post joinery as with bar-to-bar connections. In order to attach the support clip 96 to the bar-to-bar joint illustrated in FIG. 12A, two of the four posts protruding from plate 89 is snap-fit into the two side ports of each of endcaps 12 as shown. If more strengthening is deemed desirable, additional clips 96 (not shown) can be snap-fit to any of the other side ports of both endcaps 12.

Where it is desirable to present a smooth outer surface of the support clip (upwardly as seen in FIG. 12A), either of Hubs 90 or 92 (FIGS. 9A-9B) are profitably used in place of Hub 96, since the exposed surfaces of plates 84 and 86 do not impose unwanted projections outwardly from the pattern, as would the posts 50 on the butt-end 48 of Hub 96. Such a substitution comes at the sacrifice of the strength of a Hub 96 joint, but if the environment will permit, it is a useful alternative. The determining factor in the selection of Hub 90, 92, or 96 would be whether or not another component is anticipated as being attached to support clip.

Figure 12B:
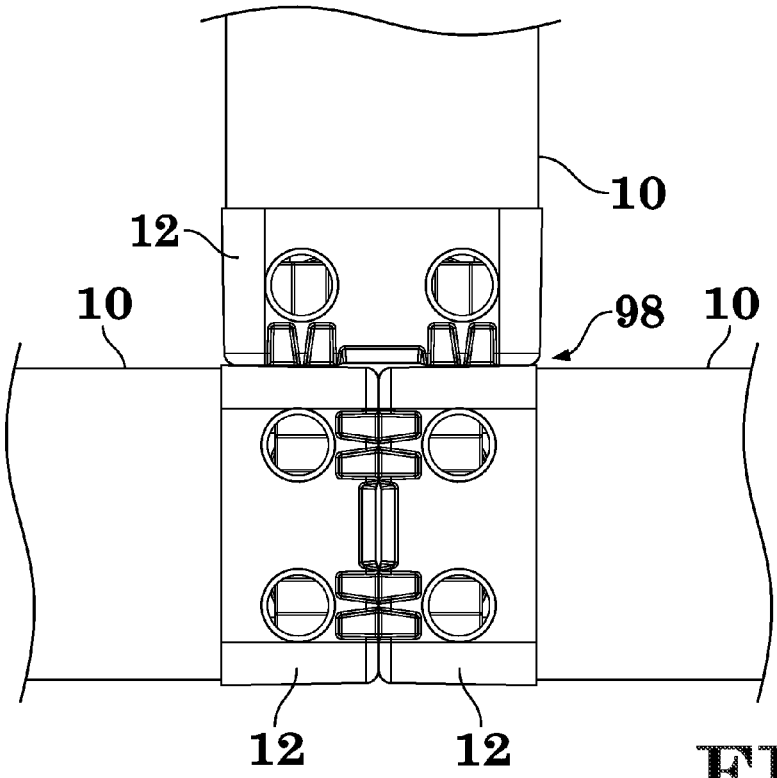
FIGS. 12B-12D are top views showing three variations of T-joints comprising the two bars of FIG. 11B joined with a third bar which extends at right angles to said two bars, all three of said bars residing in the same plane.
Figure 12C:
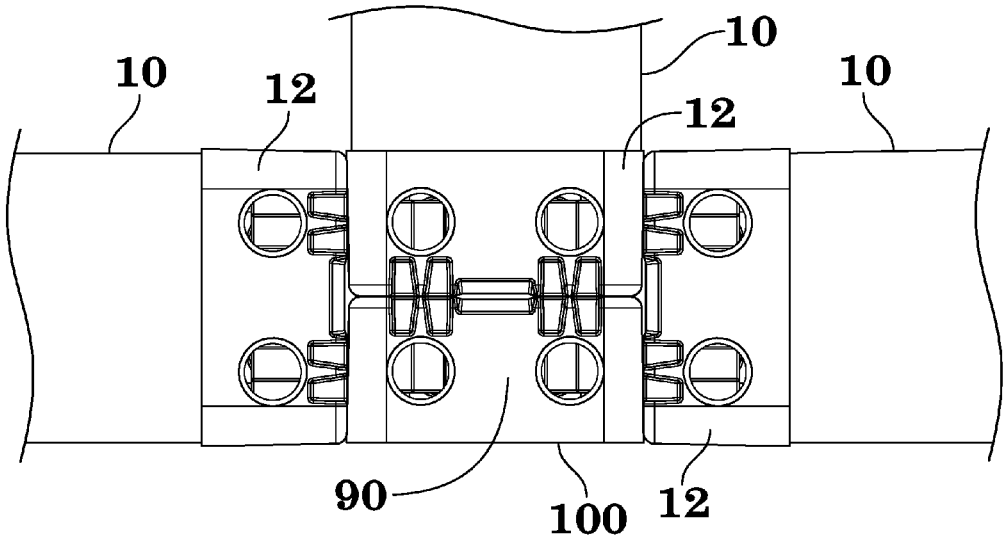
Figure 12D:
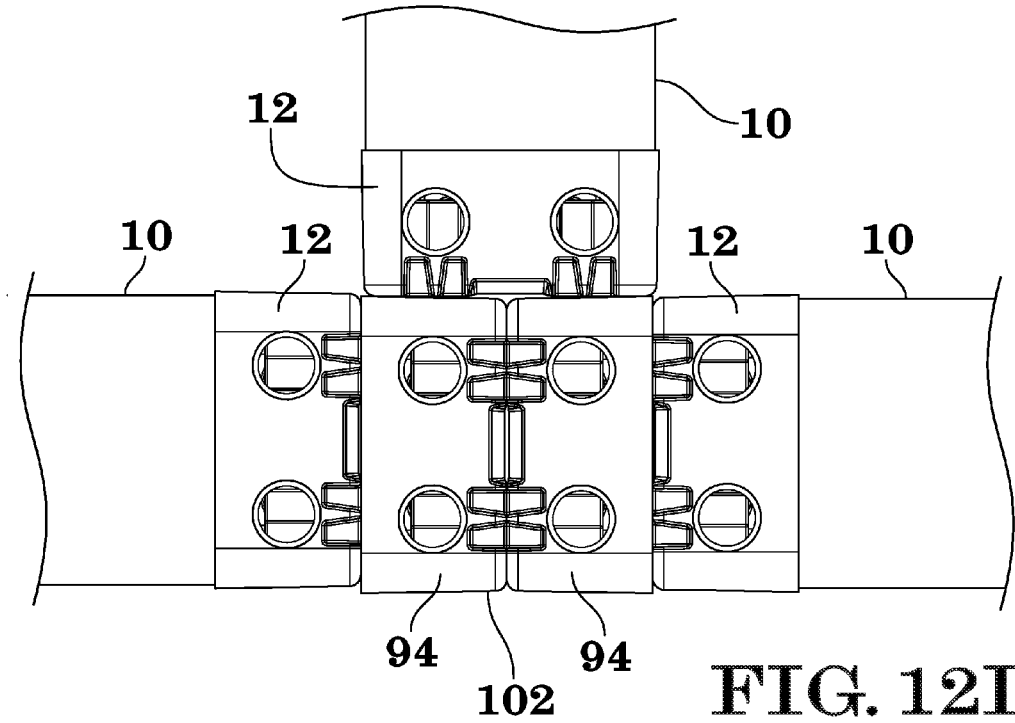

Three T-joints for three bars 10 are shown in FIGS. 12B-12D.

In FIG. 12B, T-joint 98 comprises three bars snapped together without the use of intermediary Hubs. This is the quickest, easiest, and most common of the T-joints used, since it requires the fewest number of components and thereby the fewest number of connectivity actions. Two bars 10 are first joined bar-to-bar as in FIG. 11B with endcaps 12 facing each other. Then, another bar 10 is joined thereto orthogonally by snap-fitting an endcap 12 into the ports 52 (not seen) on the coplanar sides of the confronting, joined endcaps 12.

FIG. 12C illustrates T-joint 100 comprised of joining three bars 10 together using a single Hub 90. Hub 90 is first attached to the butt-end of the vertical, top bar (as seen in the drawings) and then the other horizontal, left- and right-hand bars are snap-fit to the coplanar side surfaces of the top bar's endcap 12 and of Hub 90. Hub 90 is recommended inasmuch as it presents a smooth surface flush with the side surfaces of all three of the bars 10.

FIG. 12D shows a third T-joint 102 wherein two Hubs 94 are first joined together. The two horizontally aligned bars 10 are then attached to the cover plates of the two Hubs and the vertically extending T-bar 10 is attached to the coplanar sides of the two Hubs, as shown.

A visual comparison of the joints in FIGS. 12B-12D will show that the relative symmetry/asymmetry of the three bars are different in the three modes of forming a T-joint. Each will find its own utility in specific patterns.

Figure 13A:
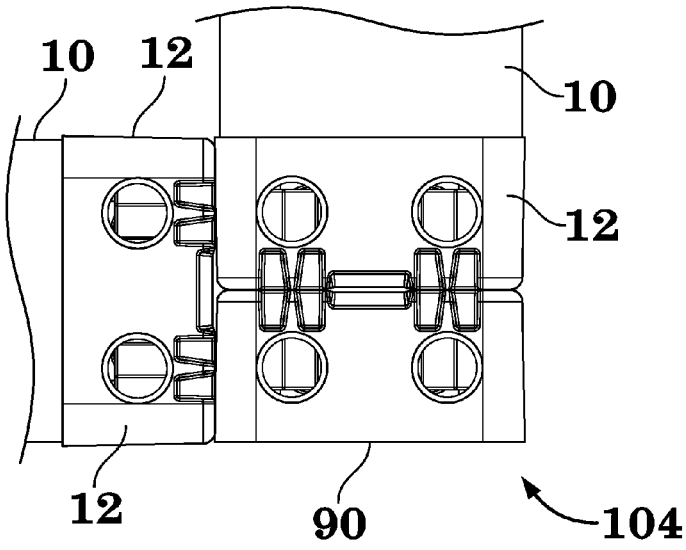
FIGS. 13A-13B show two modes of forming a corner from two bars joined together with one and two Hubs, respectively.
Figure 13B:
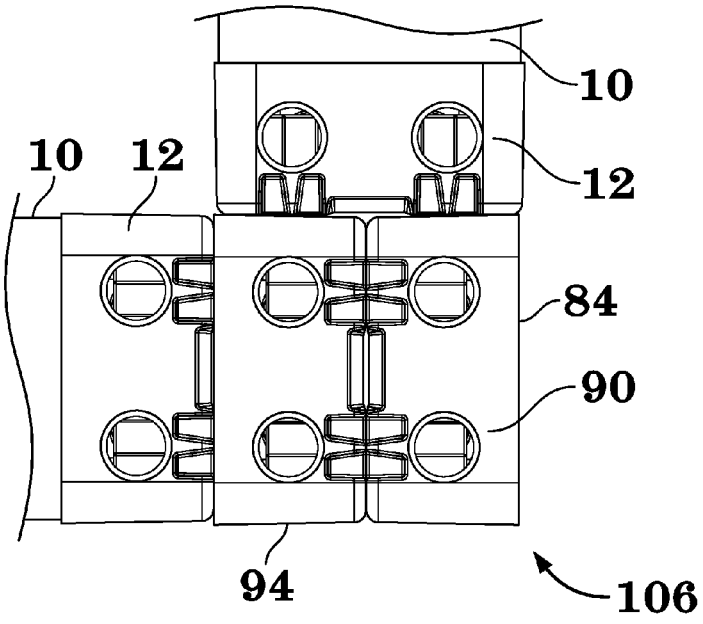

Corner joints are shown in FIGS. 13A-13B. Note that again, the relative orientations of the bars are different in the different modes.

In FIG. 13A, a first corner joint 104 is shown. A Hub 90 is attached to the butt end of endcap 12 of one of the bars 10, shown as the vertical bar in this drawing but it could, of course, be either one of the bars. Then the endcap 12 of a second bar 10 is attached to the coplanar side surfaces of the first endcap 12 and Hub 90. One purpose of Hub 90 is to round off the corner; otherwise, an unsightly gap would be present. A second purpose is to provide a sufficient base for the second bar; having two ports available for receiving its two posts yields a stronger connection.

A second corner joint 106 is shown in FIG. 13B. A Hub 90 is joined with a Hub 94 and a first bar 10 (horizontal) is attached to the cover plate of Hub 94. A second bar 10 (vertical) is then attached to the coplanar side surfaces of the two joined Hubs 90 and 94. A symmetrical configuration of bars is provided by joint 106. By facing the cover plate 84 of Hub 90 outwardly, a smooth surface rounds off the corner.

Figure 14A:
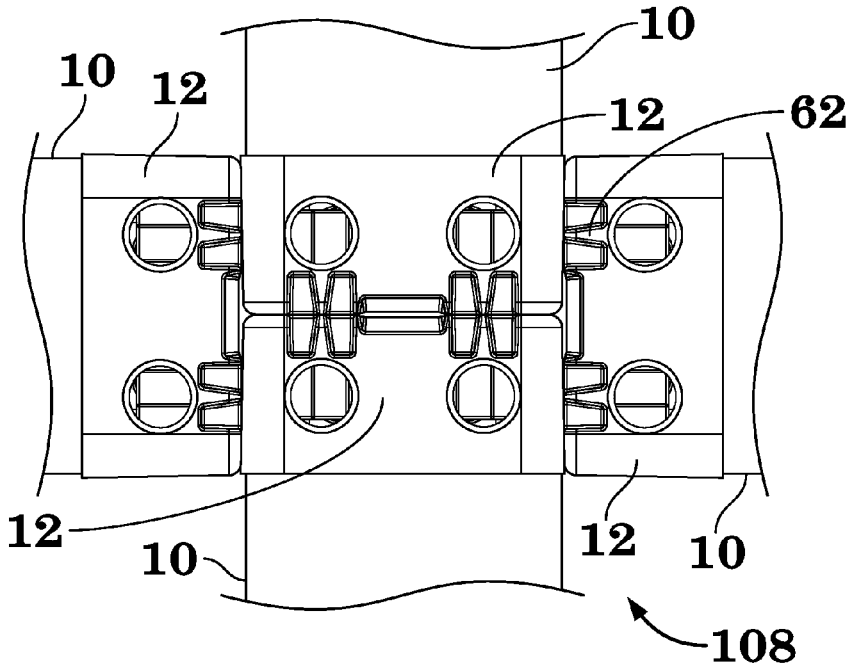
FIGS. 14A-14B show four bars joined to form a plus-shaped intersection of two perpendicular rows of bars, one without the use of Hubs and the other including two Hubs.
Figure 14B:
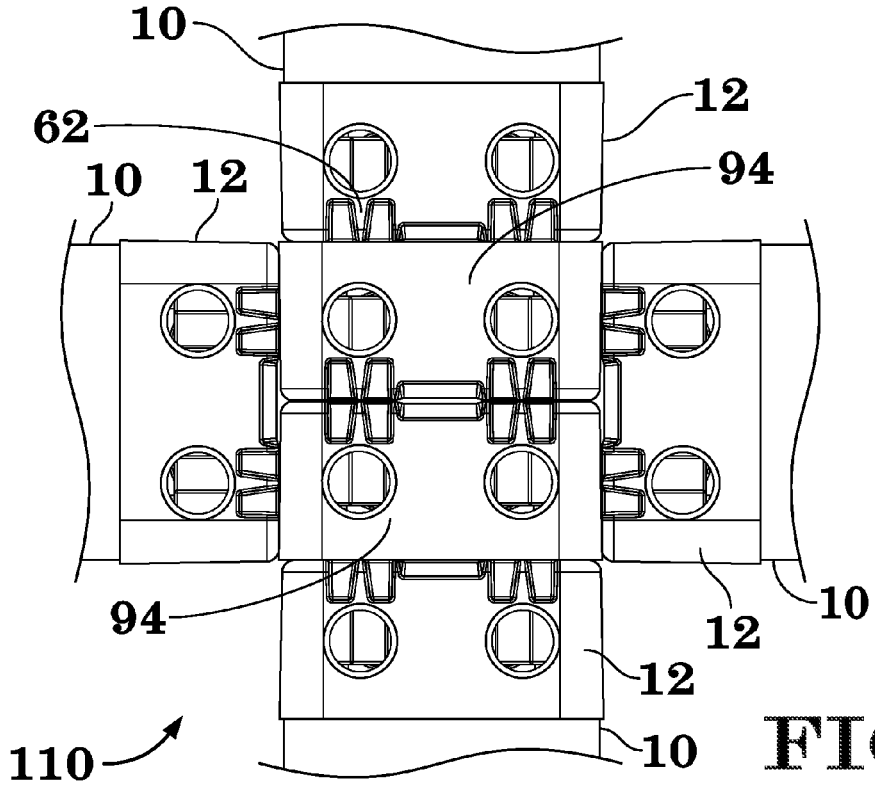

FIGS. 14A-14B show four foam bars 10 with their respective endcaps 12 joined together to form an intersection in the shape of a "plus." One or more of the bars and/or Hubs may need to be rotated ninety degrees until all indicators 62 are in the same plane, as shown, and the bars are then snapped together.

A first plus-joint 108 is seen in FIG. 14A wherein the two vertical bars 10 are connected bar-to-bar in a simple linear attachment, butt-end to butt-end; the two horizontal bars 10 are then added orthogonally thereto, being snap-fit to the side surfaces of the endcaps 12 of the two vertical bars 10. This is the simplest plus-joint, inasmuch as only bars 10 are needed, but it does result in an asymmetrical configuration.

In FIG. 14B, a symmetrical plus-type joint 110 is disclosed. Two Hubs 94 are snap-fit together, and four bars 10 are attached to each of the four vertically oriented surfaces.

Thus far, all the connections have been in a single plane, such as would be the case for patterns floating on the surface of a swimming pool. It is readily apparent, however, that 3-dimensional patterns are also easily accomplished.

Figure 15A:
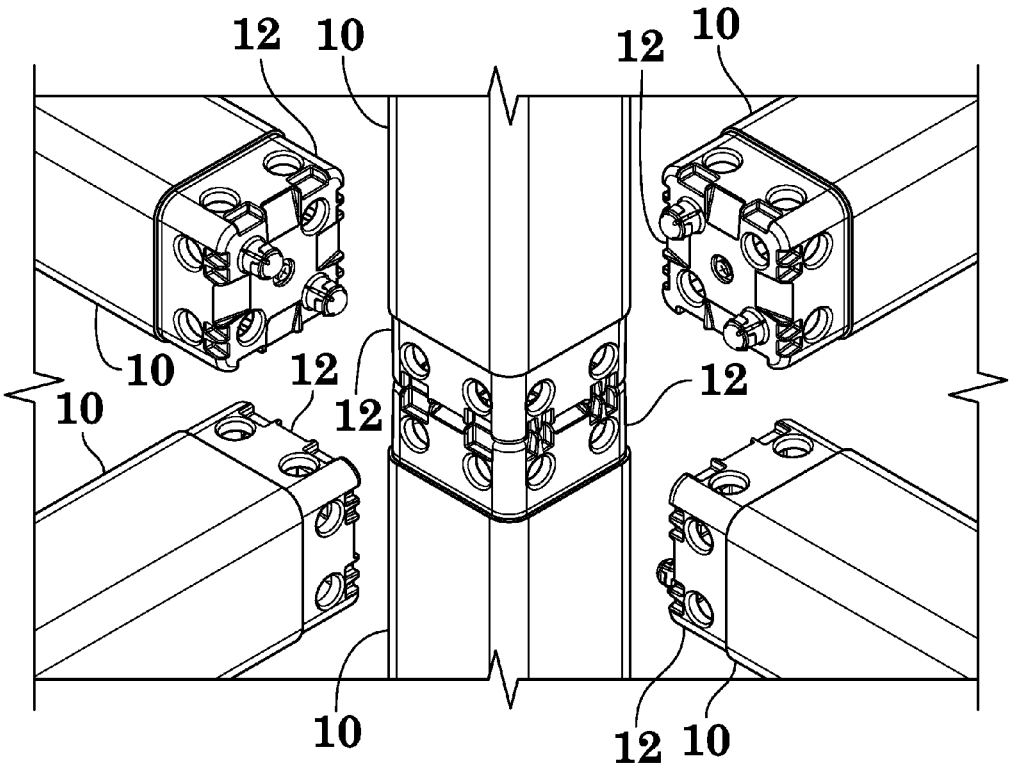
FIGS. 15A-15B depict one mode of a three-dimensional intersection formed by six bars just prior to being joined together and just after, respectively.
Figure 15B:
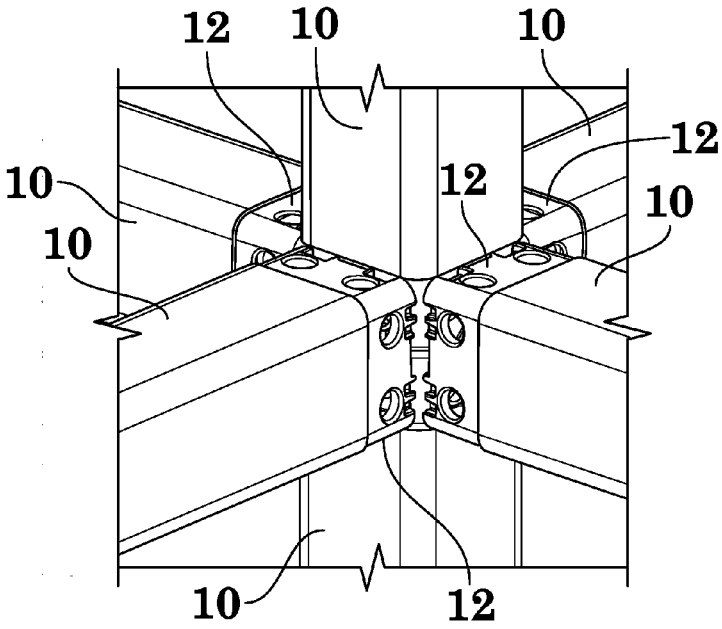

FIGS. 15A-15B show exploded and joined perspective views, respectively, of six bars 10 joined to form a three-dimensional pattern extending in the X-, Y-, and Z-planes. The simplest pattern, essentially actualizing the X-, Y-, and Z-axes, uses only bars with no intermediary Hubs. The two vertical Y-axis bars 10 are joined bar-to-bar as shown in FIG. 15A, and the endcaps 12 of four horizontal bars 10 are snap-fit into their facing, coplanar side surfaces of the endcaps 12 of the vertical bars in the manner shown in FIG. 15B.

Further details of the bars, the endcaps, the posts and ports, and accessory components used with them will be provided as the description of the invention unfolds. The above is believed to be a sufficient description to understand the manner of joining the bars and Hubs together. Further descriptions of their connectivity are therefore considered unnecessary and will not be repeated.

The genesis for the invention was to fulfill the need for activity directors of resorts, cruise lines, YMCAs, summer camps, and like environs to provide human sized (adult sized) "playing fields" in aquatic settings, namely, swimming pools, lakes, ponds, etc. The following descriptions are true to the origins of the invention and are in terms of swimming pool activities. While developed primarily for swimming pool use, a setting which imposes stringent requirements for the physical embodiments of the patterns, and thereby the pattern making Kit itself, it is readily apparent many of the patterns disclosed herein can be used with equal benefits on solid surfaces, e.g., gymnasium floors, ball fields, recreation rooms, and the like. Use of the disclosed Kit and the patterns resulting therefrom in non-aquatic settings are within the scope of the claimed invention.

FIGS. 16-19 depict four quick and easy structures capable of being assembled using no more than the rigid bars and the methods of joinery already described.

Figure 16:
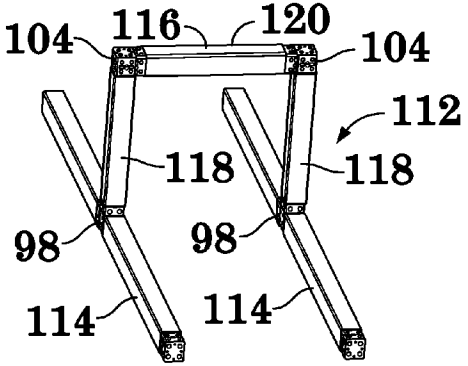

FIG. 16 shows a floating gate 112. A pair of parallel base strips 114 is each formed by joining two bars 10 bar-to-bar. An arch 116 comprising a pair of vertical risers 118 connected to base strips 114 by T-joints 98 and to a header 120 by corner joints 104. Gate 112 provides an unobstructed surface level pathway between the gate's floating base strips. Floating gate 112 is a subcombination which is extensively used in the construction of a multitude of patterns, as will become very apparent. Often the floating gate is assembled after the floating base is in place by attaching risers 118 to the endcaps 12 of base strips 114; see FIG. 12B for an enlargement of T-joint 98. A Hub 90 is joined to the upwardly extending free end of risers 118. Then one end of header 120 is snap-fit into two of the four ports exposed on the sides of the riser endcap 12 and Hub 90, as seen more clearly in FIG. 13A. Header 120 is a rigid bar 10 with the usual diagonal posts and ports on its butt-end. Consequently, the joint 104 is a two-post joint only. Inasmuch as the header 120 is temporarily supported only at one end, at least until the other end is also connected to a riser, there is a considerable "moment arm" force trying to separate joint 104 by pulling header 120 out of the endcap/Hub combination. Joint 104 is sufficiently strong to resist separation when the header comprises only a single rigid bar, but often header 120 will be required to span a longer distance, necessitating more than one rigid bar connected bar-to-bar between risers. In these situations, separation at joint 104 could be a problem. The problem is completely avoided by the addition of a Hub 96 to joint 104. Prior to connecting header 120, the four posts on cover 89 of Hub 96 are snap-fit into the four ports on the side surfaces of the endcap/Hub combination at the top of each riser 118. This transforms the connection between riser 118 and header 120 from a two-post joint into a four-post joint, doubling its holding capacity. Then the butt-end 48 of header 120 is snap-fit onto the butt-end of Hub 96. Since the joint between Hub 96 and the butt-end of header 120 is also a four-post joint, the cantilevered header is well supported by the new joint 104.

Figure 17:
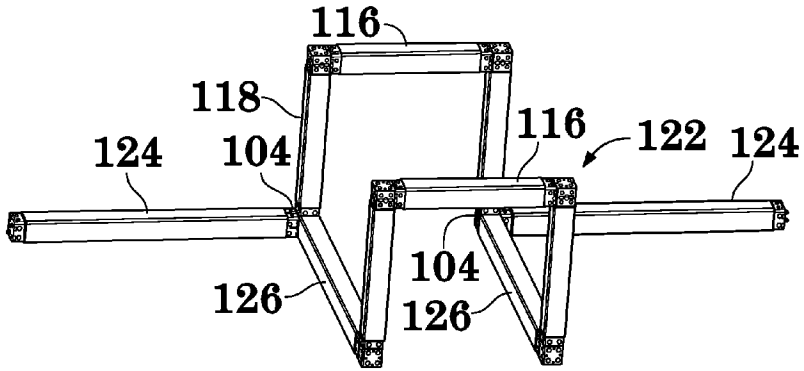

FIG. 17 shows an extended entranceway 122. Extended entranceway 122 provides an unobstructed surface level pathway to allow in-water passage between two portions of a pool through a defined swimming lane formed by two linearly oriented parallel base strips 124, which obviously could be extended as far as needed, for example, from one pool side to another. Each of said base strips 124 is orthogonally joined to another base strip 126 by a corner joint 104. A pair of arches 116 are attached to the ends of base strips 126 with each of the vertical studs 118 mating with the posts and ports of corner joint 104.

Figure 18:
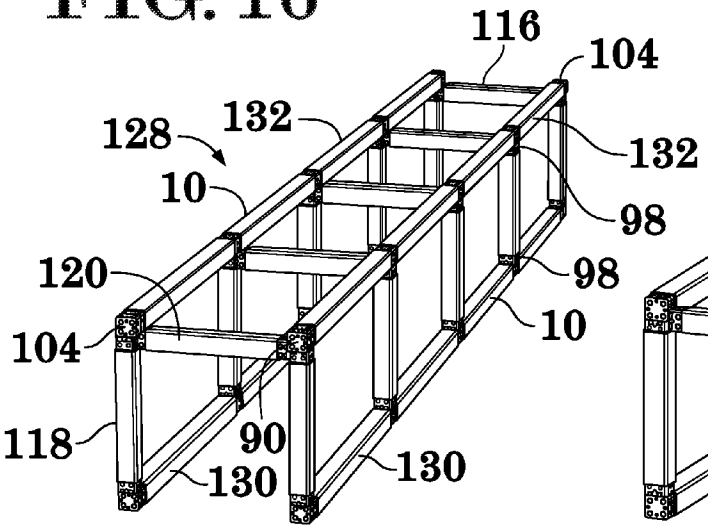

FIG. 18 depicts a tunnel framework 128. A pair of parallel base strips 130, each comprising four bars 10 joined linearly bar-to-bar, have five arches 116 attached to their endcaps by T-joints 98. A reinforcing bar 132 comprises four linear linearly oriented bars 10 joined bar-to-bar with a finishing Hub 90 at each end. Vertical studs 118 are joined to the ends of reinforcing bar 132 by corner joints 104 and are joined to the bar-to-bar joints of reinforcing bar 132 by T-joints 98. The endcaps of headers 120 are dropped by one-half of an endcap below the plane of reinforcing bar 132, so that they are plugged into the ends caps of both studs 118 and bars 10. This type of interlocking joinery provides an additional degree of rigidity to tunnel 128, which is strong enough to maintain separation, to ensure consistent spacing, and to withstand reasonable wave action.

Figure 19:
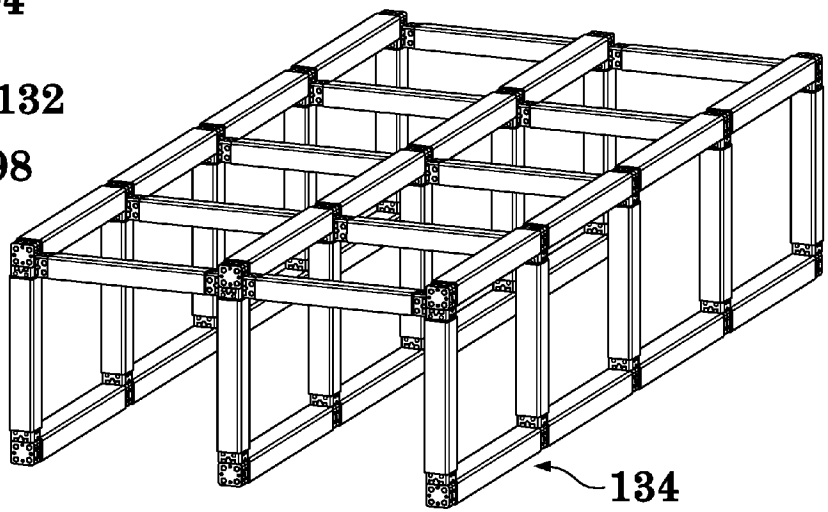

FIG. 19 shows a pair of tunnels joined together to form a rigid superstructure 134. The method of joining the bars and Hubs are the same as used in the tunnel 128 of FIG. 18.

While the number of patterns possible using just rigid bars is enormous, when flexible bars are added in, the possibilities increase exponentially. Rigid bar patterns of necessity must be limited to straight lines, three dimensional ones to be sure but nonetheless, just straight lines. With flexible bars, smoothly curved patterns can be produced, for example, arcs and circles. The prior art includes flexible beams, the popular noodle (also known as a "wacky noodle") is one example. Like others of its kind, it is without endcaps, and without endcaps, all prior flexible beams are incapable of being joined together with bars, Hubs, and other accessories, unless a separate component capable of grasping both beams is added to the mix. In short, while noodles-type beams have definite utility, they are just beams and not bars as the terms are used herein. The invention of a suitable endcap has transformed the ordinary flexible beam into a useful part of the broader invention. FIGS. 20-25 disclose a flexible bar within the scope of the invention.

Figure 20:
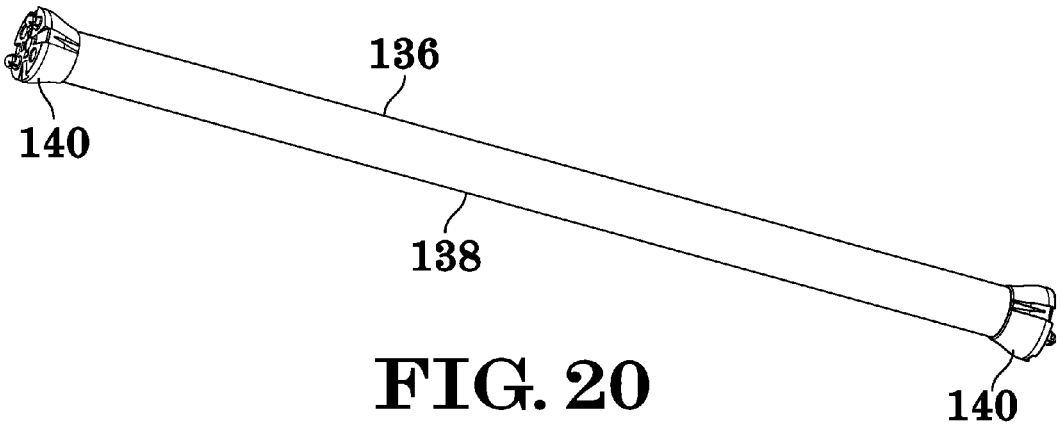
Figure 21:
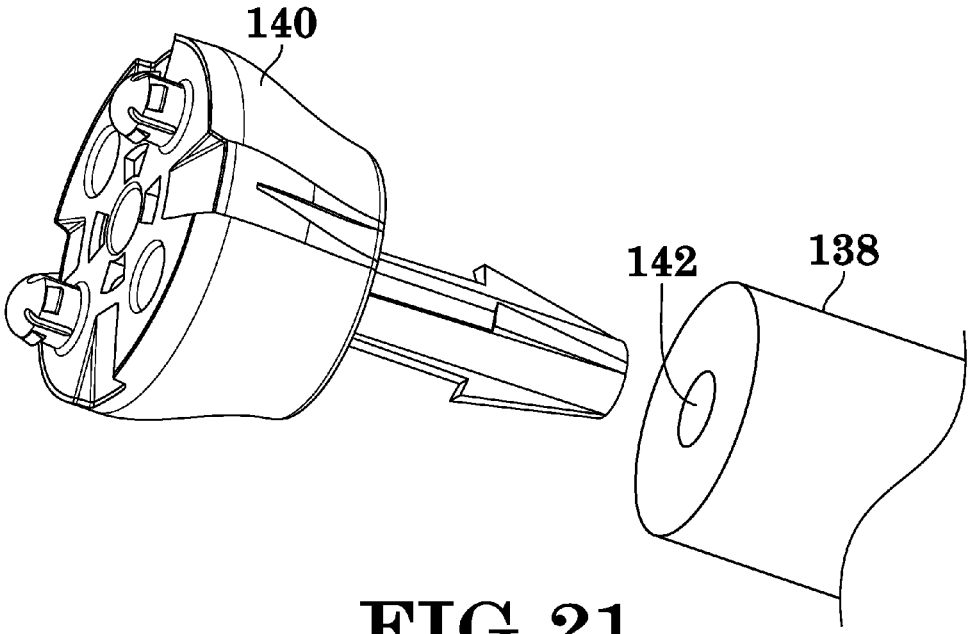

FIGS. 20 and 21 show a flexible bar 136 comprising a cylindrical beam 138 with a circular endcap 140 affixed to each end. Beam 138 is made of a closed-cell polyethylene which is formed in a variety of colors, the same flexible, foam material as used in the rigid bar beam 14 and, like beam 14, has a cylindrical channel 142 axially extending therethrough. Unlike beam 14, however, beam 138 is circular in cross-section. A square beam, such as beam 14, does not easily bend in all directions, effectively being limited to bending only across a flat surface. By adopting a circular cross-section, bar 136 can be easily bent in any direction. A practical byproduct of a forming the flexible beam as a cylinder is that when selecting flexible and rigid bars from a storage facility, they are easily distinguishable, a great time-saver when assembling a complex pattern utilizing both rigid and flexible bars. Also unlike beam 14, flexible beam 138 does not have a spine fixed internally of cylindrical channel 142, inasmuch as such a spine would rigidify it, preventing it from bending into a smooth curve. These two differences, circular beam and no internal spine, require endcaps 140 to be unique, so much so that they constitute an invention on their own.

Circular endcap 140 comprises two components, an adaptor 144 and a collar 146 and is best understood in light of FIGS. 22-23.

Adaptor 144 (FIGS. 22A-22B) comprises a circular butt-end plate 148 molded integrally with an orthogonally extending barbed shaft 150.

Figure 22B:
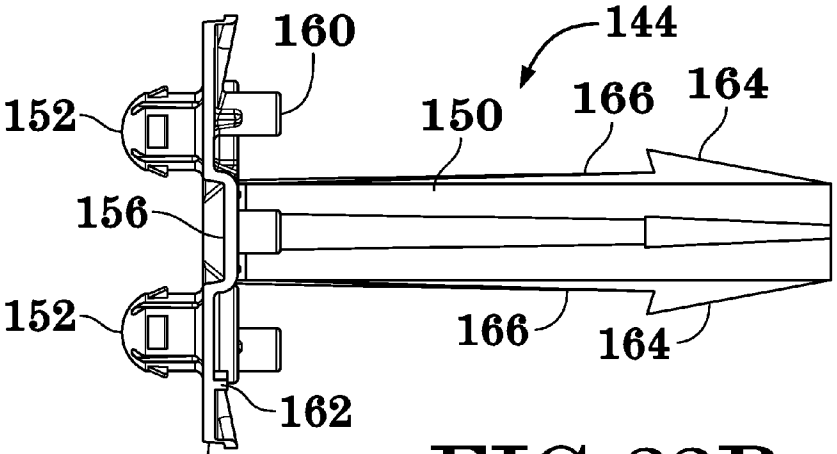
FIGS. 22A-22B disclose end and side views, respectively, of an adaptor for said circular endcap.
Figure 22A:
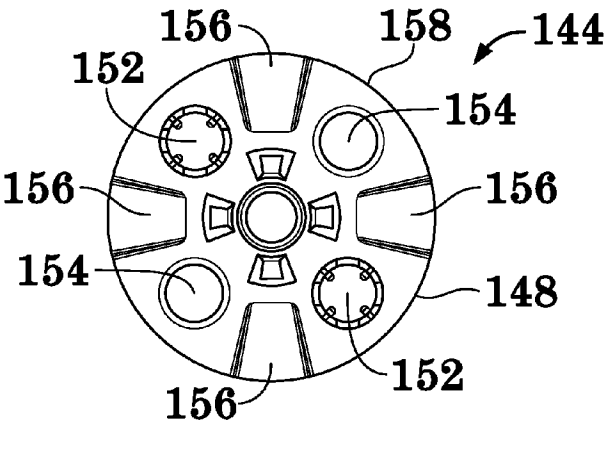

Butt-end plate 148 is substantially circular when viewed head-on (FIG. 22A) and has diagonally oriented posts 152 and ports 154 facing outwardly from butt-end 148 (to the left in FIG. 22B). The size, orientation, and spacing of posts 152 and ports 154 is the same as the previously disclosed posts 50 and ports 52 on butt-end 48 of endcaps 12, i.e., it conforms to the standard. Also facing outwardly from butt-end 148 are four disconnect slots 156, spaced uniformly around the periphery 158 of butt-end plate 148 and configured the same as the previously disclosed disconnect slots 64. A quartet of blind, internally threaded stubs 160 project inwardly (to the right in FIG. 22B) away from the base of circular butt-end 148 in the direction of and parallel to shaft 150. A small alignment post 162, located just interior of periphery 158 (FIGS. 22B and 24B), projects inwardly as well.

Shaft 150 includes four barbs 164 equally spaced around its perimeter. Barbs 164 allow for easy insertion of shaft 150 into channel 142 of beam 138 but, like fishhooks, resist removal therefrom. Reinforcing ridges 166 slope downwardly from barbs 164 to the base of butt-end plate 148.

Figure 23B:
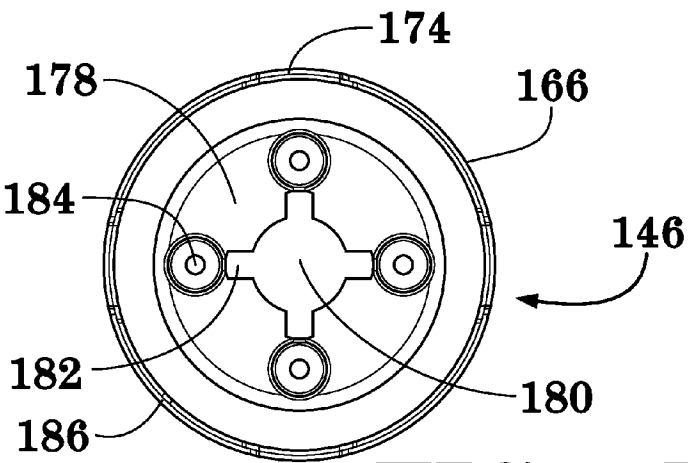
FIGS. 23A-23B show side and end views, respectively, of a collar for said circular endcap.
Figure 23A:
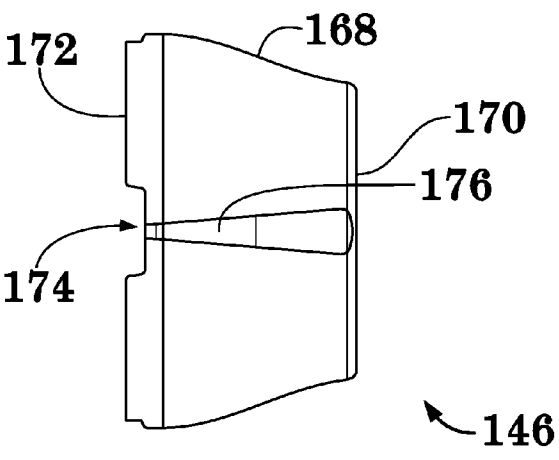

Collar 146 (FIGS. 23A-23B) has an outer shell 168 which has a complex contour, as shown in FIG. 23A, which inter alia tapers from a small end 170 to a large end 172. All cross-sections of collar 146 are circular, however, as is apparent from the end view shown in FIG. 23B. Small end 170 has a diameter slightly larger than the diameter of beam 138; large end 172 has a diameter corresponding to the diameter of circular butt-end plate 148. Four notches 174 are equally spaced around the peripheral edge of large end 170 of collar 146 corresponding in position to the four disconnect slots 156 which are spaced equally around adaptor end plate 148. Two indicator markings 176 are molded into the outer surface of shell 166 of collar 148 one hundred eighty degrees apart, only one being shown in FIG. 23A; each of the indicator markings 176 is centrally aligned with an adjacent notch 174.

Figure 24A:
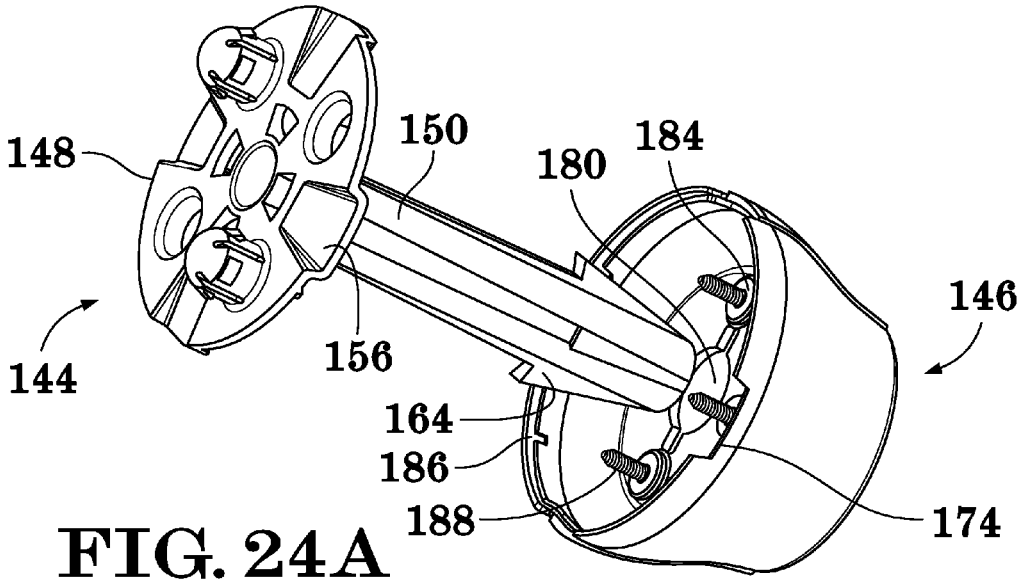
FIGS. 24A-24B show exploded, front and back, perspective views, respectively, of the circular endcap just prior to the assembly of said adaptor and said collar.
Figure 24B:
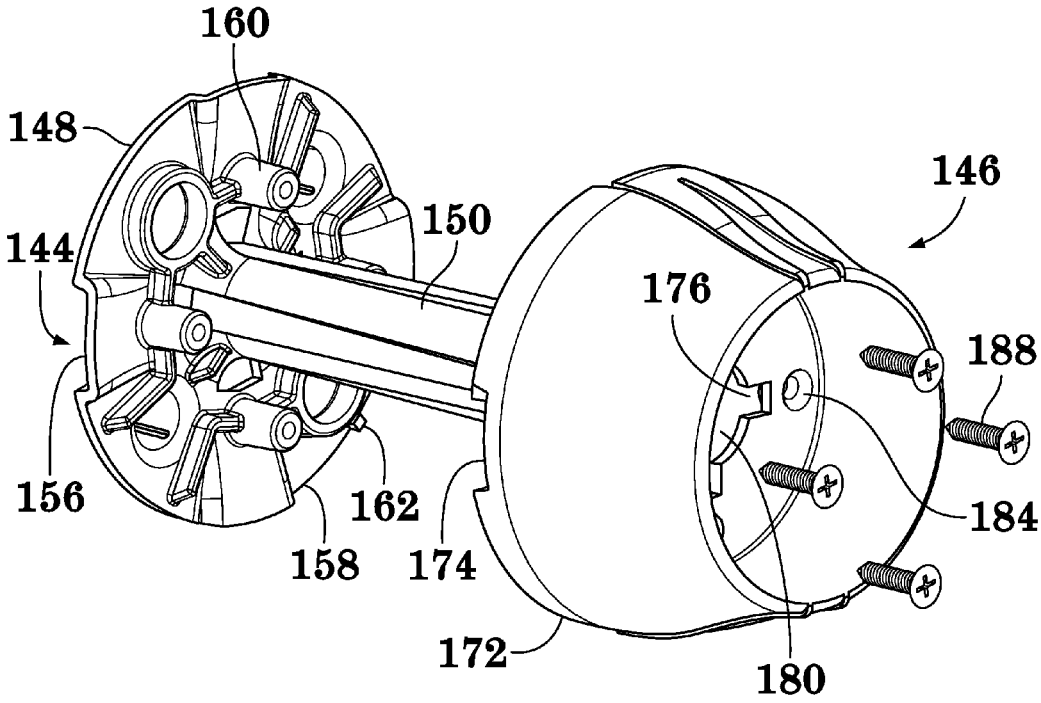

An internal partition 178 is integrally molded within the interior wall of shell 168 intermediate small end 170 and large end 172; compare FIGS. 24A and 24B. A circular aperture 180 penetrates partition 178. Opening to aperture 180 are four equally spaced key slots 182 which, along with four reinforced, screw receiving passageways 184 also pass through partition 178. The diameter of circular aperture 180 is substantially the same as the diameter of shaft 150, and key slots 184 are of a complementary size and shape as barbs 164. The relative positioning of key slots 182 and screw receiving passageways 184 correspond to the spacing of barbs 164 and internally threaded stubs 160, respectively, on adaptor 144. An alignment notch 186 is molded into the interior periphery of large end 172.

Figure 25A:
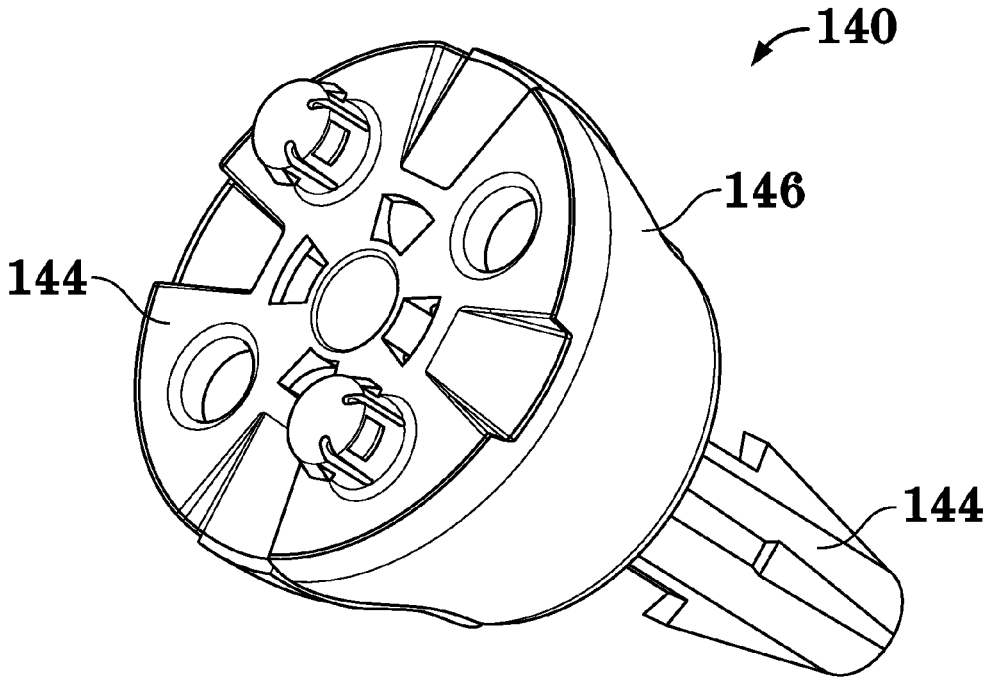
FIGS. 25A-25B show front and back perspective views of the assembled circular endcap.
Figure 25B:
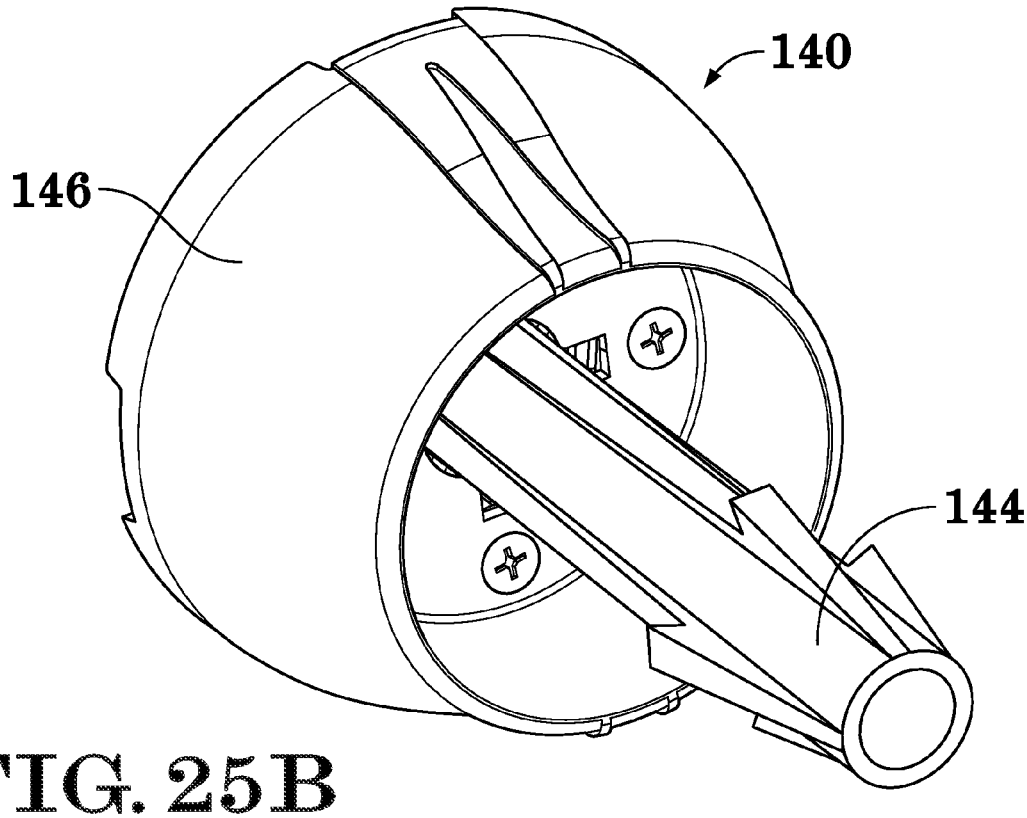

FIGS. 24A and 24B show top and bottom perspective views, respectively, of the assembly of adaptor 144 and collar 146 to form cylindrical endcap 140 (FIGS. 25A and 25B). Adaptor 144 is oriented relative to collar 146 as shown, i.e., shaft 150 is aligned with circular aperture 180, and adaptor 144 is rotated until barbs 164 align with key slots 182, and alignment post 162 is positioned opposite alignment notch 186. Shaft 150 is inserted circular aperture 180 until disconnect slots 156 on butt-end plate 148 mate with notches 174 on the periphery of large end 172 of collar 146, and alignment post 162 nests within alignment notch 186. Screws 188 are slidingly passed through screw receiving passageways 184 and threaded into internally threaded stubs 160, thereby rigidly but removably securing collar 146 to adaptor 144.

FIGS. 25A and 25B show top and bottom perspective views of the assembled adaptor 144 and collar 146, respectively, as circular endcap 140. Like endcap 12, endcap 140 is molded from a plastic material, preferably a durable polypropylene which is relatively soft and flexible, while maintaining is shape. Endcap 140 shares all the safety features enumerated previously with regard to endcap 12.

Figure 26A:
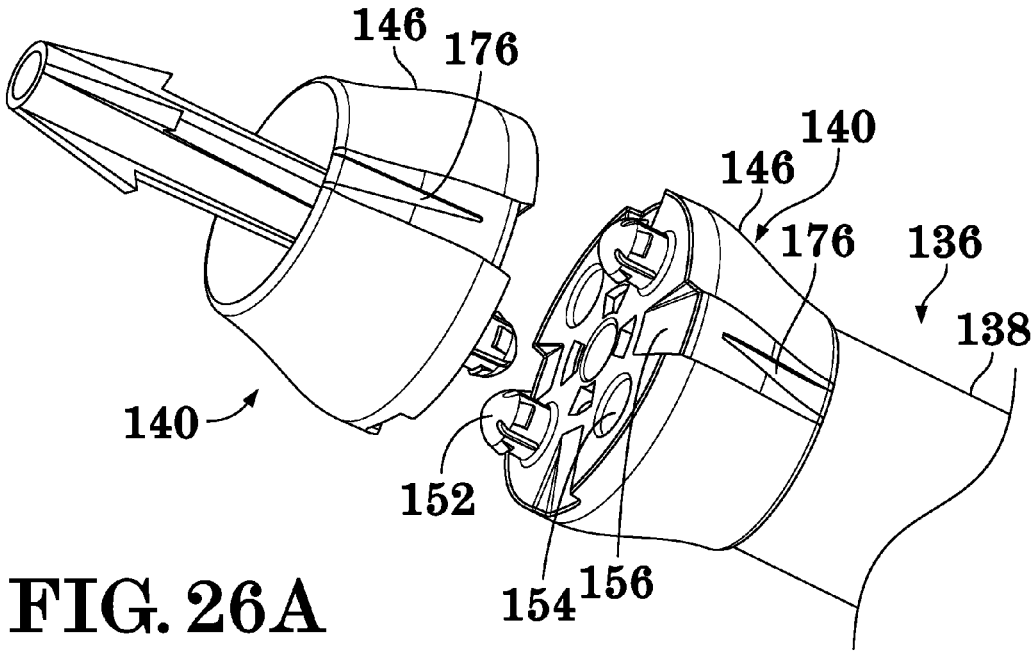
FIGS. 26A-26B are two perspective views of two flexible bar endcaps just prior to and just after being joined together bar-to-bar.
Figure 26B:
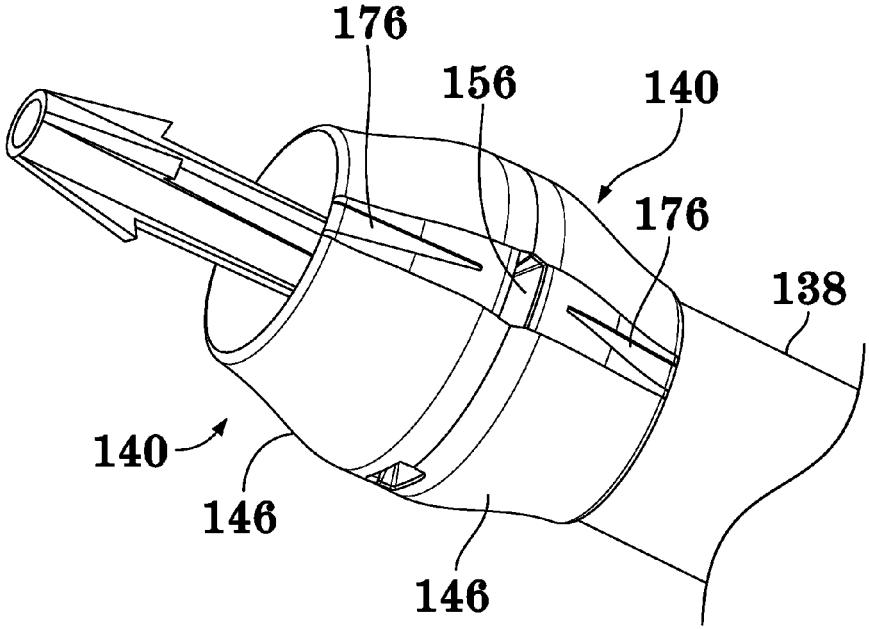

FIGS. 26A and 26B show two circular endcaps 140 just prior to and just after joining, respectively. For illustrative purposes only, one of said endcaps 140 is shown as mounted on a flexible beam 138 (thereby forming a flexible bar 136) and the other is not.

If one attempted to snap-fit two flexible bars 136 together bar-to-bar by holding their beams 138 and pushing their butt-ends together, one would fail, simply because beams 138, being flexible, would bend and/or collapse. Collars 146 are necessary for joining bar 136 to other Olympic Game Kit components. Endcap 140 has been designed with collar 146 in order to provide a hand-hold which is sufficiently solid to permit applying the forces necessary to join two flexible bar endcaps together. The mating of alignment post 162 within alignment notch 186 ensures that indicators 176 are precisely oriented relative to posts 152 such that when an indicator 176 is facing upwardly, one of the diagonal posts 152 will be located at the familiar "10:30" position. Indicators 176 are even more important when connecting flexible bars 136, because bars 136 and their endcaps 140 are circular. Consequently, unlike the four corners of rigid bars 10, they have no natural alignment features. When the endcaps 140 are joined bar-to-bar, indicators 176 will be in alignment and facing in the same direction, e.g., upwardly in the same manner as indicators 62 on rigid bars 10. Aligning the disconnect slots 156 with indicators 176 (FIG. 26B) was a deliberate design feature for another reason; it aids the handler in finding the disconnect slots quickly when disassembling a pattern.

Because bars 136 and their endcaps 140 are circular, it is critical that the endcaps 140 at each end are properly positioned rotationally, so that the indicators 176 at each end of the bar line up, thereby guaranteeing the posts and ports will be properly aligned with the posts and ports of other components, such as the posts and ports of the previously described rigid bars and Hubs. The assembly operation of inserting the round barbed shaft 150 into the cylindrical channel 142 in cylindrical beam 138 requires the use of a jig to ensure the indicators 176 are in the linear alignment shown in FIG. 20. It is contemplated that a retrofit Kit including such a jig be made available so that the inventive circular endcaps 140 may be sold separately for installation on commercially available flexible rods, such as the aforementioned noodles.

Figure 27A:
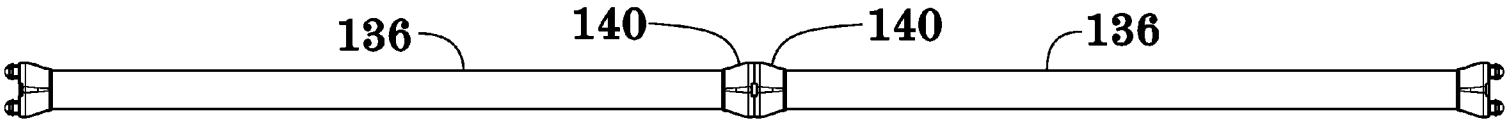
FIGS. 27A-27C are views of three ways two flexible bars are joined with other bars and Hubs.
Figure 27B:
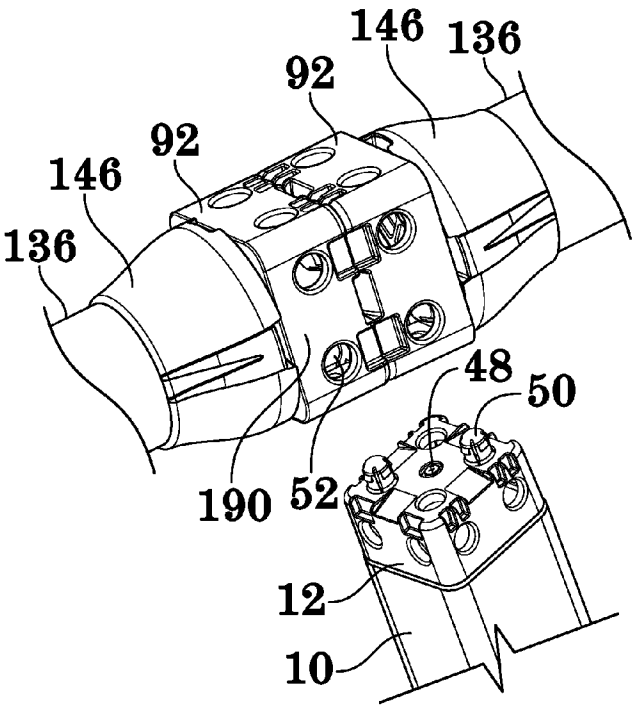
Figure 27C:
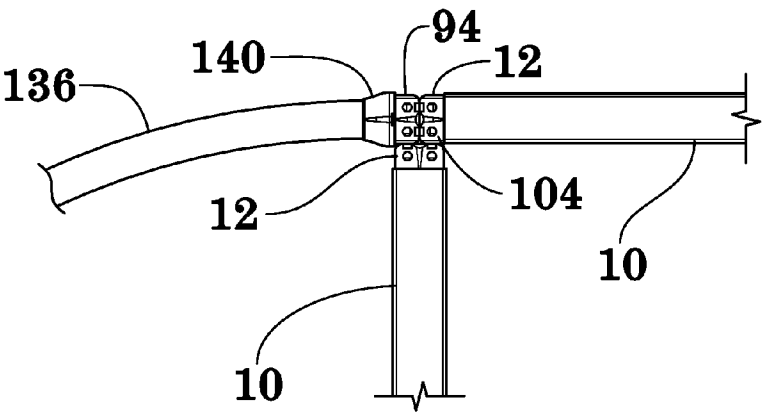

FIGS. 27A-27C show three typical connections between a flexible bar 136 and other Kit components: (1) another flexible bar 136, (2) a pair of flexible bars 136 interconnected linearly through a pair of Hubs 92 plus the orthogonal connection of a rigid bar 10 to the same pair of Hubs, and (3) a flexible bar 136, a Hub 94, and a pair of orthogonally joined rigid bars 10, respectively.

FIG. 27A depicts a simple bar-to-bar connection between two flexible bars 136 wherein confronting endcaps 140 are snap-fit together. Combinations of bar-to-bar joints involving solely flexible bars are used primarily when a large arc is desired; see FIGS. 42 and 46-47. In order to join them together, grasp endcaps 140 firmly, one in each hand, align the indicators (as in FIGS. 26A-26B)), and press the two bars 136 together until they snap-fit. Once again, the connection will be solidly effected by four posts being held by four ports.

The T-joint shown in FIG. 27B comprises a rigid bar 10 joined orthogonally to a pair of bar-to-bar flexible bars 136. This cannot be affected using only rigid and flexible bars, however. There are no ports through the outside surfaces of collars 146, so there are no built-in receptacles for the endcap's posts of bars branching off in a new direction. A pair of half-cube Hubs 92 or 94, or a full-cube Hub (not shown), must be inserted between the linearly oriented flexible bars to provide enough side ports for receipt of the posts 50 on butt-end 48 of rigid bar 10; see FIGS. 28A-28B for greater detail in the insertion of the Hubs between the flexible bars. Snap-fitting the posts 50 of endcap 12 of rigid bar 10 into two of the four ports 52 on the two coplanar side surfaces 190 of Hubs 92 achieves the desired T-joint.

FIG. 27C illustrates the manner of forming another common type of T-joint, namely, the joining of a flexible bar 136 to a corner of the type shown at 104 in FIG. 13A. In corner 104, two perpendicularly oriented rigid bars 10 have the corner filled in by a Hub 90. The T-joint shown in FIG. 27C is formed by replacing Hub 90, which has a smooth cover plate, with a Hub 94, which has both posts 50 and ports 52, and snap-fitting the posts 152 and ports 154 of circular endcap 140 of flexible bar 136 to the cover plate of Hub 94.

Figure 28A:
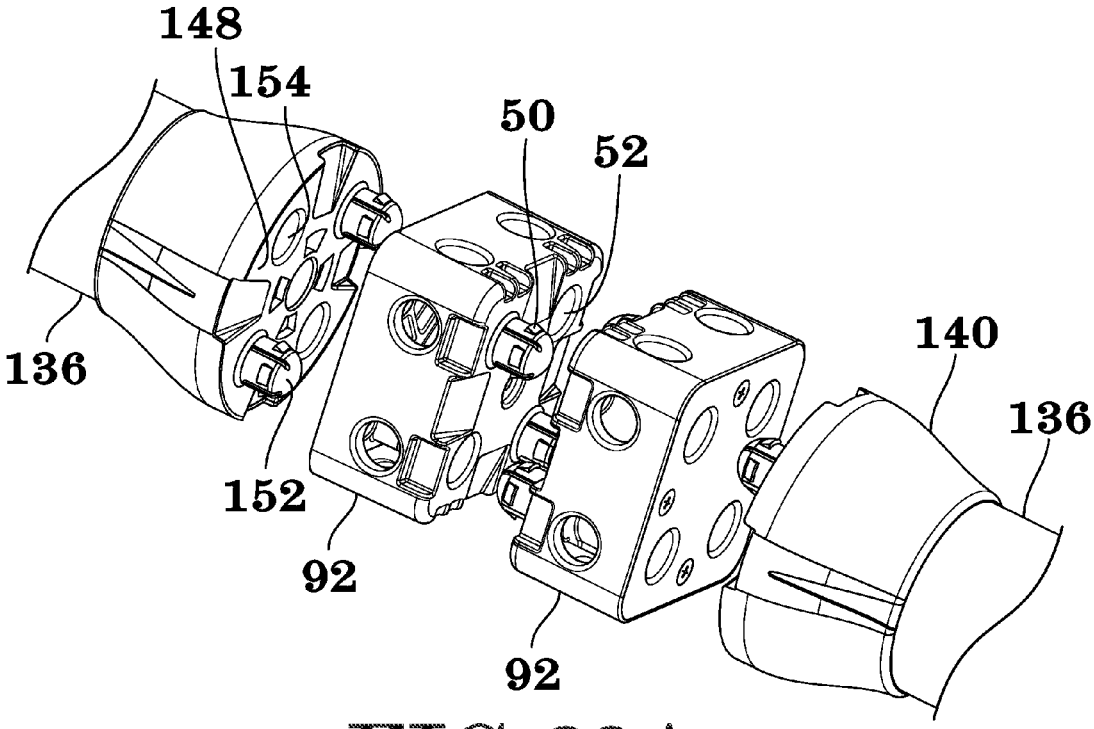
FIGS. 28A-28B show exploded and assembled perspective views of the two flexible bars joined with two Hubs, bar-to-bar, as in FIG. 27B.
Figure 28B:
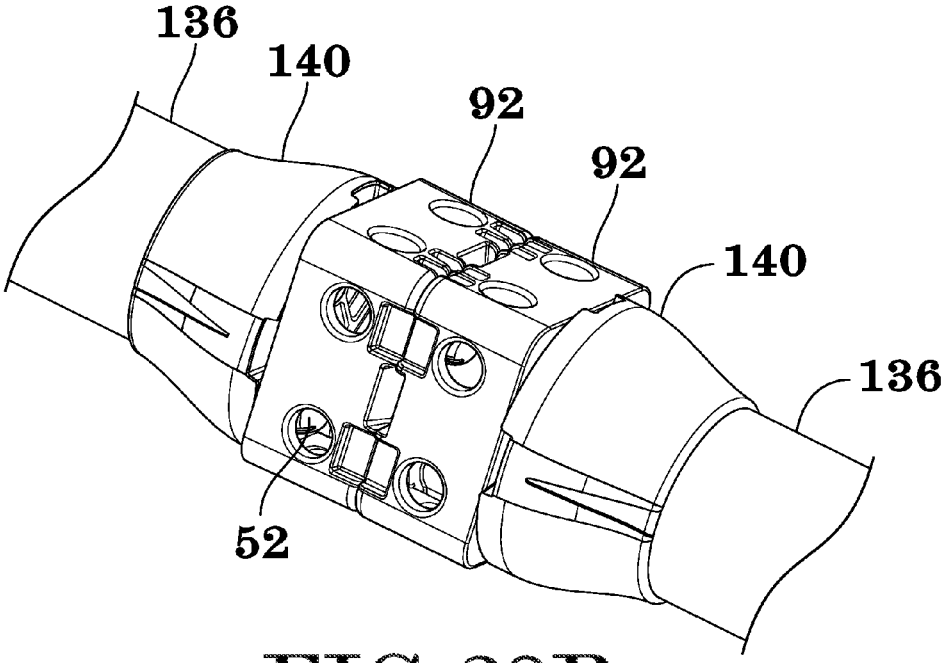

FIGS. 28A-28B show before and after views of the joining of two linearly aligned flexible bars 136 preparatory to adding another bar, rigid or flexible, branching off therefrom as a T-joint. As stated above, a pair of Hubs 92 must be interposed between the flexible bars to receive the side bars. (Hubs 94 could just as easily be used and would produce a stronger bond.) A bar 10 or a bar 136 (not shown) can then be snap-fit onto any of the four co-planar side surfaces of the two Hubs 92. In order to form a plus-joint (not shown), a pair of bars need only be joined to any opposite pairs of side surfaces. Adding bars to all four of the side surfaces (not shown) would produce a three-dimensional axis as in FIG. 15B with the difference being that at least two would be flexible bars 136.

Figure 28C:
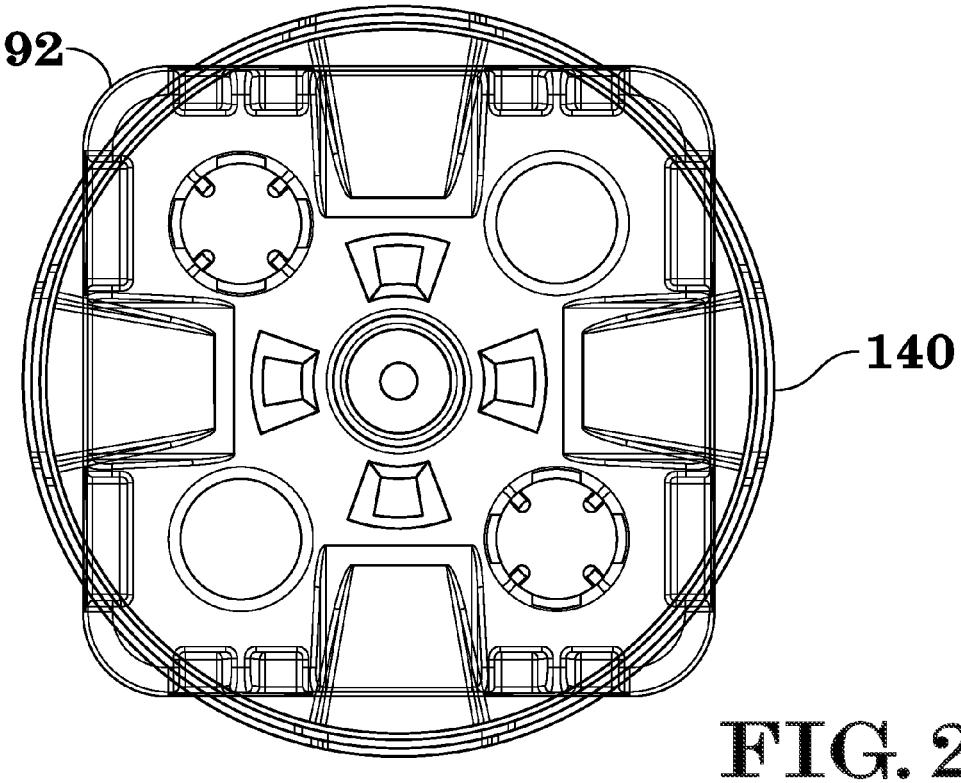
FIGS. 28C-28D show end views of a standard circular endcap and a preferred modified circular endcap.
Figure 28D:
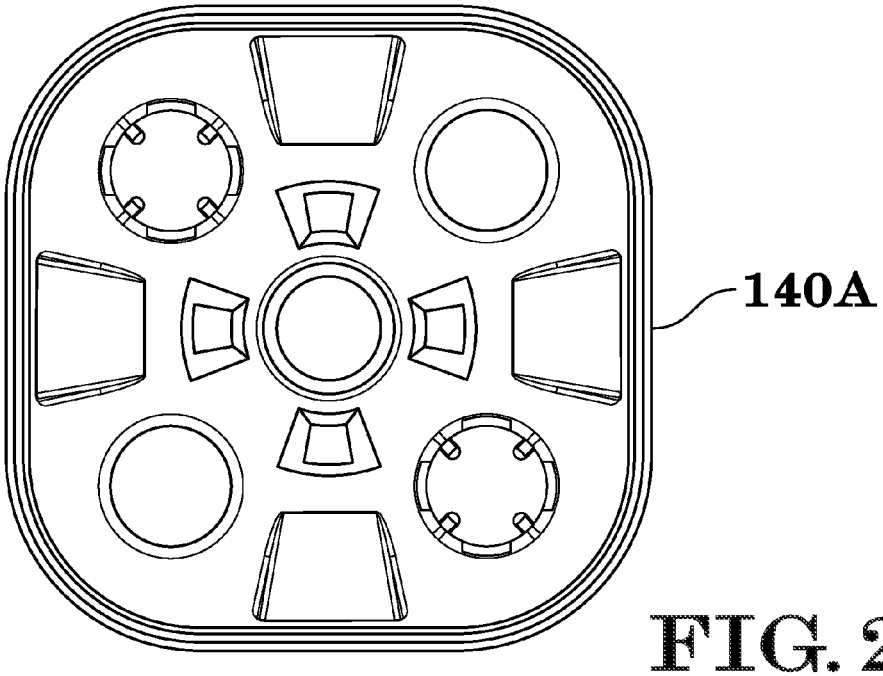

A preferred alternative circular endcap is shown in FIGS. 28C-28D. FIG. 28C shows an overlay of a front view of circular endcap 140 and a front view either of an endcap 12 or of a Hub 92, with the standard post and port relationship of both superimposed. It is readily apparent that portions of the periphery of each extend beyond the periphery of the other. As can be seen most clearly with reference to the left-hand endcap 140 in FIG. 28B, the rounded edges of endcap 140 are protruding beyond the edges of Hub 92. While rigid bars 10 and Hubs 90-96 can easily branch off from the two Hubs 92, because they have the same square dimensions, attempts to add flexible bars 136 to the side surfaces of Hubs 92 will result in the butt-ends 148 of the flexible bars overlapping with each other, making joining them together at least difficult and at worst impossible. By truncating the periphery of circular endcap 140A at the top, bottom and both sides by the amount extending beyond endcap 12, resulting in the endcap butt-end shown in FIG. 28D, circular endcap 140A will fit within the face of any Hub with which it is connected without having visible protrusions. There would be no conflicts with branching bars in that case. Of course, a truncated collar (not shown) fitting the perimeter of endcap 140A would also be provided therewith.

A useful Hub is the octagonal Hub 192 shown in FIGS. 29A-29F. It allows bars to be affixed to the side surfaces 194 and radiate outwardly like spokes on a wheel. Hub 192 permits patterns to be developed with other than right angles between bars, specifically, at angles of multiples of forty-five degrees. The size and connective versatility of Hub 192 can act as a cornerstone to stabilize vertical frames or radiating patterns.

Figure 29A:
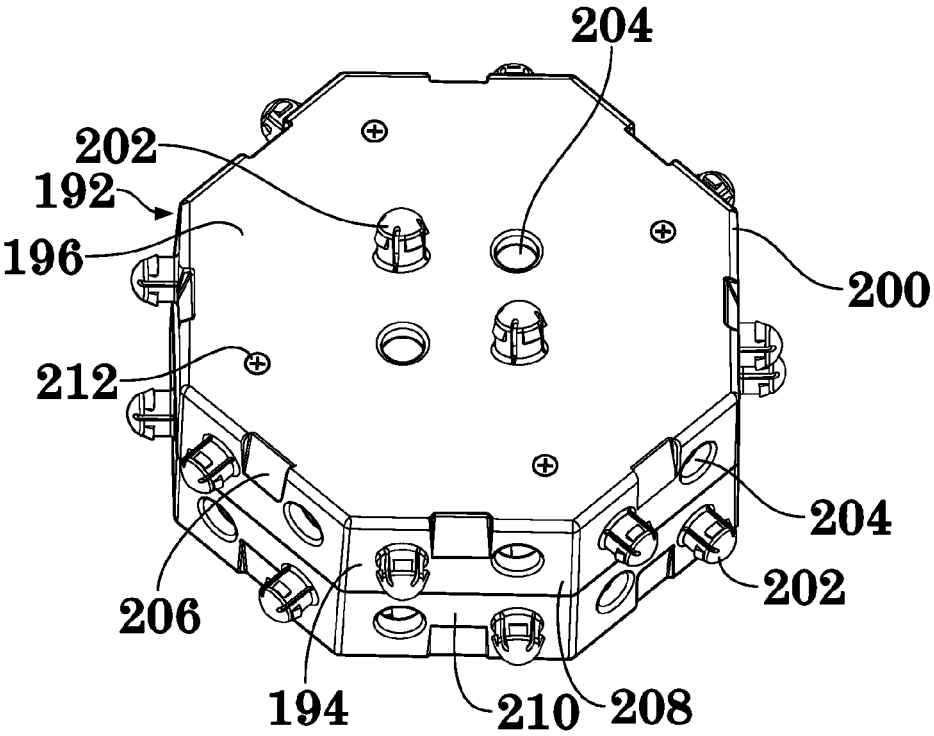
FIGS. 29A-29F show detailed views of an octagon Hub.
Figure 29B:
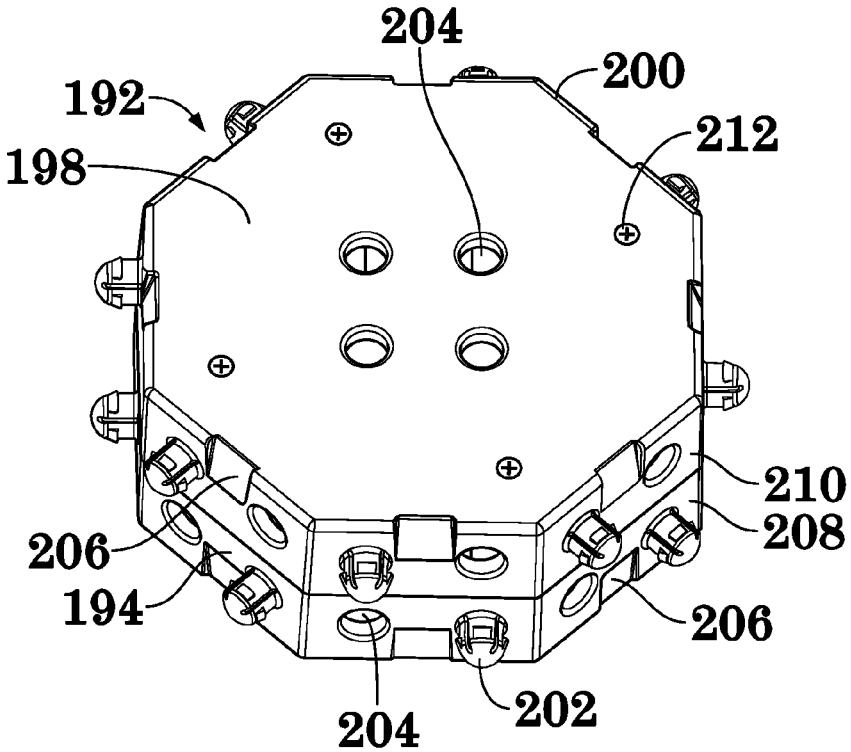

FIG. 29A is a top perspective view of Hub 192, and FIG. 29B is a bottom perspective view thereof. Hub 192 has a top surface 196 and a bottom surface 198, both of which have identical perimeters 200 shaped like an octagon. Top surface 196 has formed thereon a pair of diagonally spaced posts 202 and a pair of diagonally spaced ports 204. The size and locations of posts 202 and ports 204 are standard to all previously described butt-ends on endcaps 12 and 140 and on all of the other Hubs. Any component can be snap-fit to the top 196, therefore, to construct an upwardly projecting three-dimensional structure. Bottom surface 198 has the familiar standard array of ports 204. Other endcaps and Hubs can obviously be attached thereto, but a side benefit is that with no posts protruding from bottom 198, Hub 192 can rest without wobbling, when placed on a solid, flat surface, such as a gymnasium floor.

Eight side walls 194 connect top surface 196 to bottom surface 198. Each side wall 194 has a square face the size of the butt-end 48 of endcap 12 and have the standard diagonally arranged pairs of posts 202 and ports 204, including a post in the "10:30" position. Spaced uniformly around each perimeter 200 and centrally located between adjacent posts and ports are eight disconnect slots 206. All disconnect slots disclosed herein have the same configuration described previously relative to FIG. 5A.

Figure 29C:
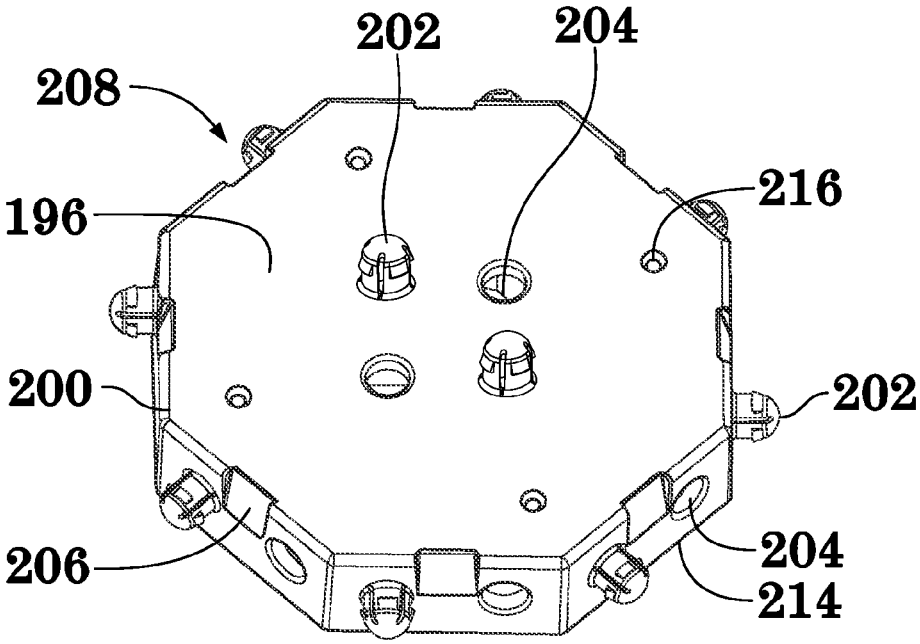
Figure 29D:
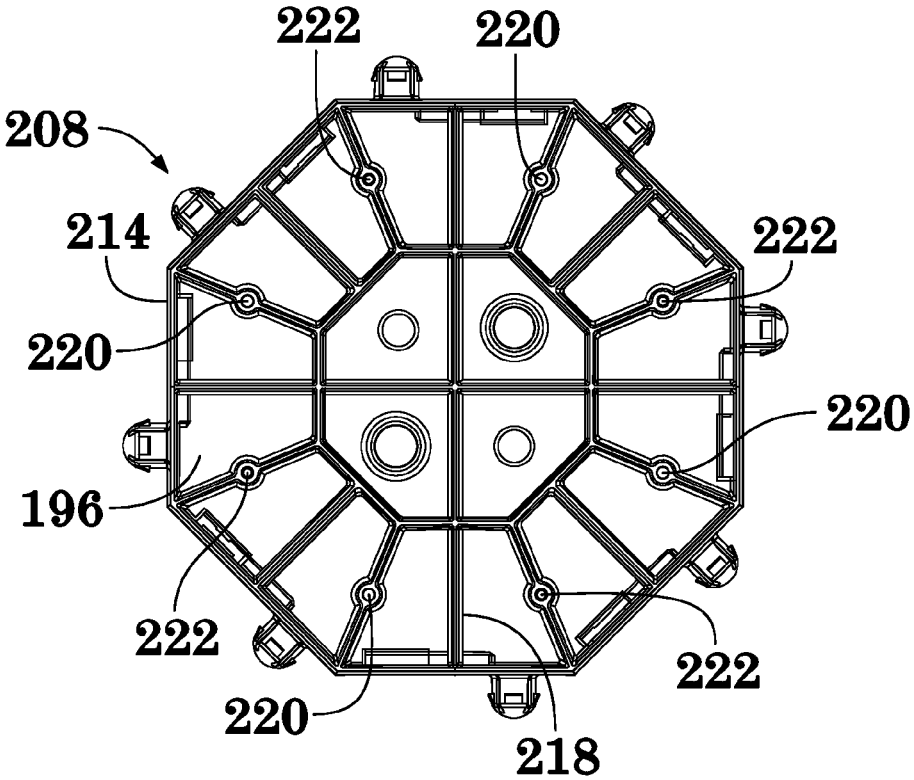
Figure 29E:
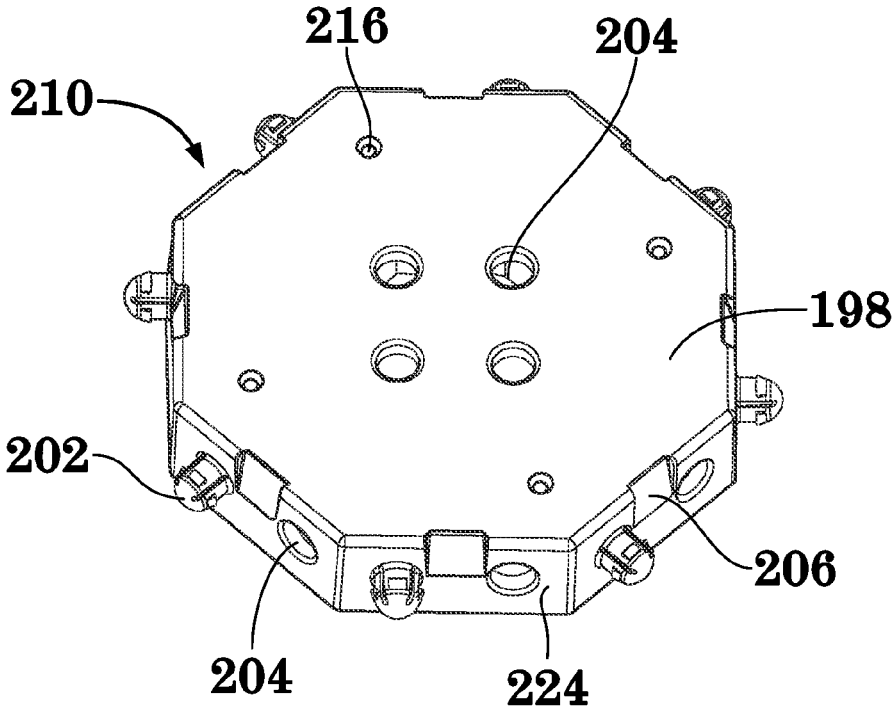
Figure 29F:
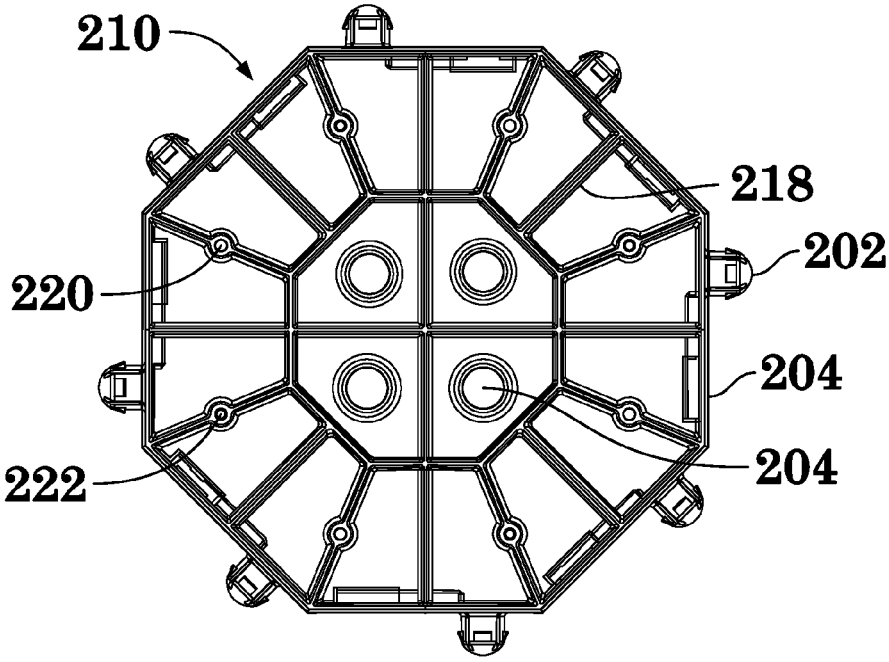

Hub 192 comprises two half-shells 208 and 210 removably attached together by screws 212. FIGS. 29C and 29D show top half-shell 208 in top and bottom perspective views, respectively. FIGS. 29E and 29F show bottom half-shell 210 in top and bottom perspective views, respectively.

Turning to FIG. 29C, top half-shell 208 has the aforementioned top surface 196 with posts 202 and ports 204 protruding upwardly therefrom. Perimeter 200 bounding top surface 196 has disconnect slots 206 spaced every forty-five degrees therearound. Eight side walls 214 depend integrally from perimeter 200 of top surface 196 and are one-half the height of side walls 194 of Hub 192. A post and a port, as viewed from left to right, respectively, are integrally molded on each of side walls 214. Unthreaded, counter-sunk bores 216 pass through top surface 196; bores 216 loosely receive screws 212 therethrough. FIG. 29D shows top half-shell 208 rotated either through its horizontal X-axis or its vertical Y-axis; because of the symmetry of top half-shell 208, either rotation results in the same bottom view. Inside of top half-shell 208, a complex pattern of reinforcing walls 218 is integrally molded with top surface 196 and side walls 214. A plurality of enlarged posts 220 are spaced every ninety degrees around the interior of top half-shell 208. Axially located through posts 220 are the unthreaded, counter-sunk bores 216 through which screws 212 loosely pass. Another plurality of enlarged posts 222 are spaced every ninety degrees around the interior of top half-shell 208, interleaved between posts 220. Posts 222 are blind and are internally threaded.

FIGS. 29E and 29F show the details of bottom half-shell 210. Eight side walls 224 depend integrally from perimeter 200 of bottom surface 198 and are one-half the height of side walls 194 of Hub 192. As with top half-shell 208, a post and a port, as viewed from left to right, respectively, are integrally molded on each of side walls 224. The only real difference between top half-shell 208 and bottom half-shell 210 is the array of four ports 204 on bottom surface 198 instead of the diagonally oriented posts 202 and ports 204. Inside half-shell 210 are the same complex pattern of reinforcing walls 218, enlarged apertured posts 220, and enlarged, blind, threaded posts 222. When half-shells 208 and 210 are mated, passageway posts 220 automatically align with blind, threaded posts 222.

To assemble octagon Hub 192, bottom half-shell 210 is inverted, either along the horizontal X-axis or vertical Y-axis, screws 212 are inserted through unthreaded, counter-sunk bores 216 in top surface 196 and are threadedly connected to posts 222 inside bottom half-shell 210; in like manner screws 212 are inserted through unthreaded, counter-sunk bores 216 in bottom surface 198 and are threadedly connected to posts 222 inside top half-shell 208. Being threadedly connected together allows half-shells 208 and 210 to be selectively separated to clean octagon Hub 192 and/or to replace a broken half, when necessary.

Because of the symmetry between top and bottom half-shells 208 and 210, they can be matched together in any combination, e.g., two top half-shells 208. When octagon Hub 192 is a part of a pattern designed for use exclusively in an aquatic setting, and when the design includes components extending both upwardly from the pool surface and downwardly into the pool's depths, two top half-shells 208 can be secured together, thereby providing posts and ports on both top and bottom surfaces of Hub 192.

Figure 30A:
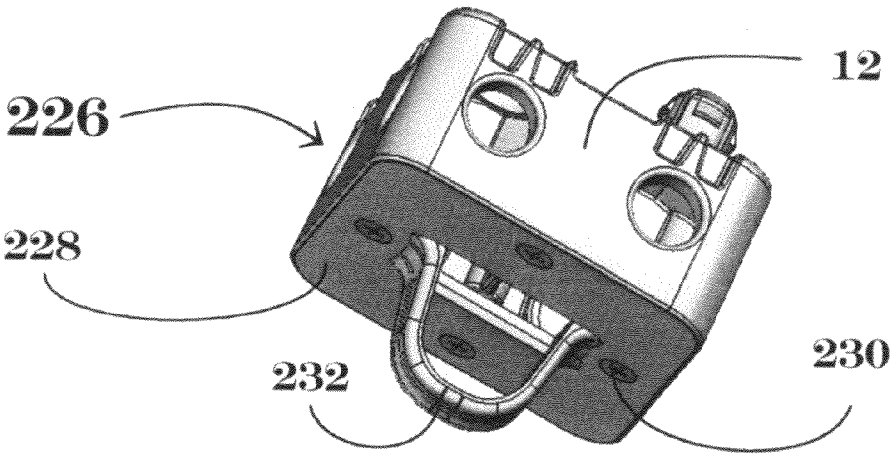
FIGS. 30A-30C show an anchor Hub in perspective, side, and end views, respectively.
Figure 30C:
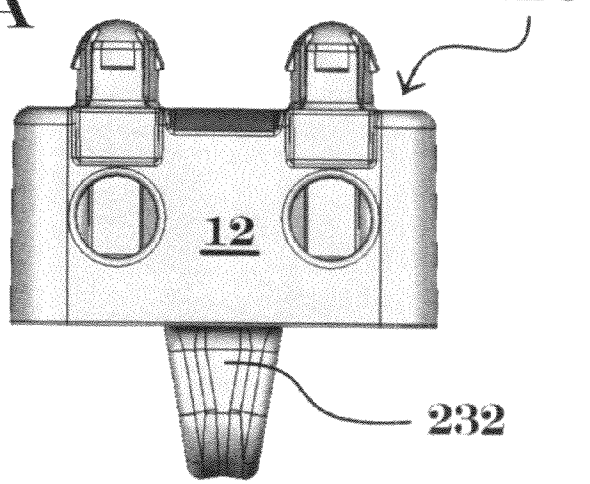
Figure 30B:
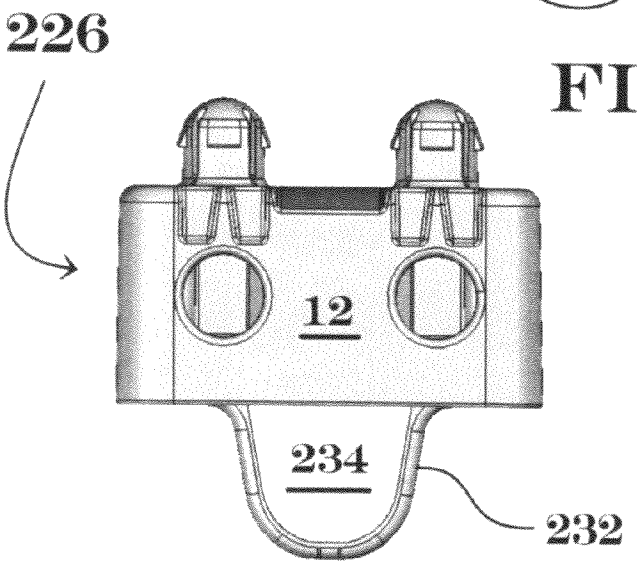

Another useful Hub is the anchor Hub 226 shown in perspective, side, and end views, respectively, in FIGS. 30A-30C. A standard endcap 12 becomes an anchor Hub 226, when an anchor plate 228 (FIGS. 31A-E) is attached to its open bottom by screws 230. A raised bight 232 defines an opening 234 through which an anchor line can be secured. In use, the posts and ports on the butt-end of anchor Hub 226 are joined to Hubs, endcaps, or combinations thereof at selected locations on a pattern to secure the anchor Hub to the pattern. One end of an anchor line, preferably a twist-resistant Nylon rope, is fastened to bight 232 and the other to a relatively immovable object, e.g., a tree beside a pond or river, a ladder or a piece of stable deck furniture adjacent the sides of a pool, or an anchor weight, e.g., a commercially available bag with sand inside of it, which rests either pool-side or at the bottom of the pool. A plurality of anchor Hubs with accompanying ropes are used to stabilize a pattern in bodies of water of various sizes and shapes, e.g., pools, lakes, or rivers, thereby positioning the pattern and preventing it from floating away, as will be seen clearly when patterns are discussed.

Anchor Hub 226 is also useful as a curtain rod support for a raised pattern. For example, assume the activities director chooses to cover the sides of the tunnel 128 shown in FIG. 18, or any other three-dimensional structure simulating a wall, with curtains. After joining a plurality of anchor Hubs 226 to the bar-to-bar joints and/or bar-to-Hub joints spaced along the reinforcing bar 132, a curtain rod with curtains (not shown) is interleaved through the bights 232 of Hubs 226. The opening 234 through bight 232 has been deliberately designed to be large enough that a one inch rod can be loosely passed therethrough. Other applications of anchor Hub 226 will occur to one skilled in the art as the Olympic Game Kit is employed.

Figure 31B:
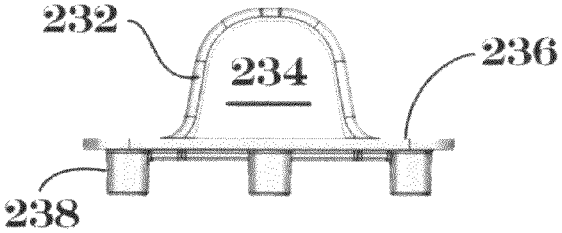
FIGS. 31A-31E are perspective, side, end, bottom, and top views, respectively, of an anchor plate which when attached to the standard rigid bar endcap forms the anchor Hub of FIGS. 30A-30C.
Figure 31C:
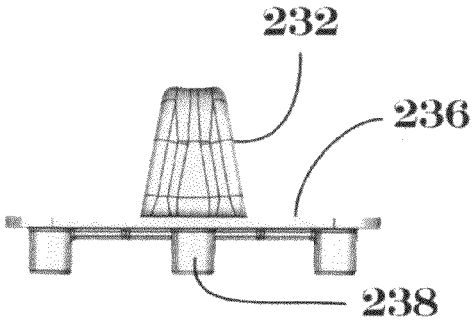
Figure 31A:
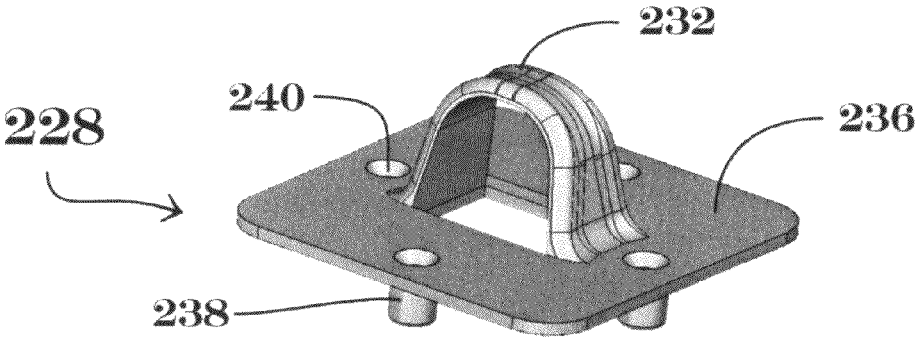
Figure 31D:
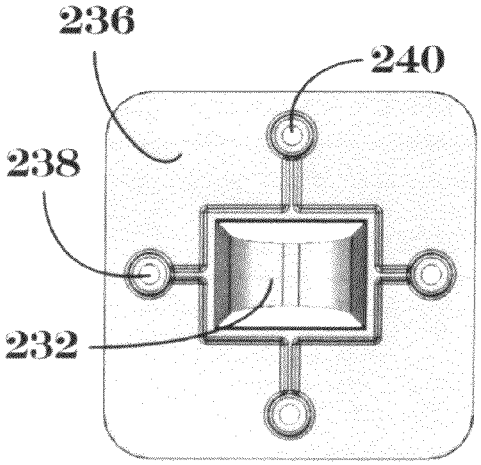
Figure 31E:
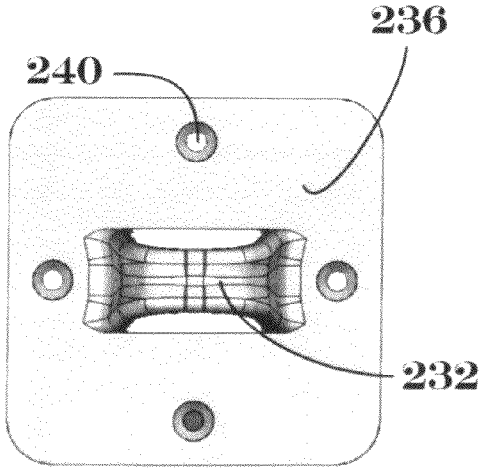
Figure 32A:
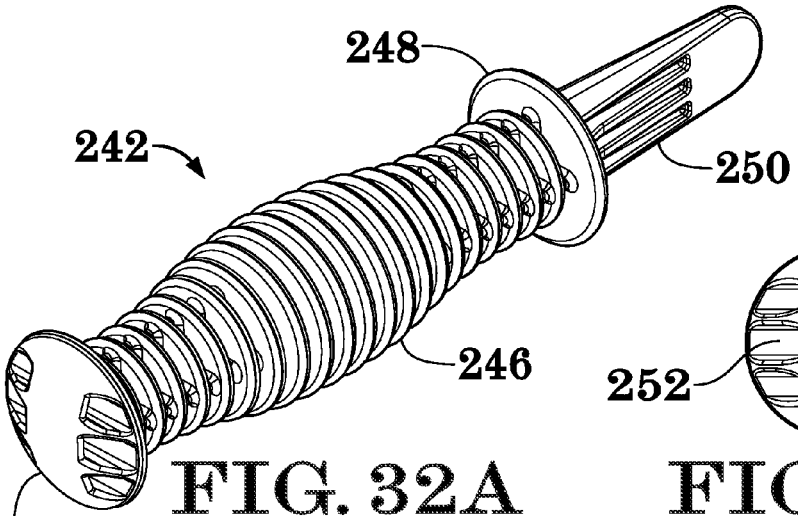
FIGS. 32A-32D are perspective, end, top, and side views, respectively, of the best mode of a disconnect tool.
Figure 32B:
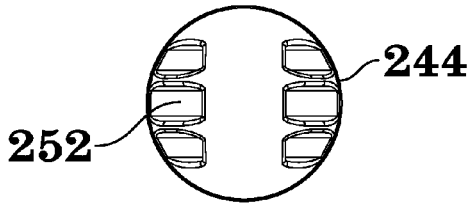
Figure 32C:
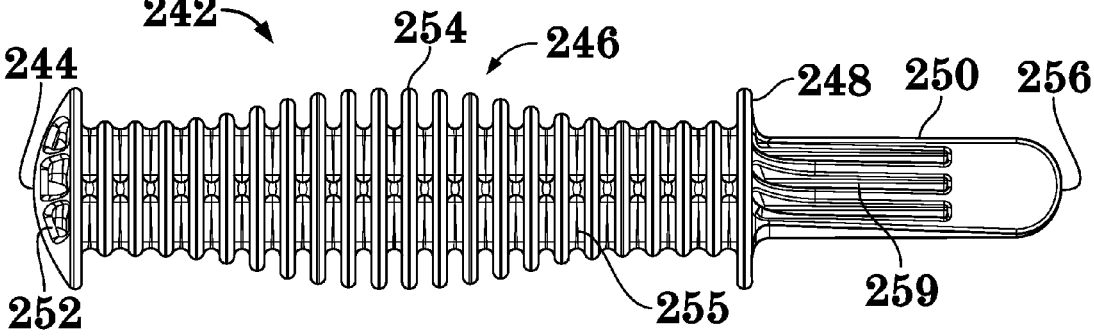
Figure 32D:
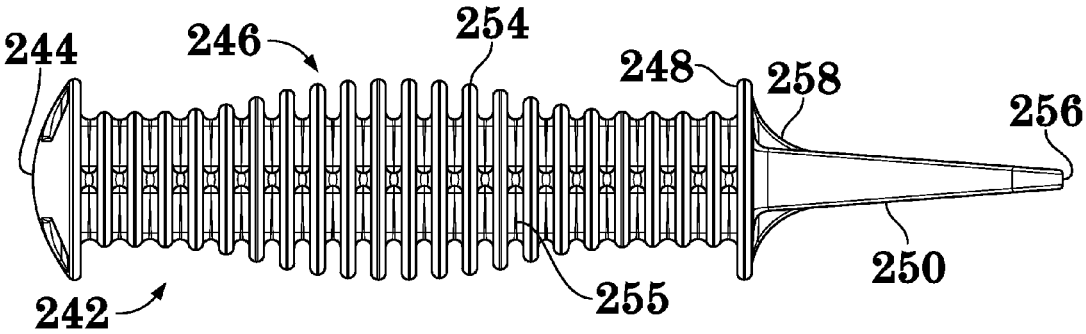

Turning now to FIGS. 31A-31E, anchor plate 228 will be disclosed in detail. Anchor plate 228 is an integrally molded component comprising a thin, flat sheet 236, bight 232, and reinforcing studs 238. Four counter-sunk, smooth bores 240 for slidingly receiving screws 230 (FIG. 30A) therethrough penetrate through anchor sheet 236 and axially through reinforcing studs 238. Sheet 236 is square with rounded corners whose dimensions correspond to the peripheral recess 76 of open bottom 74 of the standard endcap 12. When attached to endcap 12, anchor plate 228 closes open bottom 74 in the manner of plates 84-88 (FIGS. 8A-8E) to create anchor Hub 226. Studs 238 are integral with and depend from the bottom of sheet 236 (FIGS. 31B and 31C). Studs 238 are ninety degrees apart (FIGS. 31C and 31D) and are positioned to align with the enlarged internally threaded posts 78 of endcap 12. Bight 232 is oriented on sheet 236 parallel to two opposite sides and perpendicular to the other two opposite sides. This orientation ensures that bight openings 234 of a plurality of anchor Hubs 226 will align for receiving therethrough a curtain rod, anchor line, etc., when Hubs 226 are attached along a linearly extending portion of a pattern, such as reinforcing bar 132 of tunnel 128 (FIG. 18).

Figure 33A:
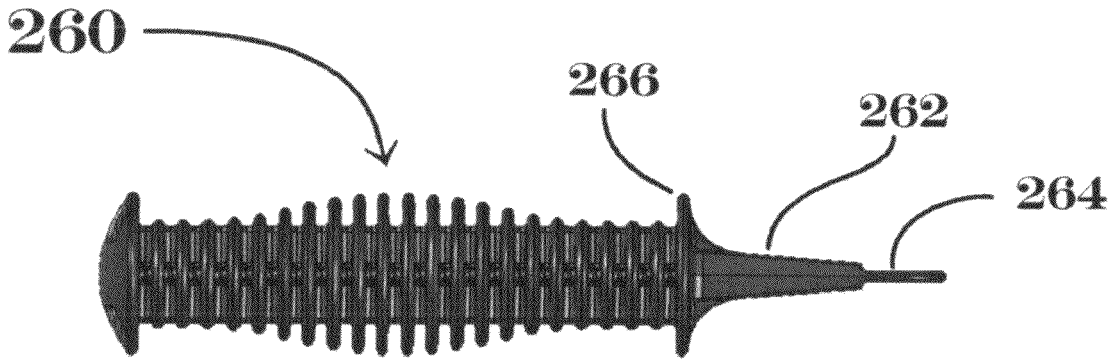
FIGS. 33A-33B show side and top views of two alternative embodiments of a disconnect tool.
Figure 33B:
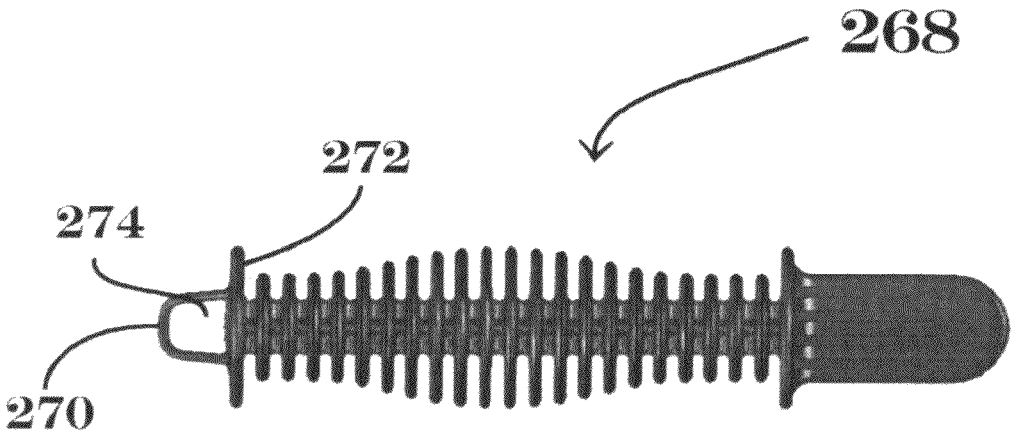
Figure 34A:
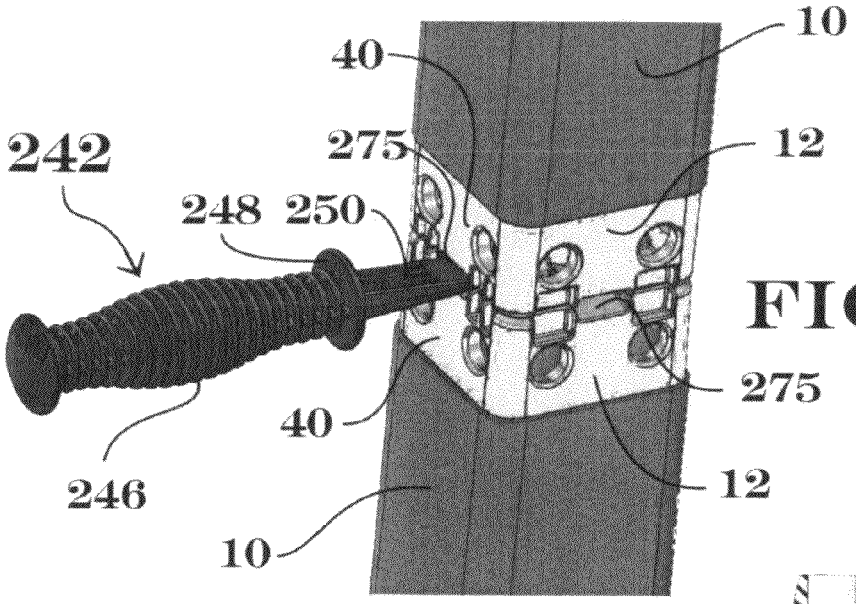
FIGS. 34A-34B illustrate the manner of using the disconnect tools of FIGS. 32-33 to disconnect bar-to-bar joinings of rigid and flexible bar endcaps, respectively.
Figure 34B:
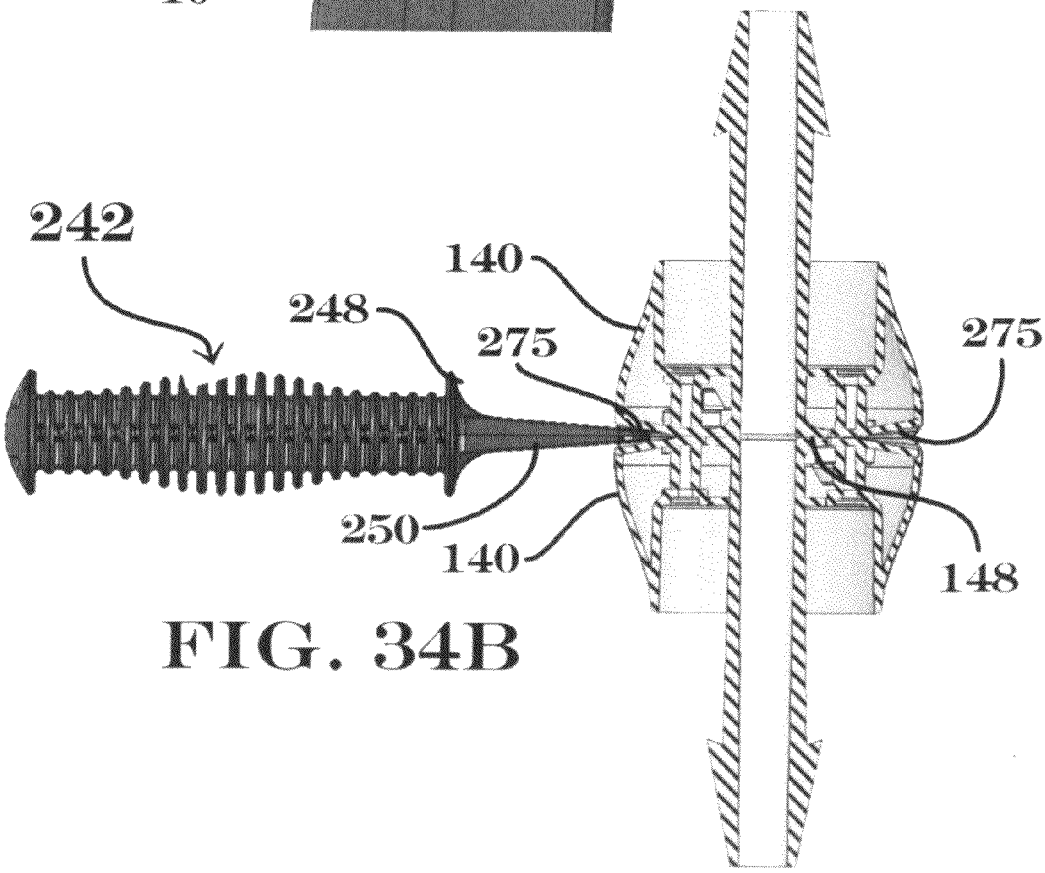

FIGS. 32A-32D show perspective, end, top, and side views of the preferred embodiment of a disconnect tool. FIGS. 33A and 33B show two other preferred embodiments of the disconnect tool. FIGS. 34A-34B show how tools are used to disconnect two endcaps 12 and two endcaps 140, respectively.

Referring to FIGS. 32A-32D, disconnect tool 242 comprises an anvil 244, a handle 246, a guard 248, and a blade 250. Anvil 244 is smoothly rounded, forming a cap which can be comfortably struck with the palm of the hand, if need be. A pair of small passages 252 are formed transverse through anvil 244, in order to receive therethrough a small cord (not shown), so that tool 242 can be removably tethered to the wrist. Alternatively, tool 242 can be tethered to a small buoy (not shown) which will float under the weight of tool 242. Without a tether, tool 242 would sink to the bottom of the pool, if dropped, making retrieval thereof at least time-consuming and perhaps difficult. Handle 246 comprises a plurality of fins 254 extending outwardly from a plus-shaped spine 255 (compare spine 255 in FIGS. 32C and 32D). The outer envelope of fins 254 is ergonomically designed to be comfortable to the hand when gripping the tool. The combination of fins 254 and spine 255 strengthens tool 242 while at the same time reducing the weight thereof when compared to a solid handle of the same outer contours. As more clearly seen in FIG. 32D, the thickness of blade 250 tapers monotonically thicker, slowly increasing from a thin tip 256 and then rapidly increasing at 258 as it nears guard 248. Blade 250 is longitudinally ribbed 259 over roughly two-thirds of the blade length, beginning about one-third from tip 256. Ribs 259 give blade 250 sufficient shear resistance when disconnecting two joined endcaps. The ribbed portion is noticeably thicker than the tip portion.

Tool 260 shown in FIG. 33A differs from tool 242 only in the shape of the blade 262. The thin tip of blade 262 extends inwardly as a flat, knife-like blade 264, before it expands monotonically toward guard 266, noticeably increasing in thickness relative to the tip as in tool 242.

Tool 268 (FIG. 33B) differs from tool 242 mainly in the loop 270 integral with anvil 272; it defines a larger opening 274 than passage 252 in tool 242. Tool 242 is the preferred embodiment, but tools 260 and 268 also perform very well.

FIG. 34A shows the disconnect tool 242 acting on a pair of rigid bars 10 joined in bar-to-bar connectivity. When two endcaps 12 are joined together bar-to-bar, the disconnect slots 64 of each endcap faces its counterpart disconnect slot in the other endcap, forming a wedge-shaped "funnel" 275 sloping inwardly. A smaller funnel is formed, when the funnel comprises only one disconnect slot 64, as occurs when an endcap 12 is plugged into the base of a Hub (FIG. 11C), the sides of two endcaps (FIG. 12A), the sides of an endcap-Hub combination (FIG. 12C), or two Hubs (FIG. 12C). The height of all disconnect slots 64 and 156, as measured transverse their respective bars 10 and 136, respectively, are constant; therefore, the heights of all funnels are also the same. The widths of the funnels, as measured axially of their bars, are either single-wide or double-wide, depending upon whether one disconnect slot or two facing disconnect slots are present. The disconnect tool is designed to be capable of disconnecting either funnel configuration.

The tip 256 of blade 250 of the disconnect tool is complementary shaped to a single disconnect slot. Consequently, it is easily inserted into the full depth of a single-wide disconnect slot where it fits snugly. Full insert of the tip 256 into a double-wide disconnection slot will fit more loosely.

Turning to FIGS. 34A-34B. When blade 250 of tool 242 is inserted within two facing disconnect slots 64 (FIG. 34A), funnel 275 guides blade 250 between the two endcaps 12 until tip 256 reaches the end of funnel 275. When pushed further, tip 256 is thin enough to slide a small distance between the two butt-end surfaces 48, before the ribbed portion begins to pry apart the two endcaps 12 a significant amount. The flatter blade tip 264 of disconnect tool 260 allows deeper penetration between endcaps 12 before the ribbed portion starts to pry them apart. Blade 250 is driven between end caps 12 until guard 248 contacts side walls 40. Just prior to guard 248 reaching side walls 40, the rapidly thickening portion 258 of blade 250 places a deforming strain of the posts and ports, causing them to weaken their hold on each other. Once the blade of the disconnect tool is fully inserted, the handle of the disconnect tool is "jerked" rapidly in a lateral direction (at a right angle to the insert) to "pop" the joint apart. This lateral force will cause elastic deformation of the undercut portions of the posts that are seated on the interior edge of the side walls of the ports, to stretch and release the posts for disconnection. Handle 246 is then tilted side-to-side in the direction of the length of rigid bars 10 until the posts and ports fully pop apart. Blade 250 is ribbed 258 to provide it with enough strength to withstand the shear forces imposed thereon by separating two endcaps 12.

The cross-sectional depiction in FIG. 34B of the insertion of tool 242 into disconnect slots 156 of endcaps 140 shows how the blade 250 penetrating between the confronting butt-ends 148 (FIG. 22A) acts to pry them apart.

Note how the location of guard 248 relative to the length of blade 250 allows the blade to penetrate only about halfway through the width of the endcaps 140. As noted above guard 248 limits the amount of insertion of blade 250 between the endcaps to prevent the blade from slicing through the endcaps and protruding beyond on the other side. When the joint being disconnected is lying on a flat surface, like a floor, guard 248 in combination with the short length of the blade 250 will prevent the blade from being forced all the way through the joint so that it would contact the floor. To accomplish a horizontal disconnect to a vertical raised joint, the handler would commonly brace the back side of the joint with an open hand, and insert the disconnect tool from the opposite side. The guard prevents the blade from passing through into the opposing hand. It is recommended that disconnection operations only be done with the plastic disconnect tool 242. A flat bladed screw driver or a flat bar will work if absolutely necessary, but neither have the built-in safeguards of tool 242.

A critical design goal was that the Olympic Game Kit be easy to assemble, have a strong locking connection, and yet be easy to disconnect. That the joints in the patterns (FIGS. 35-56) must be strong and hold during active play is obvious. But having strong connections is seemingly antithetical to being easy to disconnect. A significant step in achieving a user-friendly pattern making kit was the development of the tool assisted disconnect. As it turned out, the tool assisted disconnection operations to break-down or reconfigure a formation are super-efficient. Disconnection is actually less labor intensive and less time consuming than the connection operations, a major accomplishment that is a big deal for a supervisor in charge of entertaining twenty restless children.

Olympic Game Kit Patterns

The genesis for the invention was to fulfill the need for activity directors of resorts, cruise lines, YMCAs, summer camps, and like environs to provide adult-sized "playing fields" in aquatic settings, namely, swimming pools, lakes, ponds, etc. The following descriptions are true to the origins of the invention and are in terms of swimming pool activities.

While developed primarily for swimming pool use, a setting which imposes stringent requirements for the physical embodiments of the patterns, and thereby the pattern making Kit itself, it is readily apparent many of the patterns disclosed herein find utility on solid ground, e.g., gymnasium floors, ball fields, and the like. Use of the disclosed Olympic Game Kit and the patterns resulting therefrom in non-aquatic settings are within the scope of the claimed invention.

Figure 50:
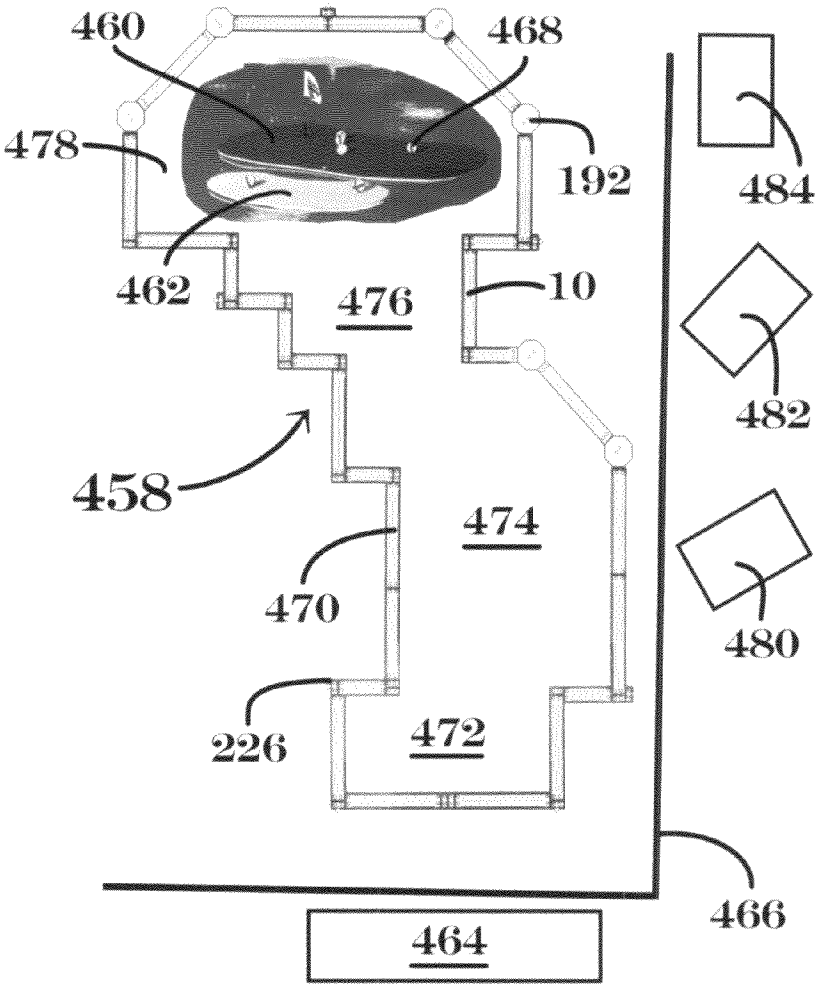
Figure 49:
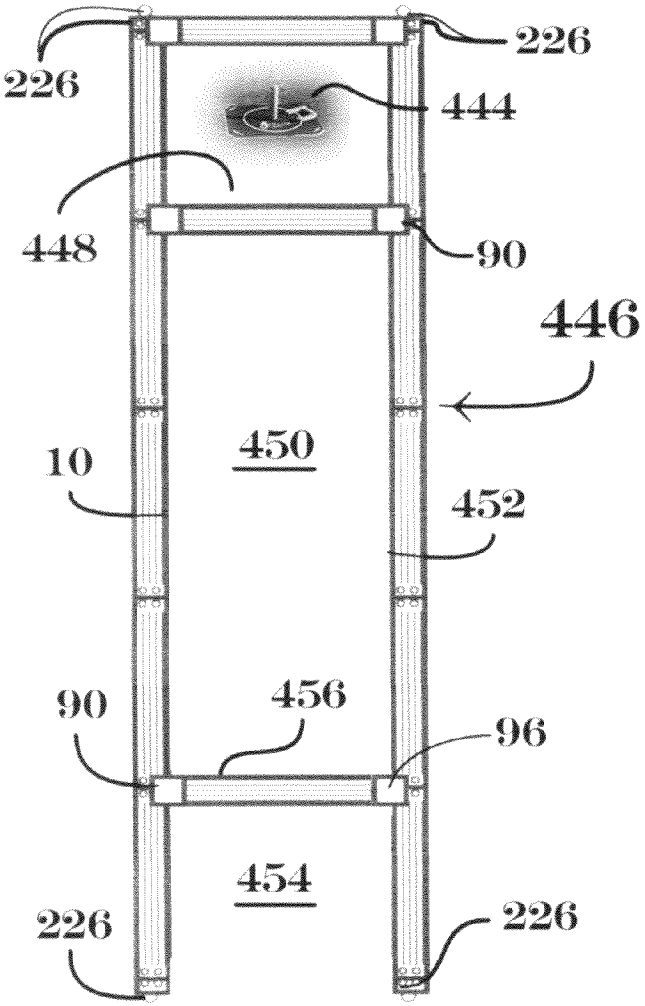

FIGS. 35-56 showcase a few of the many adult/human scale playing field patterns and their corresponding games which the invention is capable of producing, where players physically participate actively in the motion and strategy of play. All playing field patterns are produced by employing the components described above assembled in accordance with the techniques hereinbefore disclosed. Many patterns are used with commercially available accessories, such as a volleyball net (FIG. 43), a pool-side basketball backboard and net (FIGS. 45-48), a floating horseshoe pit (FIG. 49), and an aquatic golf hole (FIG. 50).

Assembled playing fields enable activity directors or party coordinators to organize group activities on a regular basis and under the constraints of a tight activity schedule for scores of impatient guests or students. An activity coordinator, a day care supervisor, a camp counselor or a neighborhood mom and dad with a group of children who require a supervisor's attention, must be able to set up and break-down an activity pattern quickly and efficiently. Ease of identifying rigid versus flexible bars, ease of handling and arranging the lightweight bars into the proper position within the formation, ease of aligning the bar's and the Hub's diagonally arranged post and port joinery features, ease of connecting the bars by squeezing them together in a straight-in pre-aligned snap-together operation, ease of dragging an assembled section of a formation into position (without it breaking apart!), ease of connecting multiple sections of a formation that were independently assembled, ease of anchoring a free-floating formation, ease of breakdown of an existing pattern for reconfiguration into another desired pattern or for stacking and storage are all practical matters of considerable importance. The disclosed and claimed Olympic Game Kit satisfies all of these desiderata.

It is of equal importance that the joinery must be capable of functioning in aquatic settings like swimming pool water and in indoor and outdoor environments, like an activity room, a beach, a backyard or a soccer field. The connections must be strong enough to hold assembled shapes in orderly formations that withstand wave action and reasonable impact from the activity and motion of boisterous child and adult players. Assembly of rows or sections of a formation for an in-water activity may be more quickly and easily assembled deck side or on dry land, so the joints must also be strong enough to hold a reasonable number of bar-to-bar connections when dragged into the water and/or floated into position. Assembly of raised gates or elevated framing to produce unobstructed swim lanes or framed enclosures also requires that the snap-together joinery be strong enough to support a cantilevered bar, such as those shown in FIG. 16 to FIG. 19, and support the moment arm stress of the cantilevered "header" bar during assembly.

The substantial benefit of providing an activity director with a floating playing field intended to generate interest and encourage active participation for a group of players of different ages and ability levels is substantially dependent upon the pattern-making Kit's capability of being efficiently managed for regular and repeated set up and breakdown. The pattern-making Kit's capability to be regularly configured and re-configured to produce and maintain a multitude of playing fields and formations is what enables the benefits of the Olympic Game Kit's modular pattern making components. Illumination of the pattern formations for nighttime activities and decoration is also a part of the Olympic Game Kit's repertoire. Lengths of glow sticks or strands of LED waterproof lights can be permanently or temporarily attached to the foam beams to illuminate a floating water course, target or decorative pattern. Dry land applications include illuminating a pathway or acting as a marker on a beach.

A few playing field patterns are to be used with commercially available swimming pool accessories, such as a floating horseshoe pit (FIG. 49), an aquatic golf hole (FIG. 50), a pool-side basketball backboard and net (FIGS. 45-48), remotely controlled toy boats (FIG. 52), a swimming pool volleyball net (FIG. 43), and a poolside football-themed target (FIG. 44), to produce unique water games and activities.

The addition of a colorful floating formation anchored under and around one of these sport's related pool products immediately improves the level of interest and enthusiasm for an organized group that is being prepared for an in-water activity utilizing the sport's related product. The same group in the same situation with the same sport's related pool product does not have comparable activity options without the use of the colorful floating formations and corresponding games provided by the disclosed and claimed Olympic Game Kit.

The accessory equipment is primarily utilized for competitive athletic contests, such as in-water basketball or volleyball. The entertainment benefit produced by utilizing these popular sport's related pool products is typically determined by the athletic ability of the competing players. The capacity of the equipment to be utilized for organized games and activities involving groups of guests, students or family members that are of varying athletic ability, size, age and gender is limited, and the entertainment value of a sporting competition such as a swimming pool basketball game is substantially diminished when the competing players are of substantially differing levels of athletic ability. If a summer camp counselor has twenty kids of wide ranging abilities at the pool, the pattern-making Kit enables the supervisor to organize a commensurately wide range of entertaining games or activities that cannot be practically accomplished without use of the Olympic Game Kit. The Olympic Game Kit's capability to enable an activities director to organize more inclusive games that are visually stimulating and encourage active participation in the activity for groups of guests of different ages and ability levels is virtually unlimited.

Perimeter Game Fields

Figure 35:
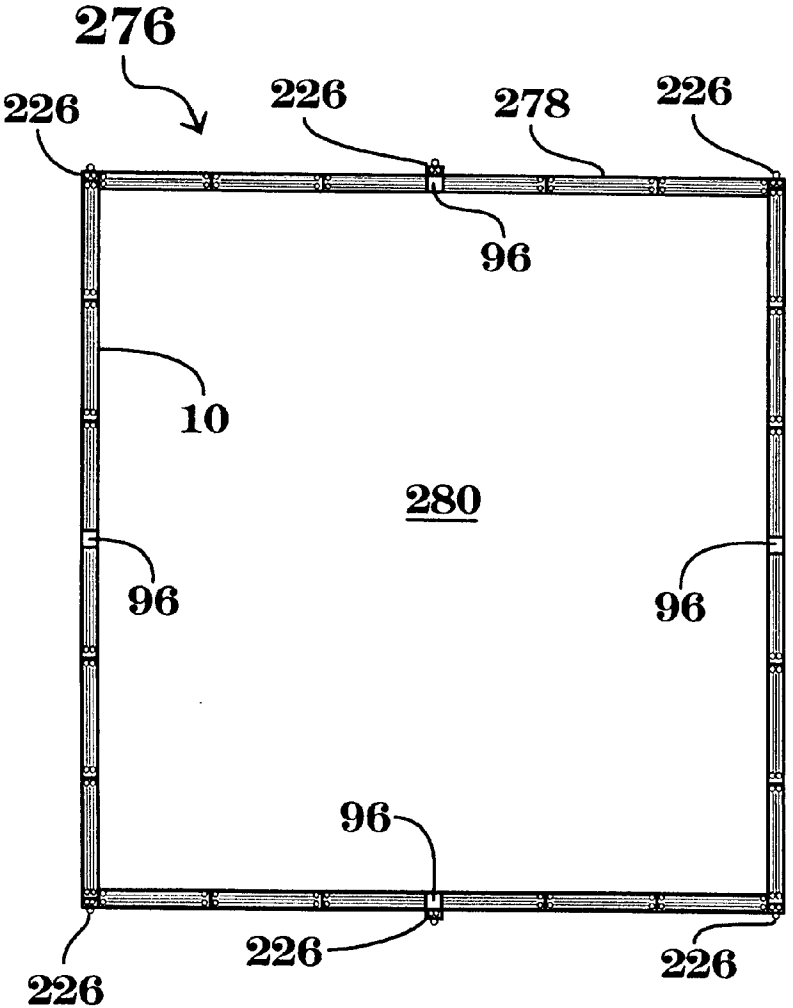

FIG. 35 diagrammatically illustrates a basic perimeter pattern 276. It is the simplest pattern for defining a playing field. A bare perimeter which simply sets aside an area in a large pool has many uses, e.g., for segregating small children safely apart from more boisterous guests, or for defining an area for water aerobics or other types of water-related activities. Perimeter pattern 276 is assembled by connecting rigid foam bars 10 together linearly bar-to-bar to form a perimeter 278 enclosing a rectangular area 280. The four corners could be rounded off with either of the corner Hubs 90 or 92 disclosed above, but anchor Hubs 226 may be utilized more efficiently as they function as corner Hubs and as aids in stabilizing the pattern in position in the water. (Throughout the diagrammatic illustrations of Olympic Game Kit patterns, anchor Hub 226 is depicted in a side view as in FIG. 30B, characterized by the bight 232 extending away from the formation.) If it is found more convenient to attach anchor Hubs 226 to sides of perimeter 276, the butt end of anchor Hub 226 is plugged into the side ports of the endcaps 12 of rigid bars 10. Joint support clips 96 (see FIG. 12A) can be added, if thought desirable, to reinforce the bar-to-bar, in-line joints and/or the corner joints.

Dodge Ball Type Games

Figure 36:
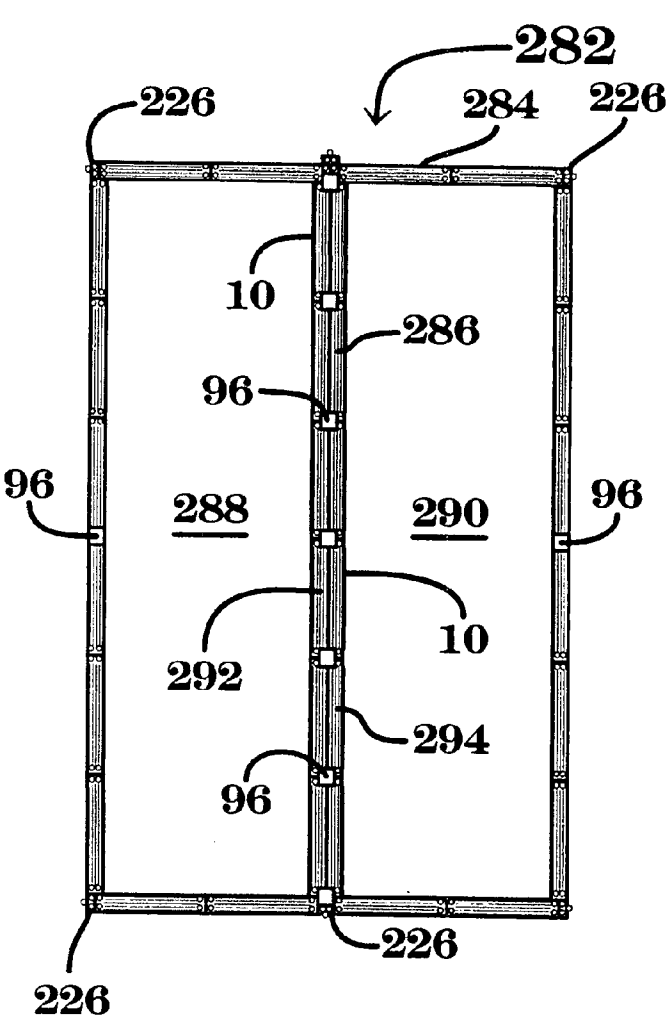
FIGS. 35-54 are examples of patterns capable of being created by the disclosed Olympic Game Kit by joining the construction Kit components of FIGS. 1-31 in such manner as to define playing fields for in-water games.

FIG. 36 shows another representative sample of an Olympic Game Kit pattern, namely, a completed dodge ball field 282 set up for in-water play by two players, multiple individual players, or multiple player teams. A perimeter 284 is divided by a center modular partition 286 into two separate opposing player's zones 288 and 290 on either side of center partition 286. Center partition 286 is constructed as a pair 292-294 of single modular partition rows of rigid bars 10 connected bar-to-bar and positioned adjacent and parallel to each other, resulting in a double wide modular divider 286 which is strong enough to withstand rough play. In addition, it aids in maintaining symmetrically sized sections. Any number of support clips 96 may be attached to adjacent bar-to-bar joints of center partition 286 to strengthen the zone-separating partition rows 292-294 and to selected joints of perimeter 284. Once again, pattern 282 is anchored at 226 (eight shown) at the corners and at intermediate points around the periphery 284. The manner of constructing pattern 282 is obvious to one skilled in the art given the descriptions of the component parts, above.

Patterns come to life, when activities or games, including their rules of play, are associated with them. Many patterns can support different games with different rules, adding versatility and utility to the inventive patterns. For example, various rules for dodge ball games can be adopted as deemed appropriate by the activity director.

Dodge ball Classic: Players are divided into two equally sized teams, positioned respectively within perimeter 284 on each side of the center dividing partition 286. One or more balls are equally distributed to the teams in each section 288 and 290. Players throw balls at members of the opposite team. If a player is hit on any part of his/her body, he/she is eliminated from the game. The first team to eliminate all of their opponents wins.

Dodge ball Eleven: Another version of the game would assess a negative penalty point for balls that are thrown at the opposition and go outside of the perimeter or the pool. The game is immediately paused once a ball leaves the playing field 282 and the player that threw the ball must retrieve the ball and return to his/her position. Play resumes once the retrieved ball and player are back in position. Points are awarded for each hit of an opposing player. The first team to reach eleven points is declared the winner.

Squirt Gun Classic: Players are divided into two equally sized teams and distributed as before. Squirt guns are equally distributed to the teams in each section 288 and 290. Players squirt at members of the opposite team; if a player is hit on any part of his/her body, he/she is eliminated from the game. The first team to eliminate all of their opponents wins.

Because of the energy displayed by the players, it is possible that a disconnection can be effected by an overly-aggressive player. Players are encouraged to minimize excessive contact, with the partitions and floating components and be careful to avoid causing disconnections of joined components. Enjoyment of the group is improved when there are minimal interruptions to continuous play, and interruptions to repair formation breaks caused by excessive contact should be discouraged and penalized. In those cases, a good general rule for the activity director to adopt is the Repair Penalty. Repair Penalties may be included as part of each of the player-active games disclosed herein to encourage players to move appropriately within the formations.

Repair Penalty: If a player causes a disconnection of one of the formation's components during their turn, that player's turn is deleted and all players and props returned to their original positions, and any formation repairs are made. Once everything is repaired and returned to pre-repair penalty positions, the next player starts his turn. Multiple Repair penalties may result in disqualification.

Battleship Games

Figure 37:
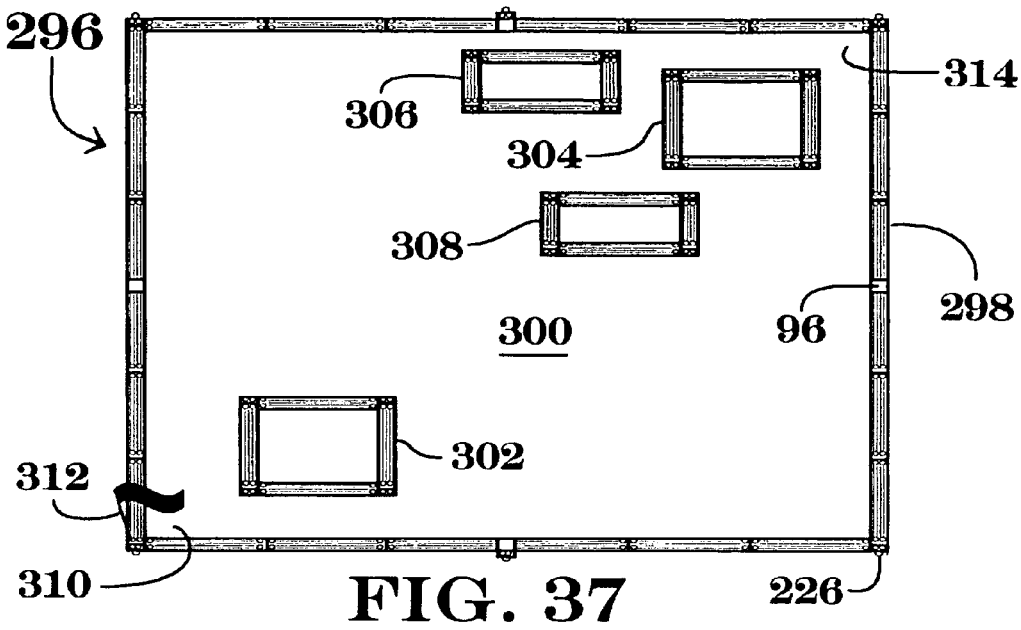
Figure 38:
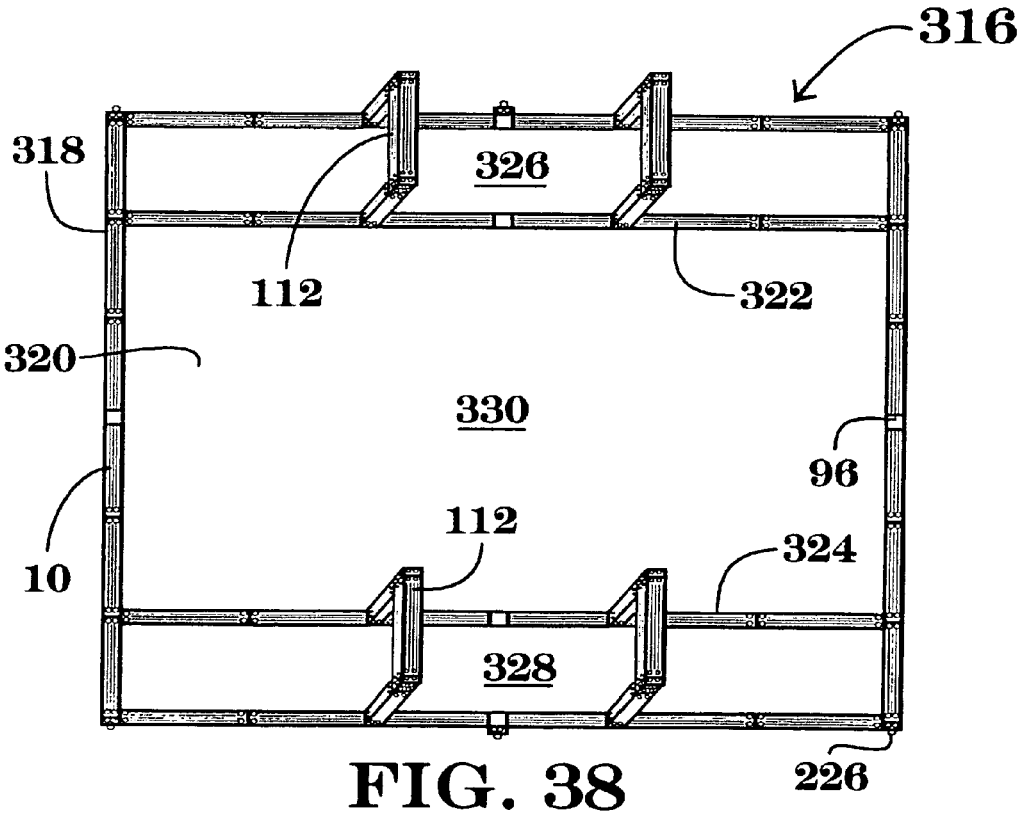

FIG. 37 shows an attack game pattern 296 set up for in-water play of the game Battleship. Perimeter 298 encloses and defines a playing field 300. Four similarly constructed, unanchored, rectangular, modular enclosures 302-308 simulate "ships" representing attack and defender convoy ships of opposing teams. The attack team has one attack ship 302. The convoy team comprises a mother ship 304 and two defender ships 306-308 for a total of three convoy team ships. The ships are preferably adorned or decorated by the participants, not only to identify their offensive or defensive roles, but to allow guests to display their creative talents. A ratio of a minimum of two defender ships for each attack ship is recommended. At least one player is enclosed within each ship and "sails" the ship as he/she swims around the pool. In the event that multiple team players occupy a single ship, one of them is designated as the Captain.

In each of the various Battleship games which will now be described, the game begins with the ships in the positions shown. To start the game, a Home port is chosen at one corner 310 of the playing field 300 and a flag 312 (or other identifying device) is connected and/or erected on that corner. The object of the game is for the mother ship to navigate from the opposite, furthest away, corner 314 of the playing field 300 and have the Captain of the mother ship 304 touch the Home port flag 312 with one hand. The attack ship 302 will attempt to sink the mother ship 304, before it can accomplish its mission. Once the mother ship is sunk, the game is over. As is becoming recognized as standard procedure by this time, anchor Hubs 226 stabilize perimeter 298 at appropriate locations spaced around the perimeter, and support clips 96 reinforce potential weak joints (only one of each is referenced).

Battleship Noodle attack: One person is chosen to be the Captain of the attack ship. Three people are chosen to be Captains of the convoy ships and one of the convoy Captains is chosen to maneuver the mother ship. The mother ship will have no defensive weapons and relies on the defender ships to shield her for successful passage to her Home port. Standard length, flexible noodle toys, available commercially, are distributed to the personnel of the ships to be used as offensive and defensive weapons. The specific rules of the game, e.g., how the noodles may be used offensively and defensively, how the defenders may defend themselves, what constitutes a "hit," when is a hit a "mortal" blow, and how a mortal blow affects the players involved, and similar issues, are all left to the discretion of the activity directors. Suffice it to say that the attack team wins if the Captain of the mother ship is hit by an attacker's noodle, and the defending team wins if the Captain of the mother ship touches the Home Port vertical flag.

Submarine Torpedo attack: This version of attack and convoy defender ships is a variation of Battleship Noodle attack. The offensive weapons are commercially available water torpedoes that are used by the attack ship Captain. The attack ship Captain launches his torpedoes which the defender ships try to avoid. Shipmates are eliminated by being struck by a torpedo, and ships are sunk when their Captains are hit.

Incoming Noodle Attack: This variation of Battleship Noodle attack requires two teams with a minimum of two ships per team. Each ship is armed with one defensive noodle for each player and each ship is armed with an equal number of tossing pieces such as commercially available foam balls, noodle pieces or discs. The foam noodles, discs, or balls are launched by the attacking team. Noodle toys would still be included for use by defenders as a defensive weapon to swat away incoming missiles. The team that can land the most of its weapons in the opponent's mother ship is the winner.

Incoming Channel Attack: Another version of the game allows the opponents to launch shots from the pool deck or from outside the pool. The in-water ship or ships attempt to move across the interior of the enclosed perimeter from one opposite corner to the other. The winner is the player that navigates the route and accumulates the least amount of incoming shots in their ship.

Tag Type Games

Pattern 316 (FIG. 38) comprises a perimeter 318 which defines a playing field 320 for various games of Tag. A pair of partitions 322 and 324 divides the playing field 320 into three zones, two end zones 326 and 328 at opposing ends of the playing field and a catching zone 330 between the two end zone partitions 322 and 324. Pattern 316 is stabilized for in-water use by the usual anchor Hubs 226 connected to perimeter 320 via nylon ropes (not shown) to commercially available anchoring devices located either under-water or pool side, and appropriately located support clips 96 strengthen perimeter 318. Inasmuch as partitions 322 and 324 are anticipated to be subject to movement relative to each other, as many raised gates 112 (FIG. 16) as deemed necessary can be added between perimeter 318 and partitions 322 and 324 to provide additional stability. Note the raised gates 112 do not obstruct free movement back and forth within end zones 326 and 328. The number of rigid bars 10 used in constructing the Tag playing field 316 will depend upon the size of the pool, the number of participants, and how difficult the activity director wants the game to be.

Classic Tag: One person is chosen to be "IT." If the game play is a team game, one person from each team may be chosen to be IT for their team. IT cannot enter the end zones. A player is considered to be safe once their head is above water in either end zone. To start the game, IT is positioned in the catching zone and all other players are equally divided and positioned in one of the two end zones. The object of the game is for players to race from one end zone to the other without being tagged in the catching zone by the person who is IT. Once a player has been tagged by IT, he/she is eliminated, becomes an additional IT, or can be counted as a point scored for team scoring games. Each game is continued until a win or tie is declared. The last player, individual or team, remaining in an end zone that has not been caught will be the winner. In team play, the winner may be the first team to have eliminated all the opposing team's players. Or, points may be awarded for each player caught, or for each pass through the catching zone, and a win may be declared when one player or one team reaches a predetermined total of points, e.g., twenty one points.

Other variations of tag are, of course, within the purview of the activity director's discretion.

Toss-into Target Games

A group of games utilizing modular game patterns involves tossing a game piece into a selected pattern. The formation of boundaries and partitions designate a series of target areas where players attempt to throw a game piece such that it lands, i.e., comes to rest, within a given, selected target area. The player may bounce, skim, skip, pitch, or toss the game pieces into the target areas; the manner of throw or the flight path of the game piece is irrelevant, so long as it ends up in the appropriate target area. A Home Position which is outside the pattern's perimeter is designated and could be an in-water spot or a pool-side location. These types of games can easily accommodate a minimum of two players or multiple players for individual or team contests. TOSS-INTO pattern games allows the activity director to tailor a program for people of all ages and differing skill levels, to thus be more inclusive of more guests.

Figure 39:
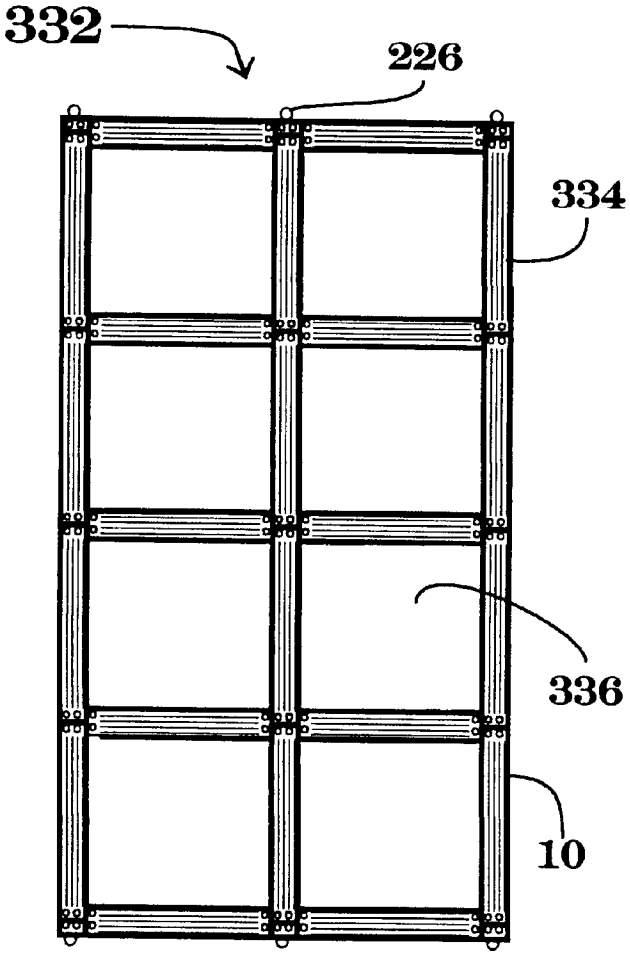

The modular pattern 332 for one target game is shown in FIG. 39 and is completed by connecting a plurality of rigid bars 10 in the shape of a grid 334, as shown. Corners, T-joints, Plus-joints, and anchors are assembled using any combination of rigid bars and Hubs according to the techniques already described. A plurality of rectangular target areas 336 is provided; eight are shown, but any number may be constructed. The target areas 336 may all be equally sized squares, equally sized rectangles, or combinations of squares and rectangles having different orientations and/or dimensions by mixing different combinations of bars and Hubs. Each of the target areas are assigned point values according to their size, location in the grid, or distance from the Home spot. Alternatively, they may be suitably identified for sequential rotation by conventionally available floating markers (not shown). As needed, modular anchor Hubs 226 stabilize the position of the floating grid 334 in the water.

Players attempt to successfully bounce, toss, skip, or skim their game pieces into the desired target area. Choose an in-water or pool-side "Home" spot from which each player will toss. An appropriate selection of tossing pieces, such as plastic or foam discs, inflatable or foam balls, floating and Velcro pool darts, bean bags, basketballs or volleyballs, that can be safely and successfully bounced, skipped, or tossed into the target area, is required.

Target Play: The order of play of the players is determined prior to the contest. The game begins when a player stands on the Home spot and bounces, skips, skims, or tosses his/her piece from the home location toward pattern 332, attempting to land the piece in a target area 336. Play passes sequentially from one player to another, regardless of whether or not a target has been hit. An alternative method of play allows a player to continue tossing his/her pieces each time the piece lands within a target area. The activity director would establish and announce the rules of play before play begins.

According to one manner of play, it is inconsequential in which order the target areas 336 are hit. Once a target area has been hit, however, it is no longer a valid target, and landing in it again is considered a miss. If the piece does not land in any target or in an invalid target, the piece is ruled out of play, and that player loses his/her turn. Play continues until all of the target areas have been hit. The winner is the first person or team to hit all of the target areas.

Another variation has the player progress through sequential steps from one target area 336 in an order that has been pre-determined by the rules. If the piece does not land in the designated target for that turn of play, the piece is ruled out of play, and that player loses his/her turn.

In a third variation, point values are assigned to the target areas, depending upon the difficulty of the piece landing in that area. Rigid bars of different lengths can be assembled into a target grid wherein the target areas are of different sizes and shapes, thereby creating target areas having a different difficulty of a player successfully landing a piece in that area. Using rigid bars of different colors adds interest, as well, since different colored "bulls-eyes" can be selectively located throughout the pattern. Each player is given the same number of pieces. According to one mode of play, the players toss their pieces one at a time in turn, the order of play having been predetermined. If the piece lands in a target area, the player is awarded the point value for that area. If the piece misses the pattern completely, the player receives no points. When all of the pieces have been tossed, the player with the most points wins. Another mode of play rewards each successful toss by allowing the player to continue tossing. The game ends when one player has tossed all of his/her pieces, and the winner is either the first player to run out of pieces or the player with the most number of points when the first player has run out of pieces.

Figure 40:
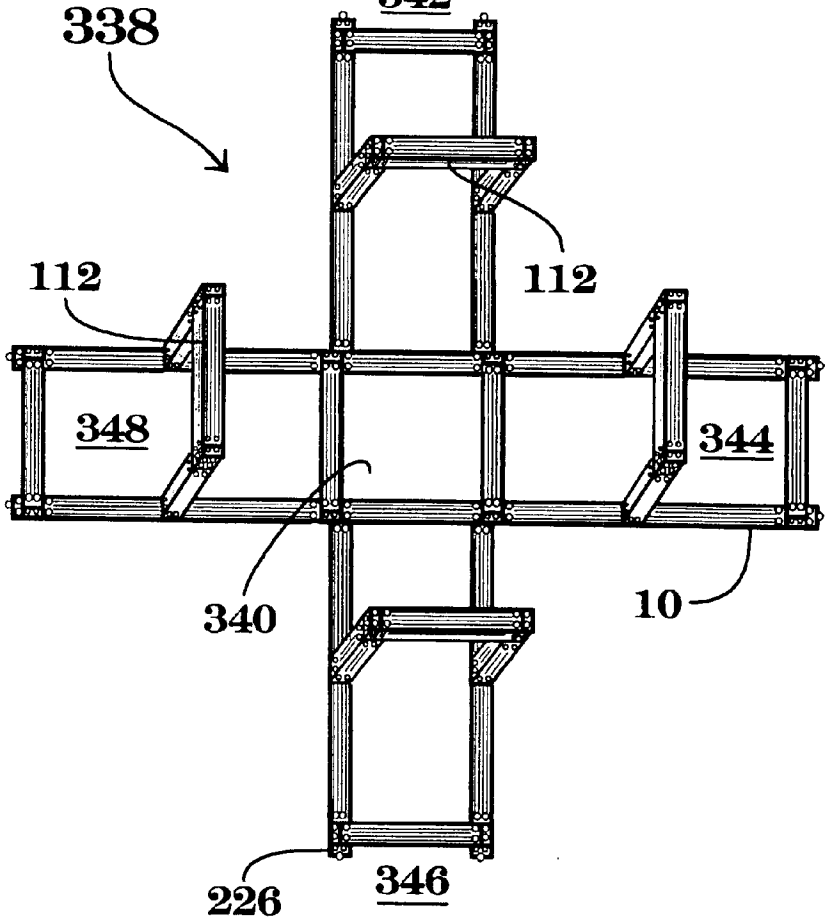

FIG. 40 shows an alternative TOSS-INTO pattern. Pattern 338 comprises assembling bars 10 to form a plurality of target areas 340 arranged in the shape of a Plus (+). Water anchors may be connected to the modular anchor Hubs 226 to stabilize the position of the floating pattern in the water. Raised gates 112 create visual interest, aid in maintaining spacing of the targets and patterns, and are obstacles when placed between players and selected target areas.

Play is as above relative to Target Play. Players must toss from a Home position, which may or may not be different for each player or team. Points are assigned to each target area according to their difficulty, or the target must be hit in a predetermined sequence, or targets are eliminated when hit.

Under-the-Gate Disc Toss: A variation involves assigning a point value for each target area, e.g., five points for the center target area, two points for the adjacent target areas, and one point for the outermost target areas. The players choose a series of Home spots that are outside the pool and that line up with the entrances 342, 344, 346, and 348 of the four lanes, North, East, South, and West. The object of the game is to accumulate points. The first player positions himself/herself in the first Home spot of a given lane, say the North lane 342, and throws his/her skimming disc attempting to "skim" it under the raised gate 112 and have it land in one of the squares, preferably the center square with the highest point value. If the disc does not pass under the gate or if it skims outside of pattern 338, the player earns no points and loses his/her turn. Each player must rotate through the Home positions facing lanes North 342, East 344, South 346, and West 348 in a clockwise direction, and skim the disc under the associated raised gate 112. Turns are alternated between players or teams. One version declares the first player or team to reach a score of twenty-one as the winner. Another version stipulates that if a team does not accumulate an exact total score of twenty-one and goes over that point total, they lose their turn and have to start again from zero.

Tic-Tac-Toe Games

The Crown Prince of Toss-In games is Tic-Tac-Toe. Everyone knows the rules, it presents challenges everyone can visualize, and the assembly of the playing field is quick, easy, and requires a limited number of Kit components.

Figure 41:
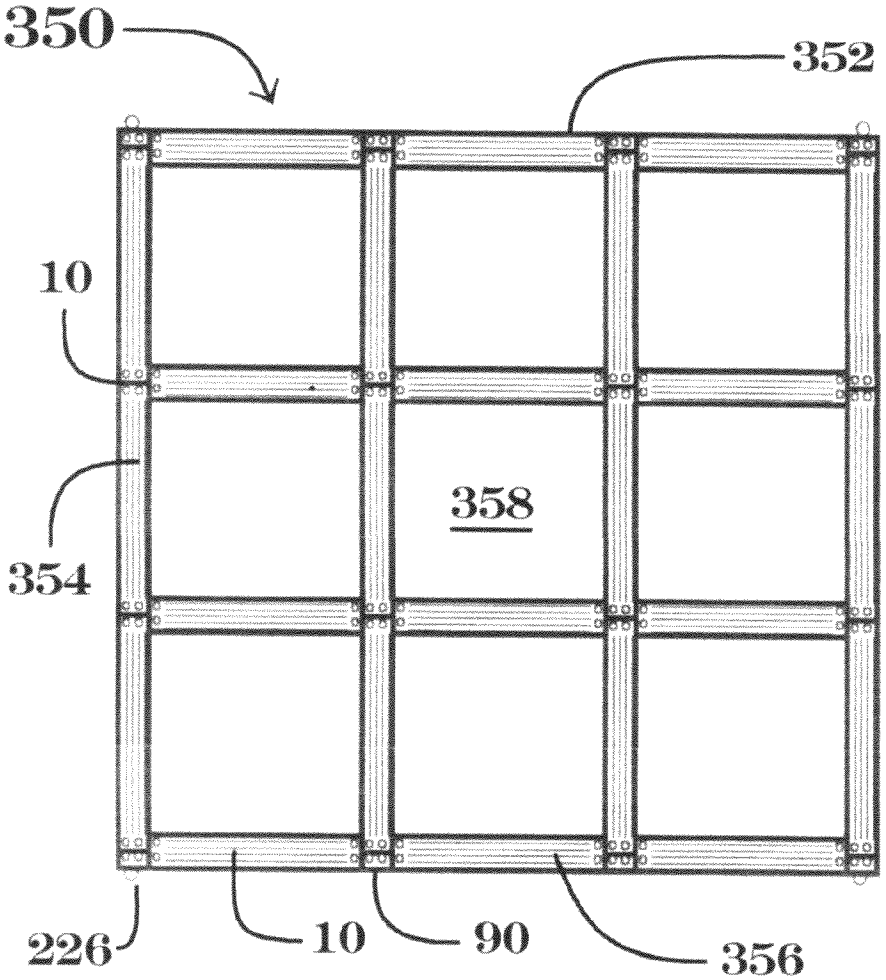

Turning to FIG. 41, as shown Tic-Tac-Toe pattern 350 comprises a three by three modular grid 352 assembled by joining together twenty-four rigid bars 10 into four vertical columns 354 interconnected with four horizontal columns 356 to delineate nine substantially square target areas, as represented by center "square" 358. Different joinery methods can be used to create different sized target areas. For instance, the T-joints of horizontal columns 356 may include three rigid bars 10 coacting with a Hub 90 whose outer surface smoothes out the sides. The vertical columns comprise vertical bars 10 joined bar-to-bar with the interior bars plugged into the side surfaces of the bars' endcaps. Because of the different joineries, the "squares" are not exactly square but rather are slightly rectangular. Other joinery combinations will, of course, result in exactly square target areas. Four Anchor Hubs 226 fill in the corners and aid in stabilizing the patterns for in-water use when connected to anchoring ropes. Recommended commercially available tossing pieces include five red and five black soft foam discs.

No support clips 96 are shown in FIG. 41. Inasmuch as pattern 350 is a toss-in field of play, it is not anticipated that it will receive undue stress on the joints. The holding ability of just the post and ports joined together as indicated to form Tic-Tac-Toe pattern 350 is quite sufficient to hold the pattern together under normal usage. The pattern can even be constructed outside of the pool and dragged to the water's surface without coming apart. No other prior art construction kit known to the inventor can make this statement while being as easy to assemble and disassemble as the Olympic Game Kit.

The games can accommodate two players or four players separated into two, two player teams. The representative games described are illustrative of the many variations from the basic game, allowing activity directors the opportunities to add more interest to this simple but versatile pattern.

The standard Tic-Tac-Toe game starts by choosing the player (or team) that goes first; he/she gets the five red "X" discs. The other player gets the five black "0" discs and goes next. A pool-side "Home" spot that each player will toss from is designated. The winning object of the game is to get three game pieces of the same color inside of three vertical, horizontal or diagonal squares that line up within the grid. The game begins when a Red player throws his/her Red "X" piece from the Home location, attempting to land the tossing piece in a square. If the piece does not land in any square on the grid, the piece is out of play and that player loses his/her turn. If the piece lands in a square that already has a piece in it, the second piece in the square is invalid and that player loses his/her turn. Each game is continued until a win or tie is declared, or until all pieces have been tossed. The game may be continued until one player reaches a target total of points. Points may be awarded to the winning player for a win and to both players or teams for a tie. Tie games are called, when neither player can accomplish the winning object. At the end of a game the pieces are retrieved and the grid is cleared. A winning player must take the black discs for the next game and start second. Many variations of tic-tac-toe games, from easy to expert, are possible.

The following variations can be used individually or in combination with any or all of the other variations. Regardless of the combination of variations selected, the standard rules for Tic-Tac-Toe apply.

Instead of a pool-side Home location, an in-water home location or area can be designated, either in the shallow end of the pool where all players can stand-up and toss comfortably, or in the deep end of the pool where players must tread water.

If an in-water Home location is chosen in an area of the pool that is deep enough so that the tallest player's head can be tucked under water, all players must submerge their entire body under the water's surface and spring off the bottom of the pool, so that they "breach" the surface of the water. They must toss their game pieces after they breach but before landing back in the pool.

With either a pool-side Home location or an in-water Home location, the players can turn around so that they are not facing and cannot see or look at the game grid as they toss their pieces.

Two variations require that no water anchors be used to secure the Tic-Tac-Toe pattern. In one, an opposing player will be allowed to stand at an outside corner of the pattern and move or shake the grid once the opposing player has thrown their piece in an attempt to make the player miss. Or, a teammate will be allowed to stand at a chosen corner of the Tic-Tac-Toe pattern and move the grid once their teammate has thrown their piece to try to position it such that the piece lands in a valid square.

Prior to each toss, an opposing player can be allowed to choose a square in the grid to defend. The opposing player is not allowed to have his hands break the surface of the water and must stay in the square chosen until the opposition throws his piece. The primary object is for the defending player to use their head or body to deflect the piece thrown so it does not land in the square.

The Tic-Tac-Toe playing field may be arranged to include a built-in handicap, so that players of different skill levels can compete as if on a "level field." For example, placement of grid 368 closer or further from an edge of the pool affects its difficulty. Multiple Home locations on different sides of the pool allow players that are the closest to the Tic-Tac-Toe pattern to more easily access the Tic-Tac-Toe squares. Specific multiple Home locations are chosen according to the skill level of the players.

Figure 42:
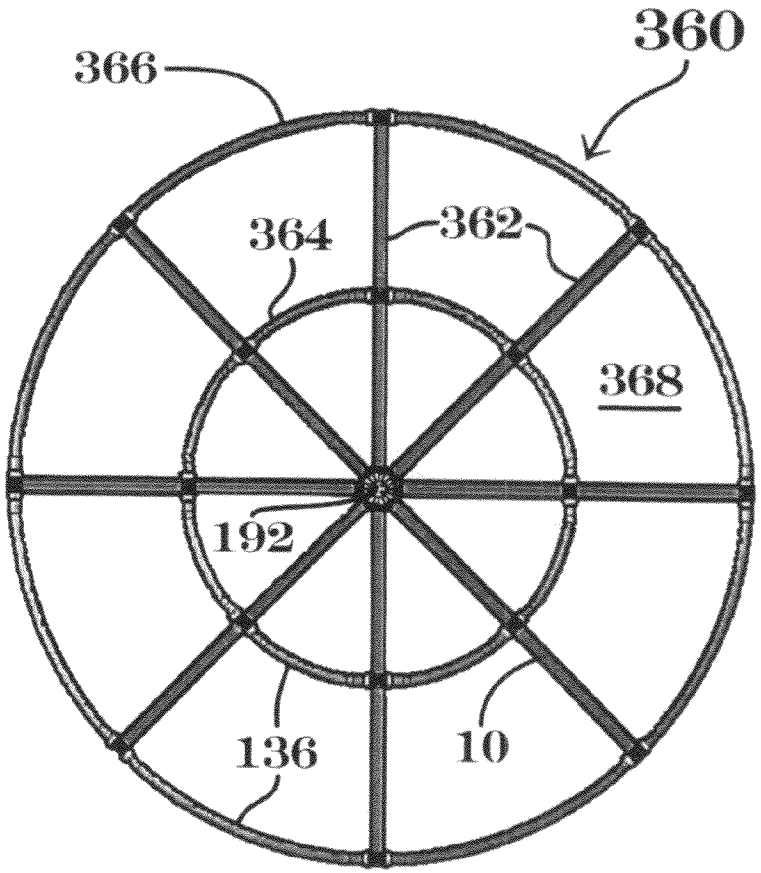

A more visually spectacular TOSS-IN pattern is the wheel-shaped pattern 360 shown in FIG. 42. Radiating outwardly at forty-five degree angles from a centrally located octagonal Hub 192, a plurality of rigid bars 10 are joined bar-to-bar to form eight spokes 362. Flexible bars 136 are connected to the endcaps of the rigid spoke bars 10 to form concentric rings, an inner ring 364 and an outer ring 366, centered on Hub 192. The number of rings depends upon the size of the pool and the activity planned and can be as many as desired. Hub, spokes, and rings define a plurality of target areas or wedges 368. Wheel 360 is shown as having one ring per radial spoke, but the number of bars per concentric ring is a variable given to the activity director so he/she might design larger wheels with varying sizes of target areas defined by the spokes and rings. The Olympic Game Kit includes flexible bars of different lengths, including values selected to match the circumferential arc of a growing wheel pattern 360.

The following games are examples of variations of toss a game piece into the modular wheel-shaped pattern 360. The target game may accommodate individual contestants or teams.

Other configurations can be constructed. For example, the butt-end of a rigid bar 10 (not shown) may be attached to the posts and ports on the top surface 196 (FIG. 29A) of centrally located octagon Hub 192, so that the bar extends vertically from the pool. This option provides visual interest and/or creates a vertical post for a ring toss target or as an obstacle to the tossed pieces; attachment of the butt-end 148 of a flexible bar 136 to top surface 196 of octagon Hub 192 provides additional visual interest as a waving centerpiece.

One TOSS-IN game utilizing wheel 360 attempts to force the opposition to accumulate all of the letters to spell P-I-Z-Z-A, the letters suggested by the simulation by pattern 360 of a pizza pie. The players choose a Home spot, either in the water or pool-side, from which every player must toss his/her pieces into the wheel shaped target. The object of the game is to avoid accumulating letters so that the opponent spells P-I-Z-Z-A first. Team play requires that a sequential order of players be established before the start of the game. To start the game, a coin flip or other method of choice is used to determine the player or team member that gets to go first. The first player positions himself/herself in the Home spot and bounces, tosses or skims his/her tossing piece attempting to land it in one of the pie shaped wedges that will be difficult for the opponent to match. If the first player is unsuccessful and does not land it in one of the pie shaped wedges, turn passes to an opposing player or team member who repeats the process. If a player is successful in landing his piece in a target wedge, the opposing player or team member must land his piece in the same target wedge from the same Home spot. If the second player is unsuccessful and does not land the piece in the same target, he/she is penalized with a sequential letter in the word PIZZA. If the second player is successful and lands his/her piece inside the appropriate target, he/she is rewarded by being able to throw again. The opposing player or team member must now match the shot. This process continues until the one player or team spells P-I-Z-Z-A. The other player or team is declared the winner.

In another game, the players (individual contestants or teams) are given easily distinguishable game pieces to toss into the wedge-shaped sections 368 defined by the spokes and rings of wheel 360. Each wedge section is assigned a point value of one through fourteen, the higher the value, the higher the difficulty in landing the game piece in the corresponding wedge section. The determination of difficulty is based in the size of the target and on its location relative to the Home spot. The point values can be indicated by floating numbered accessory disks positioned inside the wedge areas. Players who successfully land their pieces in a wedge area earn the points associated therewith. The object of the game is to accumulate points as quickly as possible. The first player positions himself/herself in the Home spot and tosses, bounces or skims his/her tossing piece, attempting to land it in a wedge section with the highest point value. Turns are alternated between players or teams. One version has that the player or team reaches a score of twenty-five first is declared the winner. Another version has that if a team does not accumulate an exact total score of twenty-five and goes over that point total they lose their turn and have to start again from zero.

In the previous game, wedges 368 are randomly targeted. The object of this game is to toss the piece into a number designated wedge in sequential order. Players attempt to successfully toss a foam ball, disk or dart game piece into sequentially numbered targets so that they complete a full rotation starting at the lowest number and ending at the highest numbered. The first time players toss, they must land their piece in the Number One wedge section. If the player is successful, they continue to toss sequentially through wedge Number Sixteen. When players are unsuccessful, they lose their turn and must begin their next turn attempting to target the sequential wedge number they missed on the last turn. The winner is the first player or team to complete a sequential rotation around the wheel.

Many of the game playing applications describe examples of play that incorporate commercially available accessories, and indeed many of the invention's intended game playing applications are specifically designed to accessorize established and new swimming pool products and outdoor game and activity products. FIGS. 43-50 illustrate representative examples.

Figure 43:
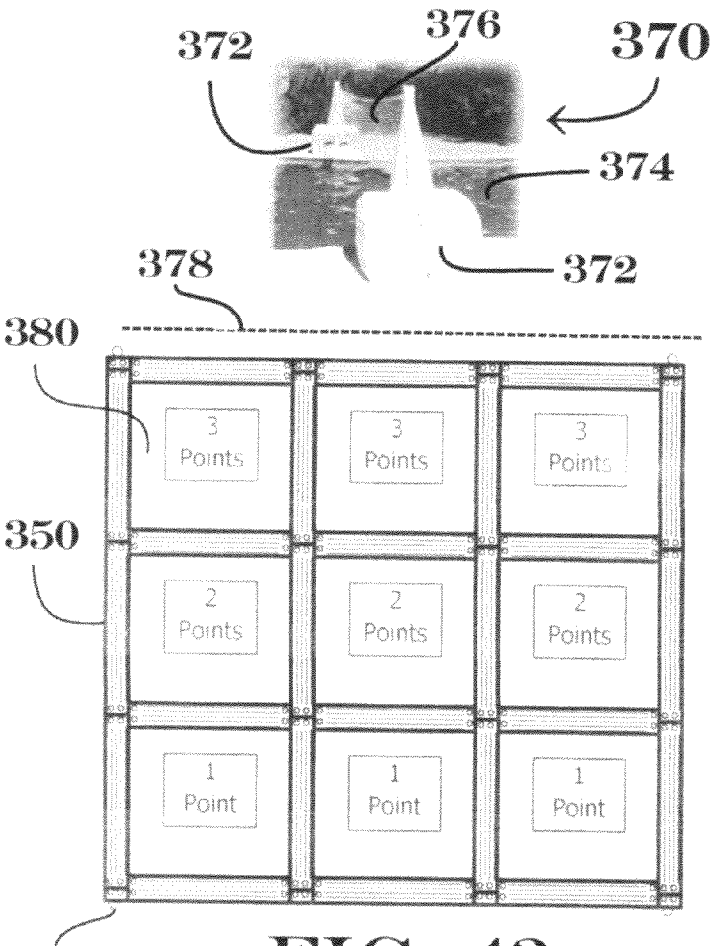

Turning to FIG. 43, a commercially available volleyball net assembly 370 designed for pool use comprises a pair of weighted stands 372, which are placed on the pool deck on opposite sides of the pool 374, and a net 376 attached to stands 372 and stretched across the pool. On one side of the net, signified diagrammatically by the dashed line 378, is a three by three, Tic-Tac-Toe type modular grid 350. The target areas 380 inside grid 350 are assigned point values as shown. Grid 350 is anchored in place at appropriate locations by anchor Hub 226 as usual.

The Volleyball Net Serve Game allows players of competing teams to accumulate points by serving a water volleyball over the net and into one of the target areas. Points are awarded depending upon in which target area the volleyball rests. Teams may alternate serves or serve a set number of volleyballs. Whichever team has the most points at the end of the serving session, wins. Or, the teams may continue to serve until the winning team accumulates a certain amount of points. This game can also be used as a practice tool for improving one's volleyball serving and location of serves skills.

Another Volleyball Net Serve Game, like P-I-Z-Z-A, is played by individual contestants or teams that play against each other in an attempt to force the opposition to accumulate all of the letters to spell S-E-R-V-E. This game typically requires swimming pool volleyball net assembly 370 or a modular floating divider and a water volleyball or other appropriate tossing piece. Players choose a Home spot in the shallow end of pool 374 on one side of the volleyball net 376. A modular, three by three, Tic-Tac-Toe pattern 350 is assembled on the far side of the volleyball net. The distance between the Home spot and the floating grid 350 will determine the difficulty of the game.

The object of the game is to avoid accumulating letters so that the opponent spells S-E-R-V-E first. In this game, a player serves the volleyball (or throws a tossing piece over the net), attempting to land it in one of the squares that will be difficult for the opponent to match. If the opponent matches the serve, he/she goes next and attempts to land his/her volleyball in the same square. If the player is unsuccessful and does not land the piece in the same target, he/she is penalized with a sequential letter in the word S-E-R-V-E. Play alternates until the one player or team spells S-E-R-V-E. The other player or team is declared the winner.

Figure 44:
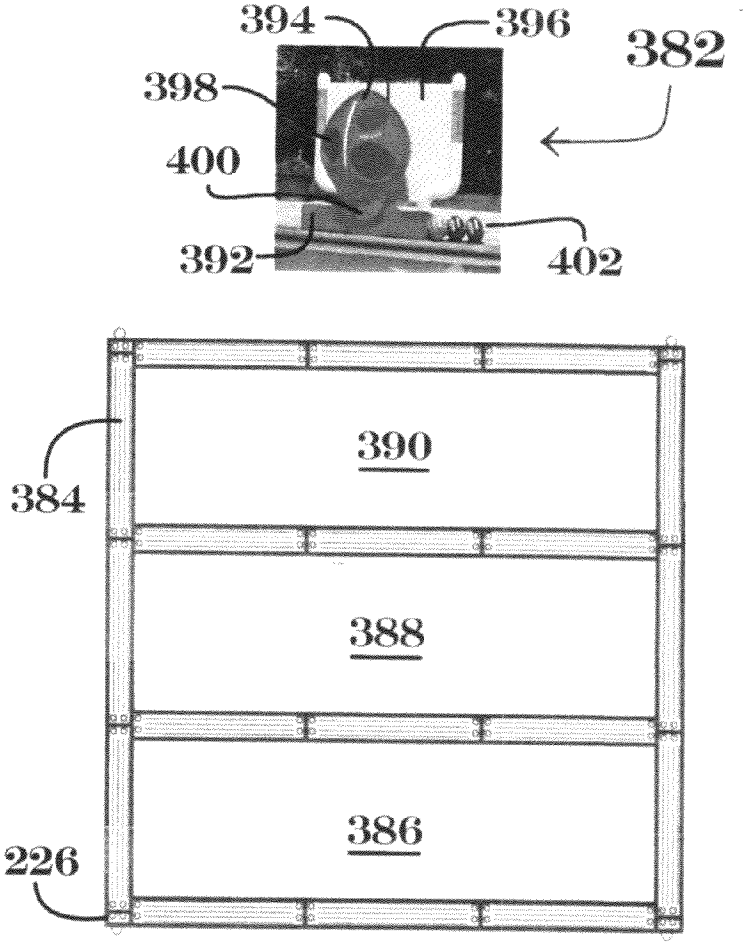

Another accessory game, this time a TOSS-FROM game, is shown in FIG. 44. A commercially available football target 382 (shown is Aqua Toss™ by Pool Shot, Inc.) or similar type of target is positioned outside the pool at one end of a rectangular, tri-zoned grid pattern 384. Pattern 384, constructed in the pool, is divided into a minimum of three partitioned zones 386-390. The zones are designated as an offensive zone 386, a defensive zone 388, and a no-man's zone 390. Anchor Hubs 226 are attached to sand anchors in the usual manner to stabilize the floating grid. Larger or smaller versions of this pattern can be constructed with less or more components in varying configurations to accommodate larger or smaller groups of players.

Football target 382 is positioned at one end of the zoned grid 384 outside the pool. The football target 382 comprises a base 392, an enlarged simulated football 394, and a backboard 396. Football 394 has three openings 398 representing, clockwise from the top, a safety, touchdown, and field goal, each of which is assigned commensurate point values. Simulated football 394 is hollow and includes an exit spout 400 for returning the football back into the pool. Backboard 396 reflects errant passes back into the pool. Specially made foam footballs 402 are commercially available.

While Swimming Pool Football can be played by individual contestants, it is more suited to team play. Before the game can begin, flip a coin or choose the team that gets to go on offense first. The other team will start on defense. The offense will get the football and start in the partitioned zone furthest from the target, i.e., the offensive zone 386. The defense will start in the middle zone, the defensive Zone 388. Players are not allowed to leave their zone nor stray into the no man's zone 390.

The offense and defense must line up in a tight group in the center of the offensive and defensive partitions. The defense starts the game by a predetermined signal. Once the "play" has started, the offense and defense are allowed to move freely within their partitioned zones. The offense may attempt to "hide" the ball, and may pass and hand off the ball between players in an attempt to get a clear shot at the target. If the ball is dropped and hits the water, all offensive players must return to the center starting position and re-start their play. The offense is allowed a count of fifteen seconds before they must throw the football at the target.

The defense can move freely in the defensive zone and attempt to block or interfere with the offense's attempt to throw the ball into the target. One variation would be that the defensive players are only allowed to have one hand out of the water to block shots. In the event of an interception by the defense, the player or team is awarded an extra play on their next offensive turn. If the interception occurs on the final possession and the intercepting team does not have a scheduled final offensive possession, they will be granted one overtime offensive possession as reward for the interception.

The offense is allowed three plays to score as many points as possible. Points are awarded for each shot that lands in an opening in the target, and the number of points is determined by the point values associated with each opening in the target.

The offense will turn over possession of the ball at the conclusion of the three plays. Accumulated points will be totaled at the end of a game. A game shall be concluded, when each team has had five offensive possessions. The player or team with the highest total of points is the winner.

When the teams have disparate abilities, e.g., adults v. children, the children's offensive zone would be zone 388, while the adult's offensive zone would remain 386. More zones can be added, so that the adult's offensive zone could be moved further from football 394, in order to increase their handicap.

Smaller children, or handicapped persons, may find throwing the football into the three openings 398 in football 394 to be discouragingly difficult. To allow more people of varying athletic abilities to enjoy the game, a simple net, similar to a water polo net, a lacrosse net, or a soccer net, which has been adjusted in size to fit the swimming pool game and anticipated participants, could replace the football target 382 shown, in order to provide a larger target for easier scoring.

Another commercially available accessory is a swimming pool basketball stand. They are common in backyard pools and also at venues like summer camps, resort complexes, YMCA's, and public or private facilities where the swimming pools may be regularly used for in-water organized group games and activities.

FIGS. 45-48 show illustrative patterns usable with a basketball stand placed poolside in combination with an Olympic Game Kit pattern assembled in the pool in front of the stand. Variations in the pattern lead to different games playable with the same basketball stand.

Trying to simulate traditional team basketball with only a swimming pool basketball stand positioned along the edge of a pool, i.e., without the Olympic Game Kit, is challenging. Typically, only one basket assembly is available in a pool, so the game is played as a half-court game. A change of possession requires that the ball be returned beyond the "key" before further offensive play can be initiated. Inasmuch as there is no visible key, the transition is at best vague, which opens up the opportunity to "bend" the rules. In addition, traditional basketball play includes a three second rule to penalize an offensive player who remains inside of the "key" under the basket for more than three seconds. In a swimming pool with no key, the three-second rule, too, has no clearly enforceable meaning. This type of undefined and unregulated team basketball game in a swimming pool typically becomes a battle of strength between the biggest and most aggressive players. The end result is that the activity director's desires to provide games inclusive of all size and skill levels is doomed. Finally, other than the pool sides, there are no well defined basketball court boundaries to identify out-of-bound zones, a potential source of injuries as players crash into the concrete walls while going for a loose ball. The Olympic Game Kit remedies these problems.

Figure 45:
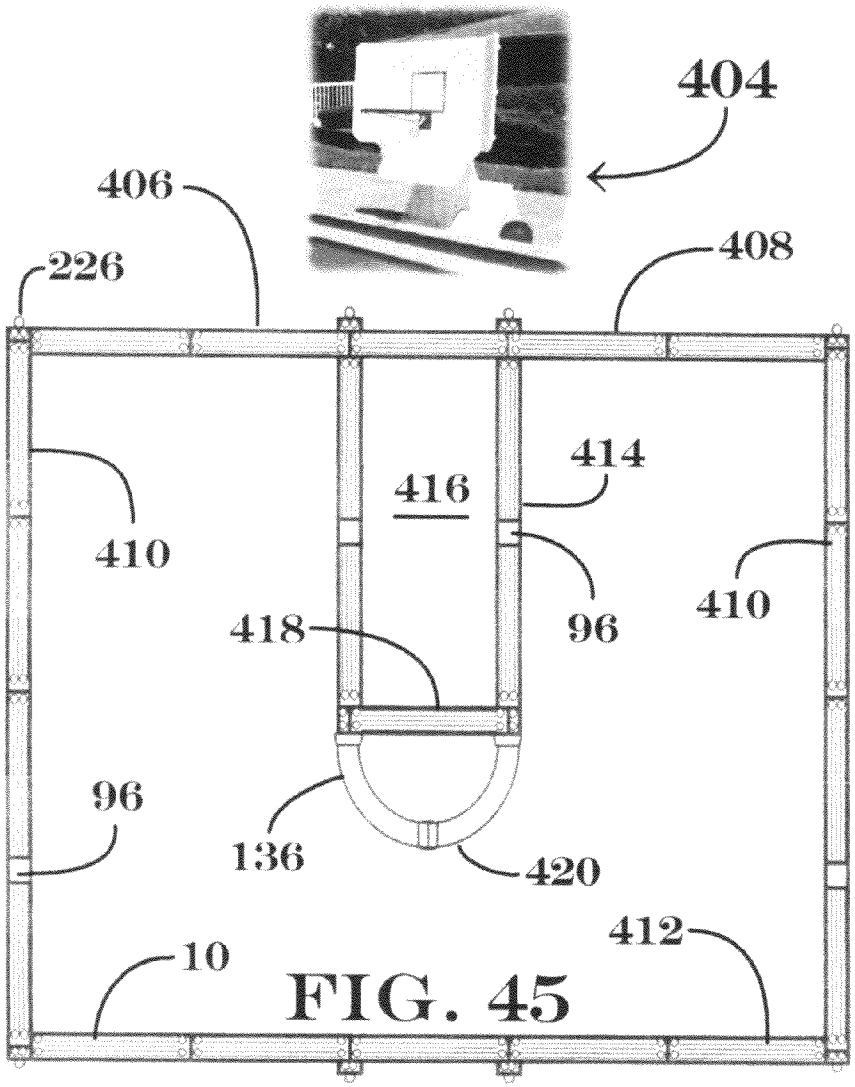

Turning to FIG. 45, a swimming pool basketball stand 404 is typically positioned at the edge of the pool, out of the water on the pool's deck. Depending upon the pool size and number of participants, a pattern simulating a traditional basketball court 406 is assembled from rigid bars 10 in the pool in front of the basketball stand 404 as a basic periphery establishing a baseline 408, sidelines 410, and a mid-court line 412. Chasing a loose ball into a line of linearly connected rigid bars is far less painful than into a pool edge. A basketball key 414 comprising a foul lane 416, a free throw line 418, and a foul circle 420 is attached to the baseline 408 of court 406 intermediate sidelines 410. The foul lane 416 and free throw line 418 are constructed of rigid bars 10; the foul circle arc 420 is made from flexible bars 136 joined end-to-end and attached to the ends of free throw line 418. The apex of foul circle 420 marks the top of the key. The court and key are anchored and reinforced by as many anchor Hubs 226 and support clips 96 as necessary at selected locations in the usual manner.

By anchoring a floating court and key at the base of the swimming pool basketball stand (FIG. 45), the court pattern 406 instantly creates a defined zone that encourages more structured and regulated basketball play. The addition of the floating pattern creates the option for more complex and interesting offensive and defensive team strategies, and reduces the advantage of the size and strength of the players.

Play is best undertaken observing as many of the traditional basketball rules as will reasonably transfer to an aquatic setting. Out-of-bounds possessions follow the same "last to touch" rule; fouls (preferably called by a pool-side "referee" but, in a pinch, by the players themselves) and their accompanying turnovers or free throws; and "three-second" violations are a few examples of valid applications of conventional rules. Some rules must be adapted to the environment, however.

Mimicking traditional dry-land basketball, players with the ball must "dribble" if they intend to control the ball and move around the court. Traveling without dribbling results in a foul and a change of possession. In in-water basketball "dribbling" is simulated by the basketball floating on the surface of the water and being pushed by the player's body, head, or arms, that is, anything but the hands. Players may enclose and control the floating ball with their arms and body to push or "dribble" the ball, but they cannot grab or hold the ball with any part of their hands while dribbling through the water. Contact by a defender with the ball-handler while attempting to grab the ball is a reaching-in foul and punishable according to normal basketball rules. Once the player with the ball stops the dribble and is stationary, he/she may then grab the ball with one or both hands to pass or shoot. A five second rule (or other pre-selected time limit) may be implemented to promote action. It requires that the stationary player in possession of the ball must pass, shoot or dribble within the allotted time or it is a foul and change of possession occurs. The double dribble foul prohibits a continuation of dribbling a second time after the player has dribbled and stopped.

The activity director is empowered to promulgate other rules to determine other aspects of the game, for example, the rules for a complete game can be one of the following: a predetermined time allowance for quarters, halves or the total length of the game, time limits for each team's possession, or the first team to reach a predetermined total number of points scored.

It is to be expected that the most vigorous action will take place in and around the key. The activity director may find it prudent to reinforce the key, especially if it is an enlarged key 422, such as the one shown in FIG. 46. Four rigid bars 10 are connected plus-shaped across the foul lane sides 424 and from the base line 426 to the free throw line 428. An arc 430 extends above free throw line 428. In FIG. 45 foul circle arc 420 is shown as comprising two flexible bars 136 joined end-to-end; in FIG. 46 three flexible bars 136 are used. The number will be determined by the activity director according to the size of the key.

Figure 46:
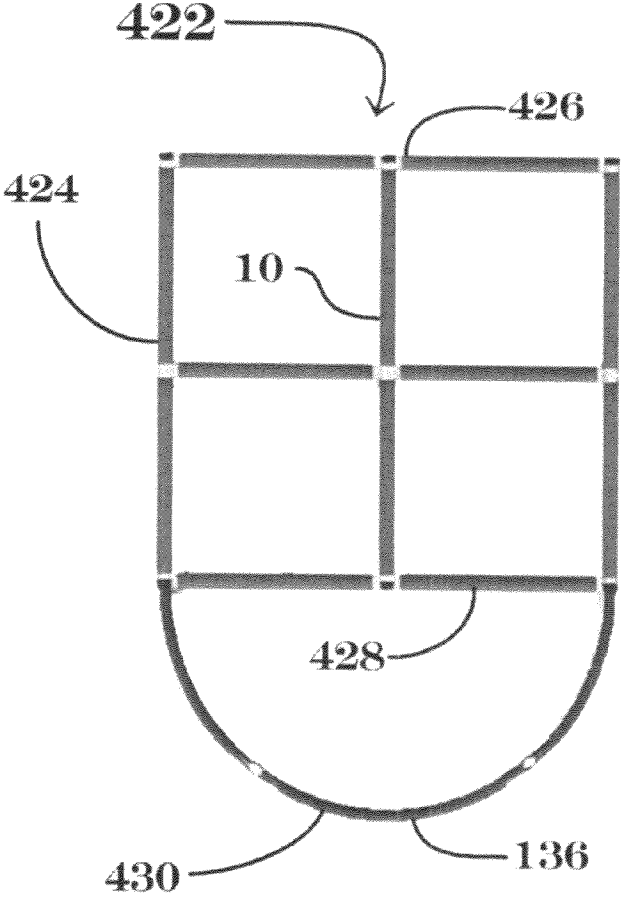
Figure 47:
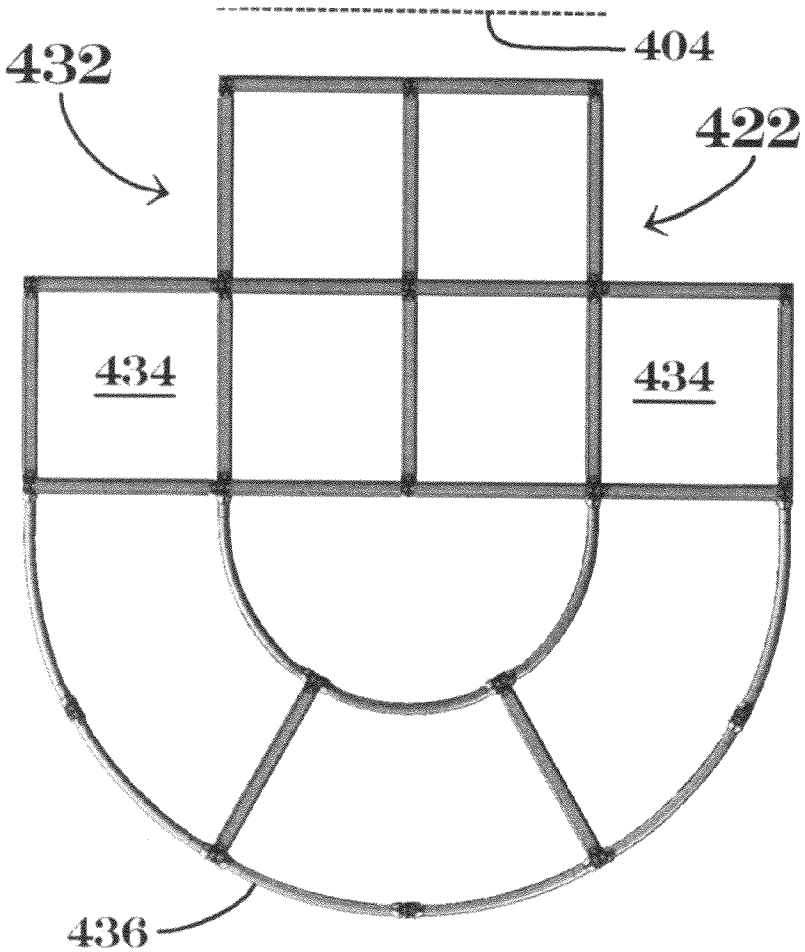

An expanded key 432 is shown in FIG. 47. To the enlarged key 422 shown in FIG. 46, a pair of wings 434 and a three-point line 436 are added. Expanded key 432 is an option for the activity director, when the crowd is larger and older. It allows for a closer simulation of a college or pro game.

The multi-segmented pattern 432 shown in FIG. 47 is especially suited for a Lightning Round in a shoot-from-the-pattern game. Players or teams compete in accumulating the highest total of points in a time regulated round of action. Each player begins in one of the partitioned areas in expanded key 432 and takes as many shots as he or she can in a predetermined time period. Team members, or players of the shooter's choosing, may be in and/or out of the water to rebound and retrieve the ball after each shot and return it to the shooting player as quickly as possible. The shooting player must be unobstructed by other players. Points are awarded for each successful shot. The player then moves on sequentially through the remaining partitioned areas, repeating the process in each one. Predetermined point values and pre-determined time allotments are designated for each position in the sequence. Point values and/or time allotments may be uniform throughout the sequence, or point values and/or time allotments may increase as the distance from the basket increases. For example, one scoring/timing possible for the pattern illustrated in FIG. 47 could be as follows: The two positions closest to the basket (indicated diagrammatically by dashed line 404 in FIG. 47) have a point value of one and a time allotment of 10 seconds. The four positions in the second row away from the basket have a point value of two and a time allotment of 15 seconds. The semi-circular area between the free throw line 428 and the foul circle arc 430 has a point value of three and a time allotment of 20 seconds. The arched area between the foul circle arc 430 and the "three-point line" 436 has a point value of four and a time allotment of 25 seconds, and anywhere beyond the "three-point line" 436 has a point value of five and a time allotment of 30 seconds.

One game option allows each player to individually complete one or more sequences and accumulate a total number of points either individually or for the team. Another option allows each team to strategically position one player in each position of the formation. Each team member accumulates as many points as possible from their designated position to add to their team's total.

Any of the basketball courts shown in FIGS. 45-47 are useful venues to play a basketball free throw shooting contest. The configuration and spacing of the key's pattern and the free throw line can be modified via the number of modular floating bars utilized in the pattern and by the use of short and long bars to increase of decrease the distance from the basket to the free throw line. To start the contest a designated first player takes possession of the ball and moves into position behind the free throw line at the top of the key. The other players position themselves outside of the designated key around the basket to rebound shots and return the ball to the shooter. The non-shooting players may not physically interfere with the shooter or the shot. The shooter attempts to make a free throw and is rewarded with one point for each made basket. If the shooting player successfully makes a shot, he/she and/or his/her rotating team members retain possession and continue to take the shots. Once a player or team member misses a shot, possession of the ball shifts to the other team, and they initiate the same process. When a player or team misses a shot, they retain the existing point total and re-start from that point total once they regain possession of the ball. The player or team that gets to the pre-determined point total first wins the game.

Another variation of a basketball free throw shooting contest in a swimming pool is to eliminate the reward for successful fouls shots with continued possession, and structure the game so that alternating players or team members take a predetermined number of foul shots to complete a round of play. The total number of points accumulated by successful shots in a round determines the winner. A tie score is resolved via a sudden death format. The loser of a coin toss must go first, since the first player or rotating team member to miss a foul shot loses.

Figure 48:
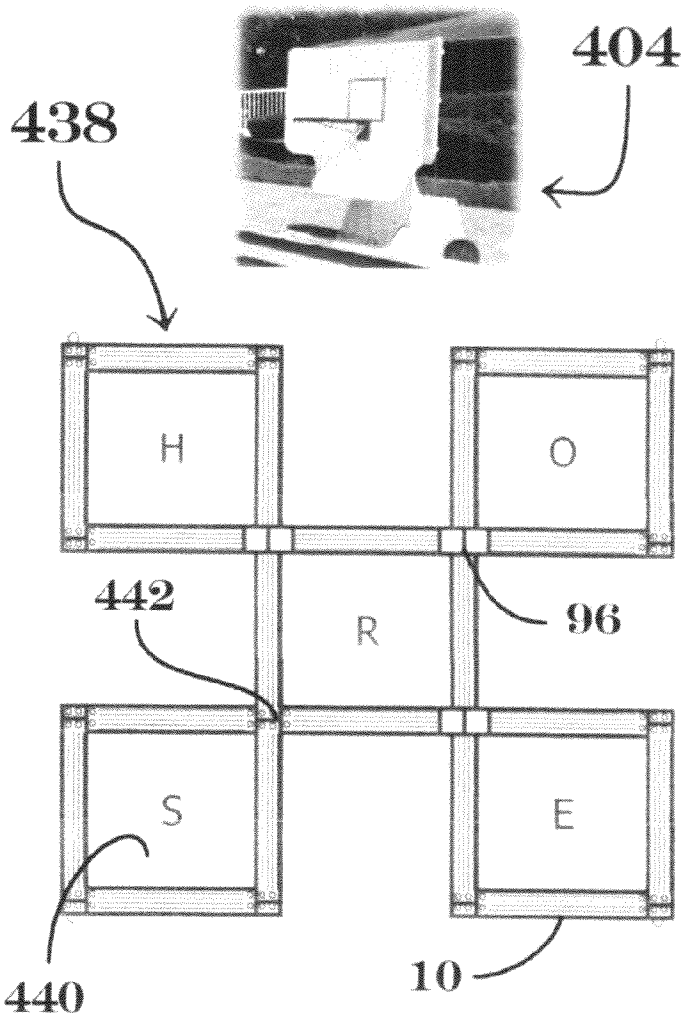

The HORSE pattern 438 in FIG. 48 is a modular floating pattern of boundaries and enclosed spaces which provides a simple, easy to assemble playing field that utilizes a commercially available swimming pool basketball stand 404 and a water basketball. Pattern 438 illustrates the variety of decorative designs afforded by the disclosed and claimed Olympic Game Kit. Pattern 438 comprises five partitioned pattern enclosures 440 including a central area and four satellite areas connected to the four corners 442 of said central area, delineating five shot positions joined only at the four intersecting corners 442. Inasmuch as this is a TOSS FROM game where the sole contact with the rigid bars 10 is to duck under them to emerge within the partitioned pattern enclosure, strengthening of the connections is usually not necessary. However, when needed, a pair of support clips 96 may be attached at the intersections 442 (only three pairs are shown for illustrative purposes).

H-O-R-S-E is the well-known, traditional shot elimination game where individual or team contestants attempt to eliminate the opposition by making them be the first to accumulate all of the letters to spell HORSE. Team play requires that a sequential order of players be established before the start of the game, and a coin toss or other selection method determines the player or team member that takes initial possession of the ball and gets to go first. The ball possession player chooses a position inside one of the partitioned pattern enclosures and attempts to shoot the basketball and successfully make the shot. If the possession player is unsuccessful and does not make the basket, an opposing player or team member takes possession of the ball, becomes the new possession player, chooses a position of his/her choice, and repeats the process. If a possession player is successful and makes his/her shot, the opposing player or team member must complete the same shot from inside of the same enclosure. If the opposing player misses the required shot, he/she is penalized with a sequential letter in HORSE. If the opposing player makes the possession player's shot, the original possession player or their team mate retains possession of the ball and starts the process over again. The first player or team to accumulate all of the letters to spell HORSE is eliminated.

The addition of modular floating configurations under and around a swimming pool basketball stand provides the necessary framework to create and organize these types of games. The buoyant pattern-making system provides an incomparable level of capability and versatility to create a multitude of defined formations for innovative group activities related to a swimming pool basketball stand, as compared to the options available to the same group with a swimming pool basketball stand that do not have access to a buoyant modular pattern-making system.

Another popular dry-land sport which has been adapted to pool play by commercially available accessories is horseshoes. Representative of the products available is the Pool Horseshoes Game □ by Seahorse Shoes, shown in FIG. 49, which includes an Astroturf floating stake 444 and two red and two yellow horseshoes. A sand anchor may be used underwater to stabilize the location of the floating stake. The Olympic Game Kit has tailored the game of horseshoes for activity directors by assembling a floating horseshoe court pattern 446 around the floating stake 444. Horseshoe court 446 comprises rigid bars 10, Hubs 90, and anchor Hubs 226 joined together as shown to define a horseshoe pit 448, a horseshoe court 450 between side lines 452, a pitchers' box 454 and a foul line 456. It is recommended that support clips 96 be attached at the ends of the cross-pieces, especially the foul line 456, as shown. The size of horseshoe court 446 can be extended or expanded to provide a multitude of variations to compensate for participants of various skill levels.

The rules of traditional horseshoes apply as practicable.

A game is divided into innings and each inning constitutes the pitching of two shoes by each contestant. Games can be played on a singles, doubles, or team basis. A regulation game consists of the pitching of fifty shoes in all contests. Choice of first pitch shall be determined by the toss of a coin or shoe; in successive games between the same players, the loser shall have the choice. The player to pitch first may pitch both shoes prior to the other player pitching or players may alternate pitches, at the discretion of the activity director. In delivering the shoe the pitcher must remain within the pitchers' box 454. It is preferable that the pitchers' box be situated in the shallow end of the pool, in order for the player to have a more firm footing. Placing it in the deep end, where players must tread while pitching, adds difficulty and interest to the contest. A player, when not pitching, must remain to the rear of the pitchers' box 454. In delivering a shoe, the pitcher must remain within the pitchers' box until the shoe has left his/her hand. A shoe landing outside the horseshoe court pattern 446 is a foul shoe. The usual rule holding a shoe foul for striking any boundary of the horseshoe court, in this instance any rigid bar 10, may or may not be enforced at the discretion of the activity director. A foul shoe shall not be scored or credited except in the score sheet column headed "shoes pitched." All fair shoes will be counted where they lay, even though they may have been hit by a foul or a fair shoe. No contestant shall approach the stake or be informed of the position of shoes prior to the completion of an inning.

Scoring shall be according to the traditional rules of horseshoes, where applicable. Any horseshoe that completely surrounds the stake is a "ringer." If there is some doubt as to whether or not a horseshoe qualifies as a ringer, a straight edge should be placed against the open end of the horseshoe; if the straight edge does not touch the stake, a ringer is scored. If a player achieves two ringers and the other player manages none, six points are scored. Should both players score two ringers each, they cancel each other out and no points are scored. If one player pitches two ringers, and the other player manages but one ringer, three points are scored. If both players throw a single ringer each, the ringers are cancelled out and the nearest of the other two horseshoes scores one point. If a single ringer has been scored that player wins three points plus an extra point if that player's other horseshoe is the closest of the remaining three. If no ringers are thrown, the nearest horseshoe to the stake counts one point. Shoes that lean against the stake are not counted nearer than any other shoe that touches the stake. It is optional as to whether a leaner or toucher is scored as two points. The first player to reach 21 points wins the game.

An alternative scoring system is simply to score three points for every ringer, two points for each horseshoe that lands on the Astroturf, and one point for a horseshoe that is floating in the horseshoe pit.

The availability of horseshoe court 446 opens the opportunity for activity directors to construct a set of horseshoe courts in a single swimming pool allowing the holding of horseshoe tournaments, either as part of daily activities or on special events week-ends. The introduction of adult sized game fields by the Olympic Game Kit provides activity directors with unheard of possibilities they never had before.

Another swimming pool game pattern made possible by the Olympic Game Kit is aquatic golf hole 458. As shown in FIG. 50, aquatic golf hole 458 is built around a commercially available floating golf accessory, such as Aqua Golf™, which includes a Velcro covered floating green and flag 460, a floating sand trap 462, and a driving mat 464. Mat 464 is placed on the pool's deck adjacent a pool's side, diagrammatically represented by line 466, so that the golfer can stand on solid ground while driving a Velcro-covered Whiffle ball 468 with a traditional or plastic golf club (not shown).

Modular Kit components are joined to assemble the out-of-bounds lines 470 around floating green 460 as shown in FIG. 50, using a combination of rigid bars 10, octagon Hubs 192, and anchor Hubs 226. The variety of golf hole contours using just these components is virtually infinite. Golf hole 458 is just one representative of the many which may be created by the activity director to simulate those found in actual golf courses. Each hole 458 includes a simulated tee box 472, a fairway 474, an approach 476 and a fringe 478 around the green. Sand trap 462 is shown placed in front of green 460; it or additional sand traps can obviously be placed in the fairway 474 at locations selected by a fiendish activity director. A set of driving mats 480, 482, and 484 are positioned pool-side beside hole 458 with driving mat 480 adjacent fairway 474, driving mat 482 adjacent approach 476, and driving mat 484 adjacent green 460. Sand anchors may be used to stabilize the golf green 460, sand trap 462, and the fairway formations.

Individual, multiple or team arrangements of players tee off from driving mat 464, attempting to land their ball on the green in less strokes than the opponents. The adventurous may choose to drive straight for the floating green 460. Others might play it safe and shoot for the fairway 474 or lay up in the approach 476. Balls that land outside of the floating fairway boundaries are considered out of play and the player whose ball lands out of bounds is assessed a penalty stroke and must hit again from the same tee box when his turn come up in rotation. Whenever the ball 468 lands in play, the player moves to the driving mat adjacent it. That is, if the ball is in fairway 474, the player's next shot is from driving mat 480; if the ball is in the approach 476, the player's next shot is from driving mat 482; and if the ball is on the fringe 478 or in the sand trap 462, the player's next shot is from driving mat 484. It is discretionary with the activity director whether or not a penalty stroke attaches to balls in the sand trap.

The determination of what constitutes the ball in the cup is optional. One manner of play has it that once a player hits a ball onto the green, he is considered to have sunk his putt, and the total number of strokes for that hole is totaled.

Another variation includes a pool side putting turf mat (not shown) that would require a player to putt a real golf ball into a putting practice cup to complete a hole. Once a Whiffle golf ball has landed on the floating green, the distance of the on-land putting turf putt would be approximately based on how close the Whiffle golf ball on the floating green is to the cup, such as, within one foot of the floating flag equals a 3 foot putting mat putt, within 2 foot of the flag equals a 4 foot putt and so on.

Depending upon the size of the pool and how much of it the activity director can afford to use at any one time, a plurality of golf holes of differing lengths and configurations can be constructed for tournament play.

Other Olympic Game Kit patterns can be drafted into use as golf game fields or simply for practice. For example, expanded key 432 (FIG. 47) can be assembled in a pool and used as a practice driving range game. If the partitioned areas are given numerical values, contests between golfers are possible. HORSE pattern 438 (FIG. 48) is especially challenging as contestants attempt to chip Whiffle golf balls into partitioned pattern enclosures 440 from a pool-side driving mat. Landing outside of a partitioned pattern enclosure is a miss and the next shot passes to the next player. It's obvious how other patterns can also be used as golfing targets with points or letters assigned to each enclosed target area.

Another set of adult-sized playing fields are patterns designed to guide swimmers from one place to another. FIGS. 51-54 are exemplary.

Figure 51:
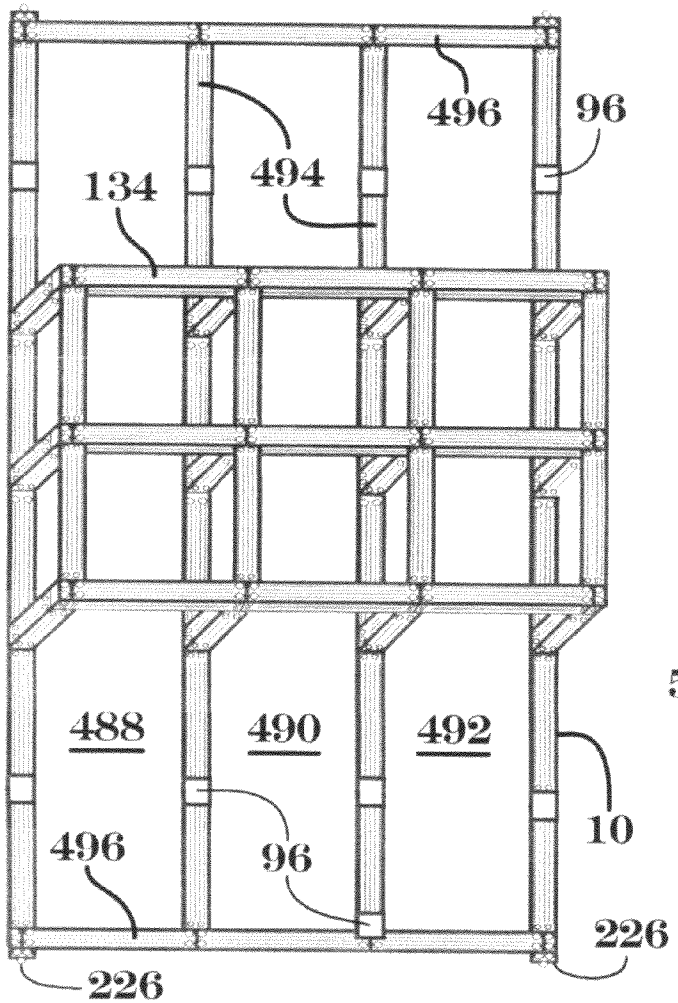

FIG. 51 diagrammatically illustrates a competition swim racing field 486. Three lanes, 488, 490 and 492, are shown, although more or less can easily be constructed using the Olympic Game Kit. Four linearly extending, parallel lane-defining rows 494 of rigid bars 10 are joined bar-to-bar with the opposite ends being closed by end rows 496. The relative spacings of parallel lane rows 494 are rigidly maintained by end rows 496 and by as complex a rigid superstructure 134 (FIG. 19) as is deemed necessary. Any additional lanes would each comprise the same combination of bars 10 joined together in a substantially identical fashion. Lane rows 494 are reinforced by support clips 96, and the entire configuration is anchored at anchor Hubs 226 either to weights on the side of the pool or to underwater weights (not shown).

Adding a row of three raised gates 112 (not shown) at the start and finish to replace the end rows 496 would usually be sufficient to maintain the relative spacings of the lane under most circumstances, but there could be a lot of wave action, when three adults race in three parallel swim lanes. In those cases, it is preferable to include a surface level, reinforcing bar at the beginning and end of all of the lanes as shown by end rows 496 in FIG. 51. Also, the elevated raised gates could present a psychological problem to someone diving into the pool while attempting to hit the open end of the lane. Placing the end rows adjacent the pool edge allows the swimmer to dive directly into the lane, much as current competitive swimmers do, where the lanes are delineated by ropes.

To start the race, the swimmers would either (1) dive into the lane from an elevated pool deck, (2) enter each lane from an under water starting position outside the beginning of the lane or via an underwater hoop, or (3) start the race from inside the lane, touching the end bar.

At the finish line, players either (1) touch the end bar or (2) swim under the end bar (via an underwater hoop if required) and surface outside of the swim lane.

The swim lanes could be organized for individual sprint races, team relay, raft or medley races where each lap is a different stroke. For relay races, each player lines up outside their lane and once the in-motion player touches the end bar or hands off the baton, the other teammate enters the lane from under water to avoid two players being in the same lane at the same time.

Traditional prior art lane separators are ropes anchored to fixtures at each end of the pool and caused to remain on the surface of the pool by means of floating balls threaded onto the lane separating ropes. This manner of establishing competitive swim lanes has many disadvantages including the necessity for ugly, potentially dangerous fixtures permanently attached to the edges of the pool, the distracting, and possibly constricting, momentary oscillatory movements of the balls and ropes due to wave motion, the difficulty of stringing the lanes in the first place, and the limitations imposed by only one pool position being available for the lanes. The inventive Olympic Game Kit provides lanes arranged into a rigid racing field 486 which is easy to assemble, easy to install in the pool, easily positioned anywhere in the pool, easily moved to any other position, and does not require permanently marring the pool in any way.

The lane separators are preferably of the double-row construction as shown in FIG. 36 as center partition 286. Center partition 286 is constructed as a pair 292-294 of single modular partition rows of rigid bars 10 connected bar-to-bar and positioned adjacent and parallel to each other. Double rows are stronger and hold their relative orientations better, but they also have another fringe benefit. Traditional competitive swim lanes are virtually indistinguishable from the sidelines (or on television). Commentators refer to the swimmers in lane three or lane five, requiring the viewers to count from one side of the pool or the other. Because rigid bars 10 come in a variety of colors, when the lanes are separated by center partitions 286, the single modular partitioned row nearest each lane 488-492 can constructed from a single color. Lanes can then be identified by their colors: "The two swimmers to watch are those in the green and blue lanes."

The swim lanes in FIG. 51 are simple, straight-through lanes. Patterns in which the unobstructed swim lanes are serpentine with many twists and turns may not be suitable for athletic competition, but where the pools are small or space is limited, such as on cruise ships or in most backyard pools, they provide activities and games which were not at all possible before, adding new interest and excitement to poolside parties. Such labyrinthine patterns are illustrated by the patterns shown in FIGS. 52-54.

Figure 52:
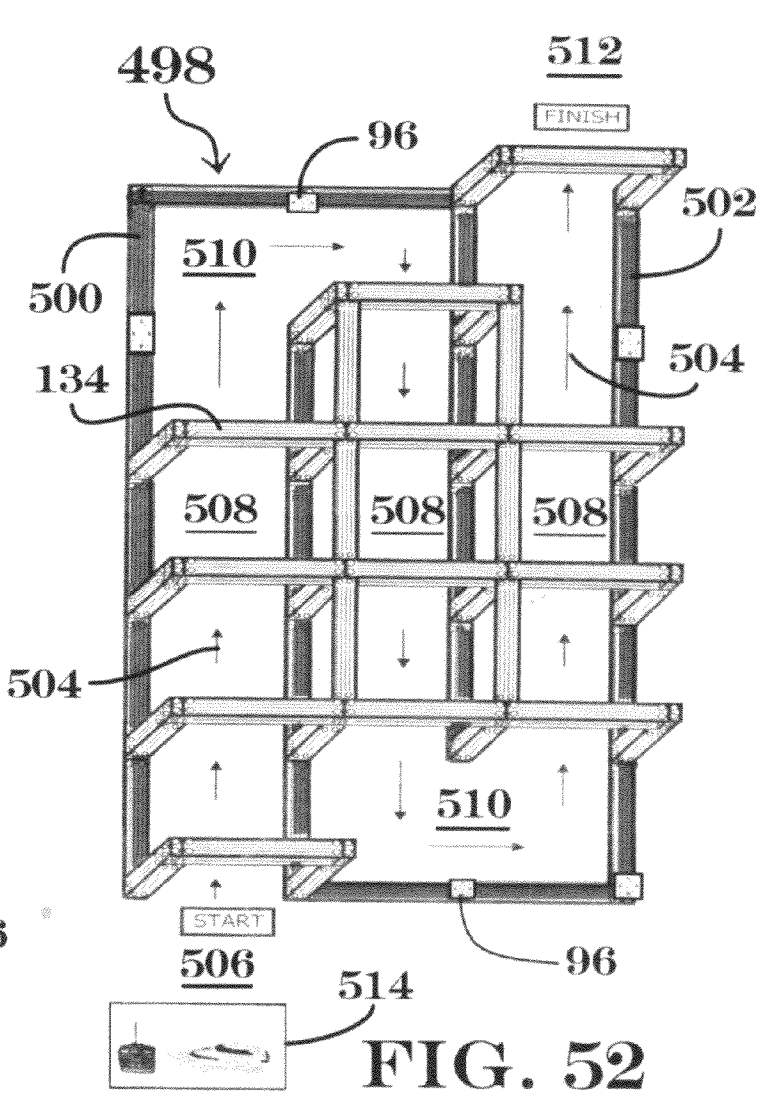

Turning to FIG. 52, the convoluted race course 498 is constructed of two substantially U-shaped segments 500 and 502 which are assembled separately and then joined together by a reinforcing superstructure 134. (When assembling portions of this particular pattern separately, it is not essential to ensure all indicators 62 face in the same direction, preferably upwardly as this is the easiest to confirm, since the posts 50 depending from the rigid bars forming superstructure 134 are being plugged into only side ports 52, but it is a good habit to get into.) Inasmuch as convoluted race course 498 is expected to receive considerable abuse during use, a generous number of support clips 96 are utilized as needed. An unobstructed swim path 504 (follow the arrows) snakes its way from "START" 506 through straightaways 508 and horseshoe turns 510 to "FINISH" 512.

Competitions using the convoluted race courses are best designed such that individual contestants or teams race against the clock in an attempt to complete the race course from the starting line to the finish line in the least amount of time. A timer is usually required.

Players can start a race in or out of the water, from a stationary position, or by jumping or diving into the course once the race is activated by a defined starting process, such as someone counting backwards from three. Players race through the course in an agreed upon order while taking note of the elapsed times. Scoring may be individual, i.e., the person with the fastest time is the winner, or team, e.g., the lowest total of the times of all team members indicates the winning team. It is recommended that the players be require to keep their heads above water when rounding corners to avoid cutting the corner short by going underneath the surface grid.

There are innumerable variations to a single timed pass through the course which an activity director may implement. The contest may involve multiple trips through the course by the same person, each trip using a different swim stroke. When multiple trips are involved, reversing the swim path with each alternating trip is in order. And, it is further recommended that multiple trip races limit the number of players in the course at a time to one.

Team relay events are always entertaining. They can require the customary passing of a baton, such as a noodle, to the next swimmer at the end of each passage of swim path, or the transfer of a pool raft or tube which must be pushed or pulled through the course. Raft or tube races may be with or without a passenger that must be navigated through the race course without the passenger falling off. As is becoming readily apparent, the variations are limited only by the imagination of the activity director.

For those who would rather not actually be in the pool, labyrinth race courses lends themselves to other types of races, such as those utilizing remote controlled boats, indicated by the boat icon 514. Swim lanes 486 (FIG. 51) also lend themselves to boat races, this time straight-forward sprints more easily controlled by children, who might have a problem directing a boat through convoluted course 498.

Figure 53:
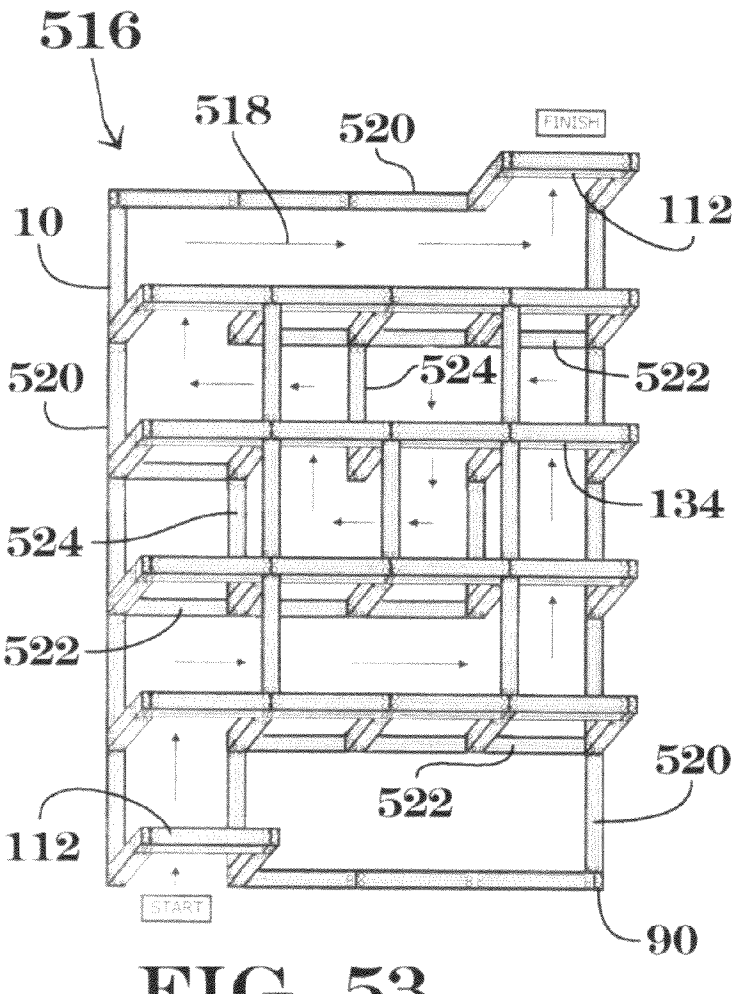

The complexity of race courses which are possible with the Olympic Game Kit is hinted at in FIG. 53. Using nothing more than rigid bars 10 and corner Hubs 90, a maze-like race course 516 is assembled rigidly defining an unobstructed, labyrinthian swim path 518. As shown, a floating perimeter 520 has surface level extensions 522 attached perpendicularly thereto. Some extensions are connected by a surface level barricade 524 which blocks a swimmer's path, forcing him/her to turn right or left to continue through open passages defined by an interconnected superstructure 134. Raised gates 112 stabilize the open entry and exit. To add further interest, curtains (not shown) can be hung along the side walls of path 518 to create closed tunnels hiding the next turn from the swimmer's view.

Figure 54:
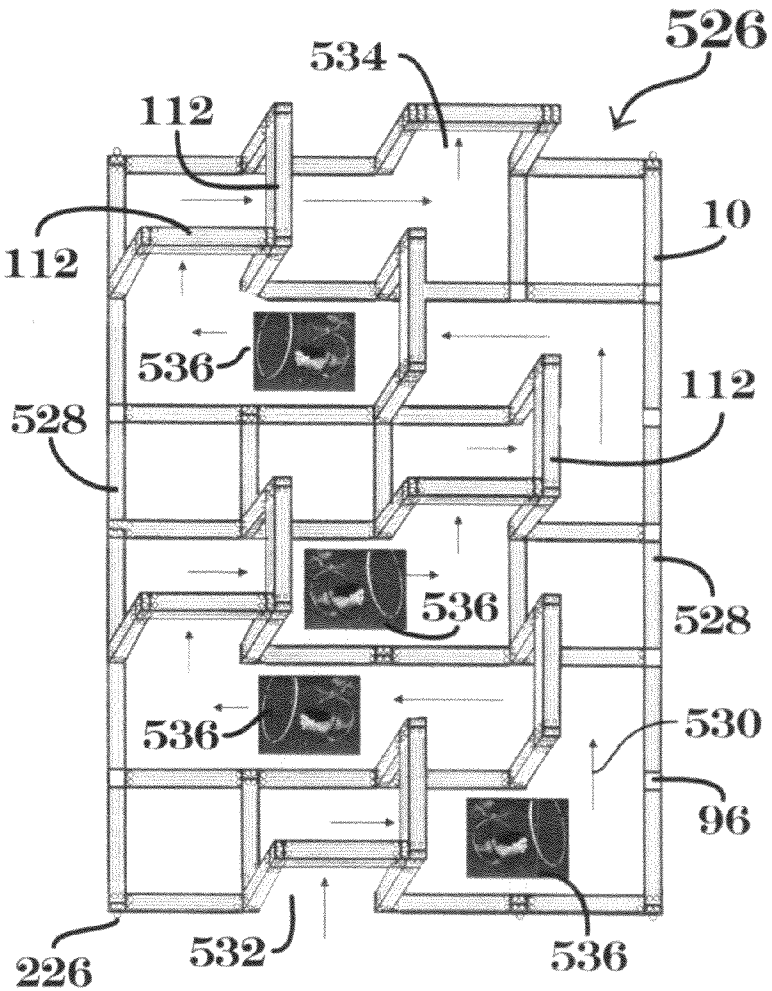

Another type of race course is shown in FIG. 54 as an obstacle course 526 set up for in-water play. Obstacle course 526 comprises a base 528 constructed of rigid bars 10 locked into its particular configuration by raised gates 112 and support clips 96. An unobstructed, tortuous swim path 530 is provided thereby from an entry 532 to an exit 534. Obstacle course 526 as a whole is securely positioned in the pool by means of the usual anchor Hubs 226. One type of "obstacle" comprises underwater hoops 536 which are submerged at selected locations in swim path 530.

Obstacle course contests can accommodate a minimum of 1 player and can accommodate multiple individual players, or team contests. As with the race lane games, the contest may be described as one trip through the course or may require multiple trips as an individual or team contestant. A starting and finish line are determined, and contest rules such as number of laps, swimming strokes, relay race hand-offs and defining the start of the race countdown are determined.

In a representative obstacle course such as the example shown in FIG. 54, a player may enter the course at one end or the other and move as quickly as possible through the maze-like pathway, swimming underwater through the designated underwater hoops. Players must keep their heads above the surface of the water when rounding corners through the course to ensure they are not going underneath the grid to cut the corners short. The player or team who completes the course in the least amount of time wins.

Any of the race course patterns shown in FIGS. 51-54 are suitable for retrieval races, but obstacle course 526 is particularly appropriate. In retrieval races, floating or sunken pieces are placed at particular locations in the pool by the activity director. Both floating and sunken pieces are commercially available in a variety of interesting designs. Contestants compete in locating and retrieving them.

Human sized board games are another type of activities made available by the Olympic Game Kit. The activity simulates a human scale version of a table top "board game" where human players actively assume the role of a conventional board game's "game pieces." The players enter the in-water formation, move from space to space, accomplish tasks, face consequences and physically participate in the motion and strategy of playing a human scale board game. Human scale board games promote inclusive participation which was not at all possible before, adding new interest and excitement to in-water and poolside activities.

Figure 55:
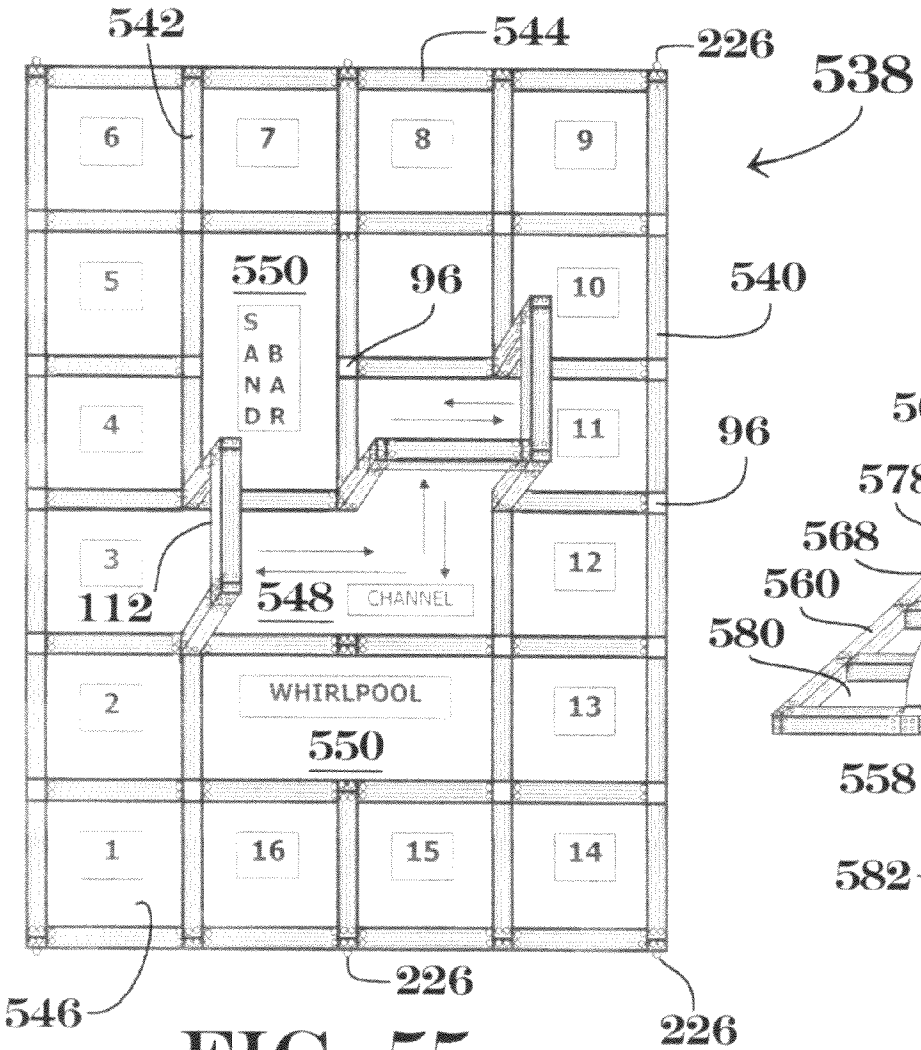
Figure 57:
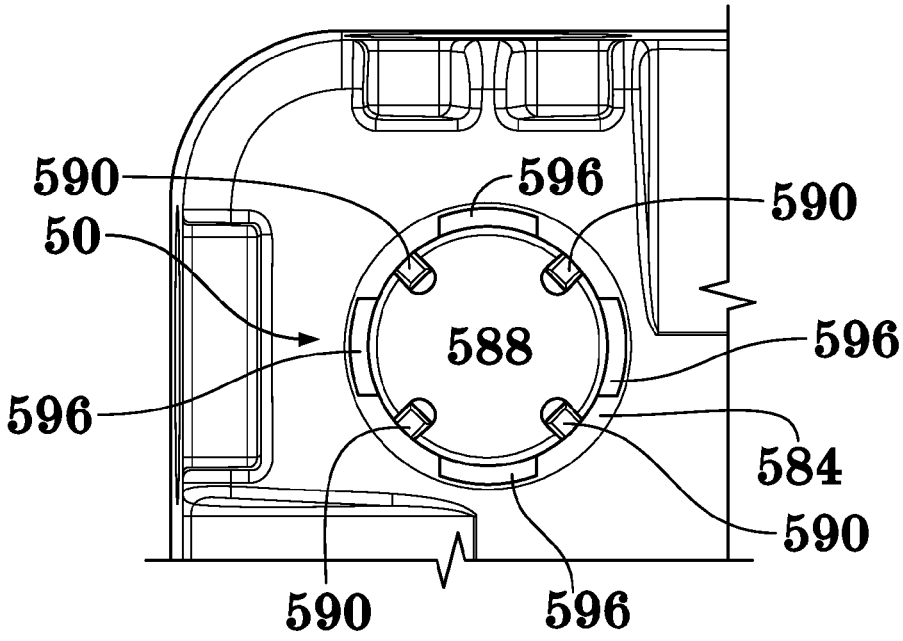
FIGS. 57-60 show different views of the preferred embodiment of the joinery, i.e., the posts and ports.
Figure 58:
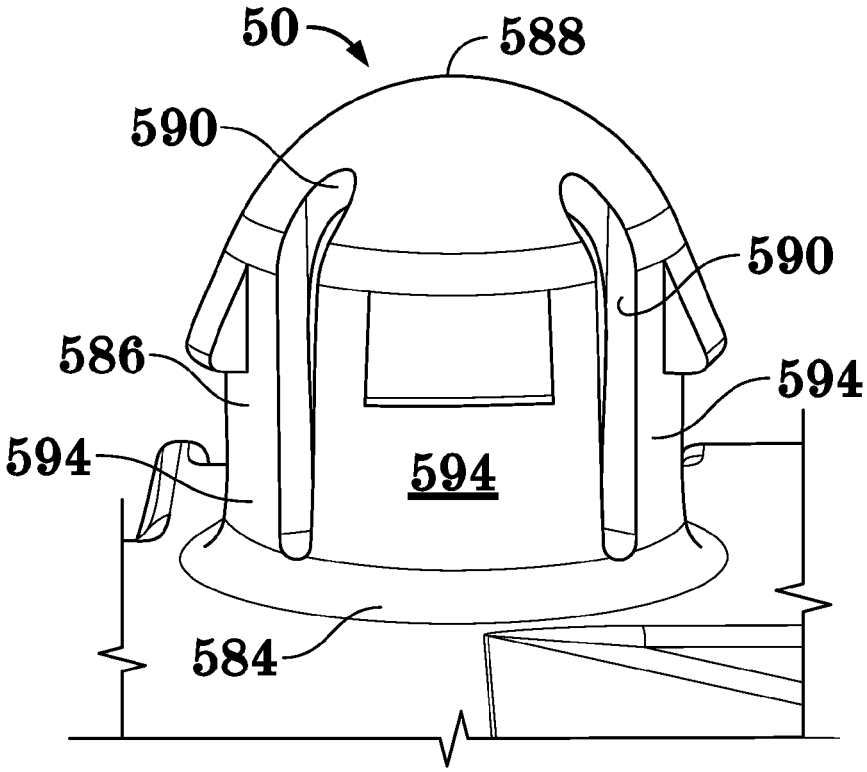

One such board game 538 is shown in FIG. 55. A periphery 540 is constructed in the usual manner. Vertical and horizontal rows 542 and 544, respectively, of rigid bars 10 enclose a plurality of partitioned zones internal of periphery 540. Immediately inside periphery 540 and following closely along its inside edge are distinct zones 546 designated One through Sixteen, which represent the stations of the game, analogous to the properties in Monopoly. An unobstructed swim channel 548 connects stations Three and Eleven. Raised gates 112 guide the swimmers through channel 548 as well as assist in stabilizing the game pattern 538. Two partitioned zones, designated "Sandbar" and "Whirlpool," are the home bases 550 of two competing teams. In anticipation of board game 538 being subject to rough play, due to multiple players moving quickly within it at the same time, support clips 96 and anchor Hubs 226 should be generously applied. The game board should be set up in shallow water so that all players will be able to stand up in each space.

Many games and variations thereof are possible with this one pattern.

Captain Dicer Two equal teams, designated as the Sand Bar team and the Whirlpool team, are selected comprising four or more players. One player from each team becomes their Captain Dicer and is positioned in his respective Home Base 550, Sand Bar or Whirlpool. Commercially available accessories such as foam or inflatable dice, a timer, a spinner, pool rafts, discs and tubes, weighted underwater hoops, or pool retrieval and tossing pieces may be incorporated into the game. At least two water dice are required, with each Captain Dicer taking one die with him into his Home Base.

A Starting Zone outside of Station One is selected, and the clockwise direction of rotation is affirmed. The two teams line up in the Starting Zone in any order decided upon by their Captain Dicer; the sequence of each player's turn is determined by the starting position and is maintained throughout the game. Players prepare to enter the game pattern one at a time. The first player positions himself in the Starting Zone so that he is ready to enter the formation once the game starts. The remaining players line up behind the first player, alternating players for each team, and move into the Starting Zone as soon as it becomes unoccupied.

To determine which team goes first, each Dicer flips his die in the air and the Dicer's team with the highest number goes first. The manner in which the die must flip is determined by the activity director. For example, the foam or inflatable die must rotate at least three times in the air, in a tumbling fashion, and land inside the space it was flipped in. If the die lands outside the space, or doesn't rotate as per the pre-designated agreement, that player or team loses their turn.

The game starts when the winning Dicer flips his die and announces the number of spaces shown on the landed die to his teammate which is first in line. The teammate enters the game board 538 and begins moving through the appropriate number of announced spaces. Motion through the sequentially partitioned spaces is described as submerge, surface and announce. As players move through the perimeter spaces, they must submerge and move under each floating partition, then fully elevate their head out of the water inside of each and every Station that they travel through. As they surface in each space, they must announce the appropriate number for that space as they count off their progress. They would then submerge again and repeat the process until they have reached the final space. Kiddy pools may accommodate players being lifted or stepping over partitions, versus going underwater, and dry land games would allow players to step over the partitions.

Once the first player has successfully completed his turn, their Captain Dicer announces it, and the opposing Captain Dicer then flips his die and announces the number of spaces to his teammate who is now in the first in line position. The opposing Dicer's enters the pattern and counts down his move.

When a player's turn ends within Station Three, that player announces Channel Call and must "cross the channel" with his head above water, bypassing Stations Four through Ten to be re-positioned in Station Eleven. On his next turn, he will proceed from this new position. Conversely, when a player lands in Station Eleven, he must announce Channel Call and "cross the channel" in the opposite direction, returning past Station Ten through Four to be re-positioned in Station Three. On his next turn he will proceed from this new position.

Play continues in this fashion, each human board piece making his move in rotation with the other players, until all contestants have completed a pre-announced number of trips around the perimeter to the starting point. Once a player has completed the pre-determined number of cycles, he must vacate the formation into the Starting Zone. The object of the game is to be the first team to vacate all of the team members (except for the Dicer) from game board 538.

Many variations in rules of play are possible and the selection of which to include is at the discretion of the activity director. Some suggested variants follow:

(1) Landing in an Occupied Station:

Occupied by the opponents: When a player's turn ends in a space occupied by one opponent, the opposing player must relocate and move in reverse two spaces. When a player's turn ends in a space occupied by two opponents, the player in motion continues to move forward one additional space.

Occupied by a teammate: When a player's turn ends in a space that is already occupied by one teammate, no relocation moves are activated and play continues normally. When a player's turn ends in a space that is already occupied by two or more teammates, the in-motion player continues to move one space forward. No more than two players can occupy one space. All relocation moves are announced by the player who occupies a space.

One of the options employs a commercially available floating disk placed in an arbitrarily chosen space as a "protection" piece. If a player lands in that space, he may take possession of the disk, carry it with him, and use it one time to protect himself from a player landing in his space and requiring him to retreat two spaces. If the occupying player with the protection piece chooses, he may make the player that landed in the space retreat the two spaces. Once a player uses a "protection" piece, it must be left in the space where it was used.

Relocation in Reverse into Opponent Occupied Spaces: When relocated players are moving through spaces in reverse, if they land in a space occupied by a teammate, their move is completed. If the relocation move lands them in a space occupied by one or more opponents, they must continue to move in reverse, space by space, until they land in an unoccupied or teammate occupied space.

Channel Relocation: No player can be relocated into Station Three or Station Eleven. When a relocated player is scheduled to land in either of these spaces, they will add one extra space to the number of spaces required by the relocation move.

Relocation in Reverse to Station One and Starting Zone: When a relocation move results in the relocated player moving in reverse past Station One, the relocated player will move out of the formation into the Starting Zone. When players are sent to the Starting Zone, they must make their way to the zone outside of the perimeter. Once a player has been returned to the Starting Zone, they will re-enter the formation at Station One and continue play, when it becomes their turn.

Relocation moves occur simultaneously with the action of normal moves. One relocation move may cause another relocation move to be activated, and all relocated players must complete their relocation moves before play continues.

Right of Way is always given to the forward moving players. All players who occupy a space in the path of the in-motion player must allow unrestricted access to the space and may be required to move to the outside of the their occupied space in the formation, until the in-motion player has completed his turn. The same is true for any relocation moves.

Multiple Players in the Channel: Players who are in the channel are not considered occupants and do not trigger relocation rules. When a player is located in the channel and is not in play, they must provide clearance and not interfere in any way with Channel activity. Some variations require that they vacate the channel until it is their turn.

(2) Channel Ferry:

In this variation, in order to cross the channel, the player must ride on a Channel Ferry, i.e., an inflatable raft, kickboard, tube or floating disc that may support a player, to maneuver through the channel. The Channel Ferry is originally docked at either Station Three or Station Eleven, at the call of the activity director, and remains there until a player rides it to the opposite end of the channel, where it is then docked. When a player lands in Station Three or Station Eleven, the single Channel Ferry must be anchored in the Channel space in which he lands to activate their Channel Call move. In the event that the Channel Ferry is anchored at their end of the channel when they land in the space, then they follow the standard rules of announcing Channel Call and crossing to the other end. In the event that the Channel Ferry is anchored at the opposite end of the channel, then they do not announce Channel Call, and simply remain in the space until their next turn, where they must continue to move forward through the Stations. Another option would require the player to return one space (which could cause a series of relocation moves). This option may cause more activity and does help keep the Channel as clear as possible.

A variation within Channel Ferry includes Dinghies and Dockers that can help teammates move around the game board more rapidly.

Dinghies: A limited number of Channel Dinghies (small floating foam pieces, dice or disks) are floated in the Channel when the game starts. To gather the Dinghies, a player who is maneuvering through the Channel may grab one Dinghy per Channel Move and hand it off to his team's Captain Dicer, who keeps it within his Home Base. When a player's Dicer has possession of a Dinghy, he can hand it off to a teammate who lands in Station Three when the Channel Ferry is at the opposite end, and the Dinghy allows that teammate to advance through the channel without use of the Channel Ferry. Once a Dinghy is used one time, it is removed from play.

Dockers: Similar to Dinghies, a limited number of Dockers (small floating foam pieces, dice or disks) are floated in the channel when the game starts. They are gathered in the same way, and can be used by the Dicer to hand off to a teammate who lands in Station Eleven. A Docker allows a teammate to remain in Station Eleven, without having to return through the Channel to Station Three. That player will simply continue to move forward on their next turn. If the Channel Ferry is positioned in Station Eleven, and a Docker is used to avoid a player having to return to Station Three, the opposing Dicer has the option to choose to leave the Channel Ferry in Station Eleven or relocate it to Station Three.

(3) Treasure Hunt:

A defined number of Treasure pieces can include floating pool toys, foam beams or discs floated inside of the channel or Sunken Treasure comprising weighted pool toys or bean bags that are placed underwater for retrieval. The channel can have weighted underwater hoops located therein that a player must swim through before he can gather treasure sunken treasure. When a player enters the Channel at Station Three or Station Eleven, they are allowed to gather one piece of treasure and physically lay it (they cannot throw it) inside their team's Treasure Cove (Home Base). The Channel Crossing player may be required to float a Cargo Raft through the Channel and to place the retrieved piece of treasure on the raft for transport to the Treasure Cove. The object of this game is to be the first team to collect and stash the most treasure into their teams Treasure Cove. This may be accomplished by the first team to gather all of the Treasure or just the majority of the defined number of Treasure pieces.

(4) Piracy:

The object is to capture either the opponents treasure or the opposing players themselves and imprison them until they are released, thereby slowing down the opponent's traversing around the game board in the required number of trips. The rules defining capturing an opposing player can be arbitrarily determined by the activity director to suit the group playing the game. Suggested rules include: A player is captured when landing in a corner space occupied by an opposing player, or when landing in a space occupied by two opponents, or when relocated backwards into a channel Station. Captured players are confined in their own team's Home Base. Captured players maintain their position in the team's rotation, but must lose their turn, if it arises while they are imprisoned.

The rules for releasing players from captivity are as arbitrary as for capturing them. For instance, these actions can cause the release of one or all of the captured teammates: The two Captain Dicers can agree to a prisoner exchange. The capture of an opponent landing in a corner space releases one captured teammate. When a captured player's turn comes up in the rotation, that player's Captain Dicer flips the die and the prisoner is released if he successfully calls the number. And, when a teammate lands in another single teammate occupied space, their longest held teammate is released. Released players may re-enter the formation via an unoccupied space, or a space occupied by no more than one teammate, but it must be a space that borders their Home Base (other than the Channel). If there are no spaces available, they are still considered released but must wait until their next turn in the rotation to reenter. If one team has all of it's players captured and imprisoned, the opposing team claims victory, and the Game is over.

(5) Fair Wind: A player crossing the channel must push a beach ball therethrough without using their hands.

Time Limits: At the activity director's option, time limits for each team to complete each player's turn can be agreed to and should be strictly enforced. The faster the pace of the game, the more exciting. Tight time limits should challenge the ability of players to complete submerge, surface and announce moves, and allow extra time for relocation moves. Tight time limits help keep players focused on the game activity and encourage them to be ready to go when it's their turn. Teammates are encouraged to communicate with each other, watch the opponent's moves for penalties, and also prepare their teammates for the next move. Tight timing is intended to keep players involved in rapid rotations and help minimize a group's down time. When large groups are involved, or groups with young children, it is optional to link two players together so that each move is accomplished in tandem.

Penalties: If a player has not correctly completed their turn within the allotted time, or if the player did not advance the correct number of spaces, or if a player did not correctly accomplish a designated task, or if a player causes a disconnection of one of the formation's components (Repair Penalty) during their turn, that player's turn is deleted (lost) and all players and props return to their original positions, and any formation repairs are made before play resumes.

A supervisor or the opposing Dicer is in charge of timers or countdowns, and is responsible to confirm the opponent's completion of each task to ensure that the task was accomplished correctly. Penalties must be called immediately by Dicers, and if a Dicer incorrectly calls a penalty their team loses a full turn. After a penalty is called, play stops until everything is repaired or returned to the proper position. Repositioning players and props, or making repairs after a penalty is not a timed event, but should be accomplished as quickly as possible. No players may start forward movement until play is resumed.

Depending on the age of the players, an activity director may assign a supervisor to assume the responsibility for all timing, rule oversight, coaching and refereeing duties.

Figure 56:
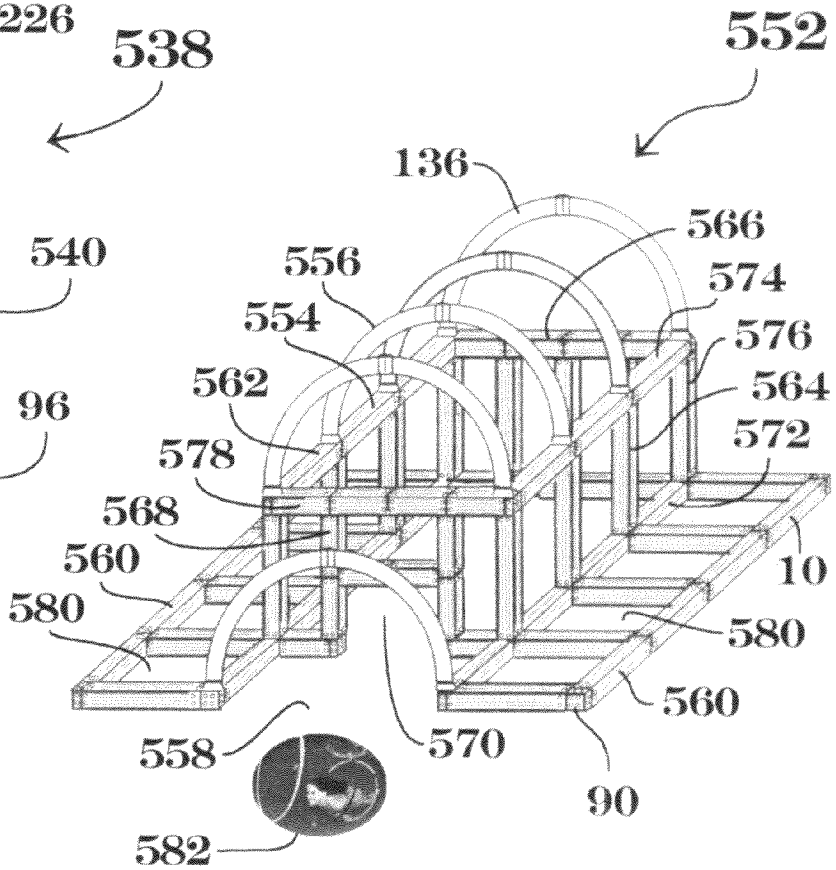
FIG. 56 shows a three-dimensional, open framework which simulates a playhouse or fort.

FIG. 56 shows a floating, open framed enclosure 552 constructed from rigid bars 10, corner Hubs 90 (or 92) and flexible bars 136. Enclosure 552 comprises four vertical wall sections 554 capped with an arched roof 556. An arch-covered, open rotunda 558 presents an attractive entranceway into the enclosure's interior. When intended for in-water use, enclosure 552 is stabilized by attaching two rectangular grids 560 on two or more sides of the enclosure's perimeter. Much like pontoons on a boat, they expand the foundation area and create a buoyant support platform. Water anchors may be tied off to anchor Hubs (not shown) to help stabilize the floating pattern, or the entire structure may be left free to be moved around the pool. Hub support clips (not shown) may also be used to aid in maintaining the connections, especially if it is anticipated that the formation that will have multiple players moving within it at the same time.

Although the framework enclosure simulates a playhouse or fort, on which children can lavish their imagination when at play, it has many other utilitarian functions, both in water and on dry land. For instance, parents or pre-school teachers may designate the open framed enclosure as a non-threatening time-out area. When used as a game field for aquatic games, it can be attached to many playing field formations (FIGS. 35-38) where it can be used as a safe zone, a penalty zone, a rest area, a finish area, a boat house, a treasure stash, or a team's home base. When associated with games requiring separate accessories (FIGS. 39-50), enclosure 552 doubles as a storage shed, keeping the accessories located close at hand and the pool neat and clean. The framework enclosure may also be used indoors as a fort, playhouse, or tunnel, or as an enclosure to interest and amuse domestic pets such as cats, dogs or birds.

Three in-pool activities are especially worthy of note: (1) The assembly of the enclosed framework may be used as an educational building activity to teach Olympic Game Kit construction techniques, e.g., how to make bar-to-bar connections and how to choose the most appropriate Hub connector for the task at hand. (2) Teams can compete in assembling the enclosure in Construction Races. And, (3) the enclosure can become a Treasure stash for a Treasure Hunt.

Inasmuch as the assembly steps applicable for teaching the construction of enclosure 552 are the same as those applicable in Construction Races, only one need be described. The difference between the two is that for teaching purposes only one set is needed to teach Olympic Game Kit assembly techniques, whereas a complete set of materials necessary for building the enclosure will be supplied to each team. They may include door and window openings, decorative nylon sheeting, sheet foam siding and flooring planks grooved to within friction fit tolerances so that they slip on over exposed framework, and may be described in step-by-step instructions. In Construction Races, the teams try to see who can construct it first. Penalties will be assessed for incorrect assembly.

The four exterior wall sections 554 of the FIG. 56 enclosure comprises two side walls 562 and 564, a back wall 566, and a front wall 568. They are configured similar to traditional stick-built framing methods commonly used in residential construction that are built with stud walls. The two side walls 562 and 564 and the back wall 566 are similarly constructed; front wall 568 includes a doorway 570, so its assembly is slightly different.

The assembly of the two side walls 562 and 564 begins with identical bottom and top plates, 572 and 574, respectively. Each of the bottom and top plates 572 and 574 use the same number of rigid foam bars 10 which are snapped together bar-to-bar; the exact number is dependent on the depth desired of enclosure 552. Each wall's bottom and top plates 572 and 574 are assembled when laying parallel, side by side; although the assembly can be performed pool-side, requiring the assembly be done in the pool adds an interesting challenge for the players. Half-cube Hubs 90 (or 92) are attached at both opposing ends of each bottom and top plate end walls to create a full cube connector (FIG. 10B) at each end of each plate. Depending upon the height desired for side walls, studs 576 are composed of anywhere from one to three rigid bars joined bar-to-bar. Studs 576 are then snap-fit to the full-cube formed by each bar-to-bar connection of adjacent rigid bars (FIG. 12A) and to the full-cube formed by the endcap to Hub connection at the ends of the plates (FIG. 13A). Back wall 566 is constructed the same as side walls 562-564 except for two differences: one, there are no Hubs attached to the ends of the top and bottom plates, and two, the studs are joined only to each bar-to-bar connection of adjacent rigid bars, leaving the ends cantilevered into space, i.e., unstudded. Front wall 568 is created with half-length rigid bars 578, as shown, to frame out the doorway 570. Half-length rigid bars can also be use to stud out window openings, when designed into the architecture, especially for out-of-water framework applications.

The fully assembled four wall sections are then stood up and positioned to be connected into each other. When the endcaps of the back and front walls 566-568 are snap-fit into the Hub-endcap combination at the ends of the side walls, the four walls share a corner post. Once the four wall sections are all connected, rectangular grids 560 are added, and the structure becomes self-supporting in water. A series of arches made up of flexible foam bars 136 can be added to create a simulated roof 556 over the enclosure 552 and the rotunda 558. The enclosure framework and arched roof can optionally be partially or fully covered with pre-cut nylon sheets or sheet foam sections that can be safety-pinned into the foam or attached to the plastic endcaps and Hubs with Velcro.

The size and layout of the framework enclosure may be modified, reduced or enlarged depending on the number of players and ability levels within a group. The following game description does not limit the applications for the invention to produce framework enclosures for human scale games and activities, or for domestic pet toys, accessories and furnishings.

Treasure Hall. Enclosure 552 is well-suited for a treasure hunt game.

Each of the partitioned spaces 580 in the rectangular grids 560 is designated a Buried Treasure Site, and one small floating "prize" is positioned therein, one per each site, four prizes per grid. Players are equally divided into two teams. The object of the game is to be the first team to successfully transfer all of a team's prizes into the Treasure Hall 552.

To begin, the teams gather in pre-selected Starting Zones on opposite sides of the enclosure, taking care that the Starting Zones are equidistant from their assigned grid. As in the board game (FIG. 55), players are arranged for sequential order of play. For safety reasons, alternating play is staggered between the teams so that only one player is moving through the formation at a time.

When on a Treasure Hunt, a player must swim underwater from the Starting Zone to any Buried Treasure Site, surface by bringing his head above water within the partitioned space, seize the prize, submerge again and swim underwater around the Treasure Hall 552, through the rotunda 558 and doorway 570, and surface within the Treasure Hall to deposit the prize. Preferably a weighted underwater hoop 582 is positioned in front of rotunda 558, in order to ensure players remain under water and not cut any corners while entering the Treasure Hall. Only one prize may be transferred with each player's turn.

Once a prize has been removed from a space and successfully transferred into the Treasure Hall, no other teammate may surface in that space but instead must move underwater past all spaces that no longer contain a prize. Once players have retrieved a prize for transfer, they are allowed to surface and gather breath in any space that still contains a prize. Once they reach the last available space with a prize, they must swim underwater and pass through the entry hoop and into the Treasure Hall to complete a successful transfer. If they either miss the hoop, surface before full entry or drop the prize in route, the prize is returned to its space and the player returns to the end of the line in their team's starting rotation.

Once a player has successfully transferred a prize, he may remain inside the Treasure Hall until the next teammate successfully transfers the next prize. The original teammate will then vacate the Treasure Hall and move outside of the formation so that there are never more than two teammates inside the Treasure Hall at the same time.

When queuing their players, teams may decide to inject some strategy. Each team's strongest swimmers may choose to go last and retrieve the prizes in the furtherest spaces from hoops 582, because there is more distance to travel underwater on the final leg of the transfers. Leaving the prizes in the closest spaces allows teammates to surface and gather a breath for the final underwater journey to and through the entry hoop and into the Treasure Hall.

Instead of the outcome of the game being decided by the first team to successfully transfer all of a team's prizes into the Treasure Hall 552, the team transferring all of their prizes in the least amount of time could be declared the winner.

Disconnection and Repair Penalties (the same as in the Captain Dicer Board Game) should be implemented and enforced to encourage players to minimize stress on the formation.

The extraordinary locking power of the posts and ports coupled with their ease in assembly and ease in tool-assisted disconnection is due to a combination of both the design of the posts and ports, i.e., their forms, and the material used for the endcaps (and thereby the posts and ports). Both are discussed below.

Referring to FIGS. 57-60, the details of the design of post 50 will be described first.

Figure 59:
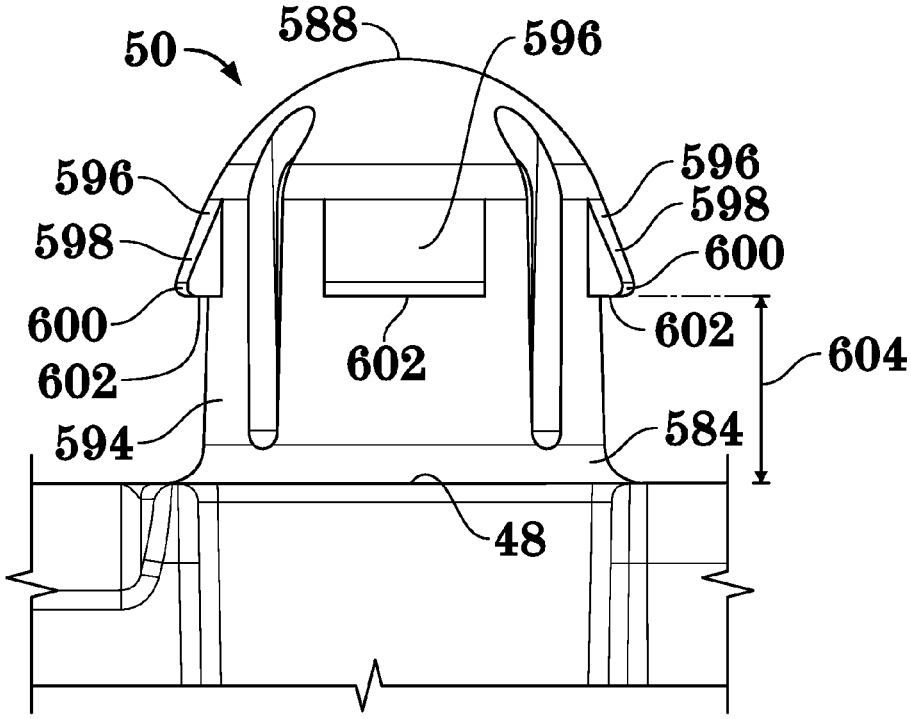
Figure 60:
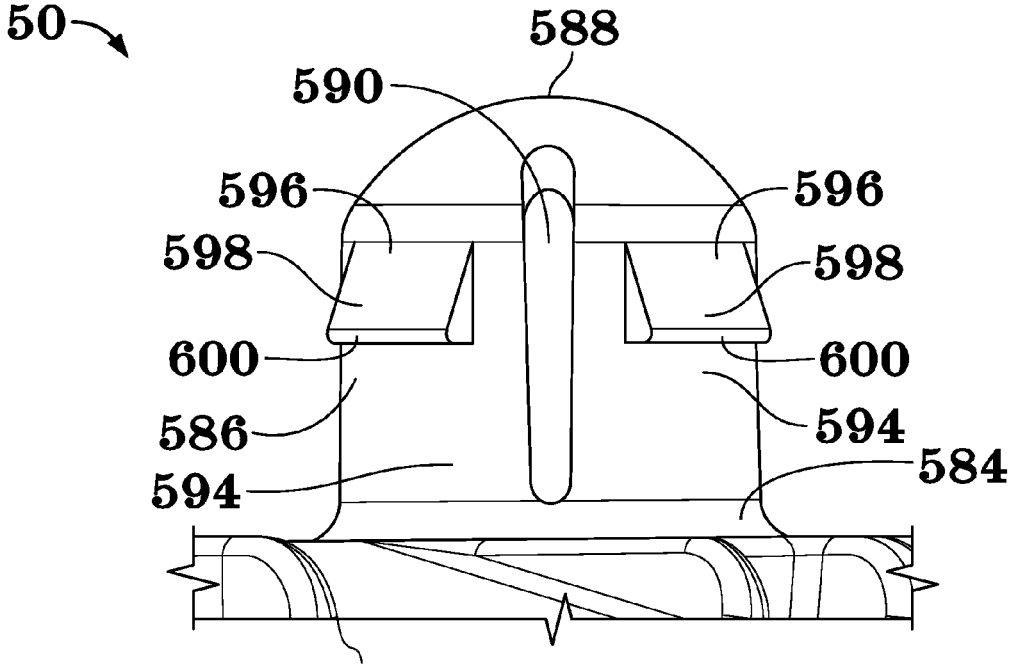

As shown in FIGS. 57-60, post 50 comprises an arcuately sloped base 584, an axially extending, substantially cylindrical body 586, and a closed, domed top 588, all integrally joined together. Four slots 590 extending from arcuately sloped base 584 into domed top 588 penetrate through body 586 to a hollow interior 592 (see FIG. 61). Slots 590 divide body 586 into four strips 594 individually joined at their ends with base 584 and domed top 588. Four sloped latches 596 are each molded as a part of each one of the four strips 594. Each latch 596 (FIGS. 59-60) has a linearly, outwardly sloping ramp 598 beginning tangentially just below the bottom of domed top 588 and terminating in a slightly rounded tip 600 and a flat step 602 (FIG. 59) which extends orthogonally back to strip 594. The dimensions of post 50 are selected such that the linear distance from butt-end 48 to flat step 602 is a precisely controlled predetermined height 604 (FIG. 59).

The general outline of post 50 is round from the arcuately sloped base 584 through the cylindrical body 586 to the domed top 588. The general shape of each cross-sectional slice is a circle, with the exception of the slices inclusive of the four sloped latches 596.

Figure 61:
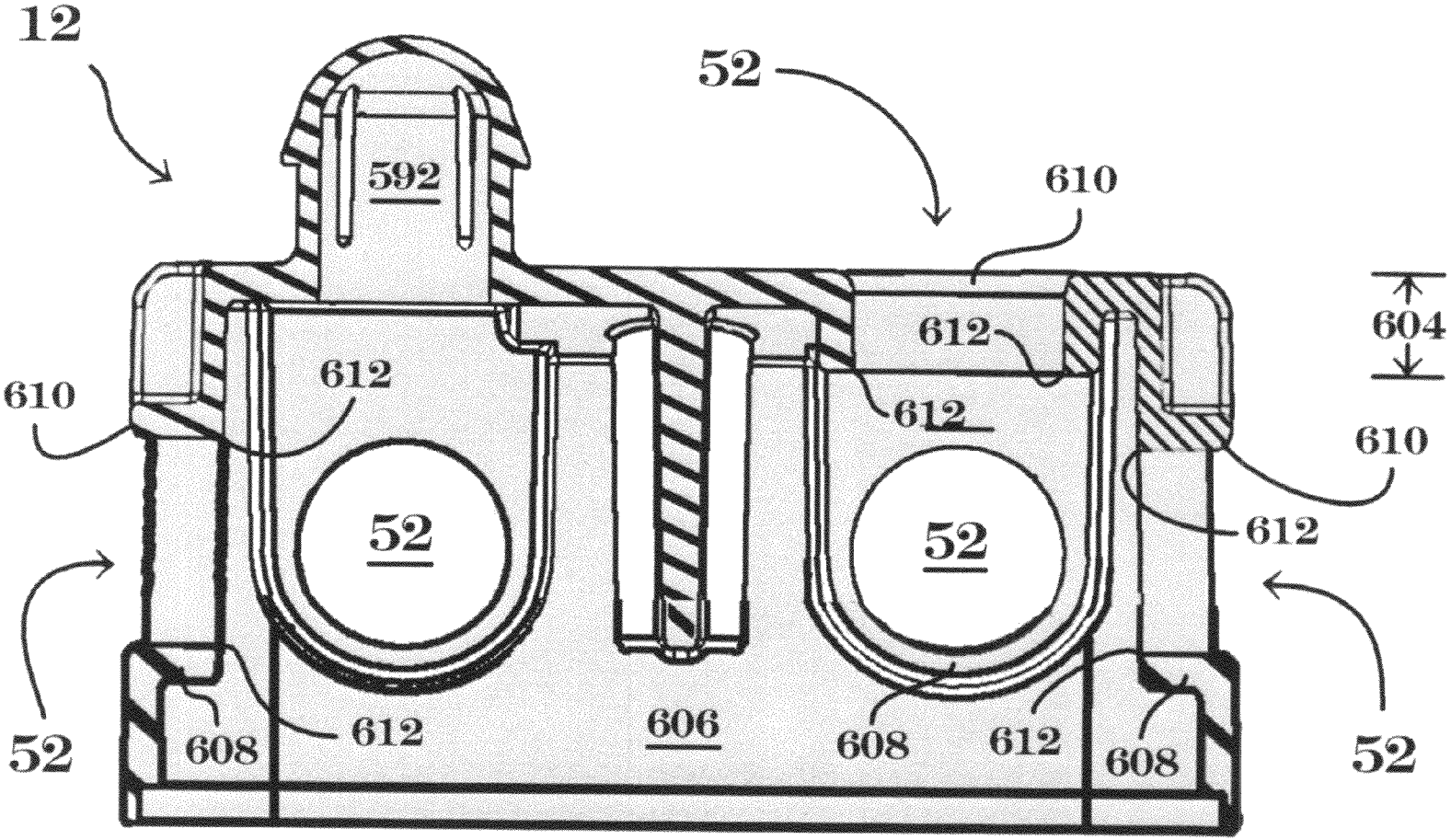
FIG. 61 is a cross-sectional view of the endcap showing details of the posts and ports.

FIG. 61 is an enlargement of the cross-section of the endcap 12 previously depicted in FIG. 10A. It shows the details of the form of four ports 52. Each port 52 is circular, as shown, whose diameter is equal to the diameter of an unflexed cylindrical body 586 of post 50. The internal wall 606 of endcap 12 is thickened in a portion 608 surrounding port 52, giving port 52 a predetermined depth 604, the same predetermined depth as the previously defined predetermined height 604 of the unflexed cylindrical body 586 of post 50 (FIG. 59). The external edge 610 of port 52 is arcuately shaped; the curvature of edge 610 is complementary to the arcuate curvature of arcuately sloped base 584 of post 50. The internal edge 612 of thickened portion 608 of port 52 is square, i.e., ninety degrees.

The dimensional value of predetermined depth 604 is a balance between enhancing the holding power of the post and port joinery and exposing posts 50 to the risk of being sheared by lateral forces, both of which are increased by increasing the depth 604. The relative dimensions as shown in the drawings achieve a good, workable balance.

Referring back to FIGS. 10A-10B and 11A-11B, the snap-fit operation of bar-to-bar joinery will be described.

The diagonally arranged post and port joinery features are designed for straight-in insertion to create a connection. Initially, two rigid bars 10 are linearly aligned on a flat surface with the indicators 62 all facing upwardly as shown in FIG. 11A. This positions the diagonally oriented posts 50 of each endcap 12 opposite the diagonally oriented ports 52 of the other endcap 12. The handler then simply grasps the rigid bars 10 and applies pressure linearly of their axes toward each other. As the domed top 588 of each post 50 enters its facing port 52, the curvature of the domed top 588 coacts with the curvature of the arcuately shaped external edge 610 of port 52 to center each post in its port. As the ramps 598 begin to enter port 52, the steepness of the ramps causes a uniformly slow and smooth elastic deformation of the four strips 594 which allows the rounded tips 600 of the latches 596 to flex inward enough to pass through the thickened portion 608 of wall 606 surrounding port 52. At the same time, strips 594 elongate, and because the domed top 588 will not allow them to separate, the diameter of the entire post 50 becomes smaller, which makes it even easier for the latches 596 to pass through the thickened portion 608 of wall 606 surrounding port 52. When the laterally extending flat step 602 of latch 596 travels beneath the square internal edge 612 of port 52, the ramps release and the strips 594 return to their original shape, causing the post to snap into engagement with the port's interior wall. During the insertion period, the wall of port 52 also flexes slightly outwardly, allowing easier insertion, but snaps back to its original shape when latch 586 clears the inner end 612 of port 51. There is a spring action caused by the post's dome and strips and by the resilient port which applies pressure between them to in effect lock them together. This is a very secure connection which enables the construction of the floating and three-dimensional formations and structures described above. Even more importantly, it allows the connectors to withstand the stresses of active play. The design of the posts results in the entire insertion process being easy to effect without the use of tools. At this time, arcuately sloped base 584 nests with the arcuately shaped external edge 612 of port 52; see FIG. 10B. The close tolerances between posts and ports guarantees a close engagement of the interacting parts, namely, arcuately sloped base 584 and arcuately shaped external edge 612, body 586 and thickened portion 608, and laterally extending flat step 602 and square internal edge 612. The four post to four port connection produces a very strong joint between the endcaps 12 of bar-to-bar rigid bars 10.

The disconnection operations have been adequately described, supra, relative to FIGS. 34A-34B. It is important to note, however, that tip 600 has been slightly rounded, in order to facilitate the disconnection of posts and ports, which it does without imparting damaging stresses on latch 596.

The materials used also contribute to the advantageous operations of the Olympic Game Kit.

Both the rigid bar beam 14 and the flexible beam 138 are made of a closed-cell polyethylene foam. Polyethylene foam is a durable, lightweight, resilient, closed-cell material available in a wide range of densities and colors. It is highly resistant to chemicals and moisture. It is easy to process and form and has high load bearing characteristics. It is easy to fabricate, has superb strength and tear resistance, has excellent flexibility, is impervious to mildew, mold, rot, and bacteria, is resistant to UV rays, water, swimming pool chemicals, solvents, and grease, is odorless, and has excellent buoyancy which makes it quite popular for flotation products and other water related applications. It is the traditional material used in the popular noodle, mentioned earlier. While a closed-cell polyethylene foam is the preferred material, other well known molded, extruded, cast or any other of current industry standard means to process foamed material, too numerous to mention specifically, and which will accomplish the obvious goals of the Olympic Game Kit, are included in the scope of the claimed inventive concepts.

The spine and plastic connector are preferably made of Acrylonitrile Butadiene Styrene (ABS). ABS possesses outstanding impact strength, high mechanical strength, a good resistance to bending, and has good dimensional stability, as reflected in its technical properties: a tensile strength of 4300 psi, a compression strength of 9000 psi, a flexural strength of 9200 psi, a coefficient of expansion of 0.000053, and a flexural modulus of 300000 psi. In addition, it is easily machined and can be ultrasonically bonded. With a specific density of 1.05, it does not detract significantly from the desideratum that the rigid bars have excellent flotation properties. Any known rigid or semi-rigid material which has properties reasonably close to these can obviously fulfill the needs of the spine and connector and are included within the scope of the claims.

The endcaps, and thereby the Hubs, are molded from polypropylene. Polypropylene is strong and long lasting. It has good tensile strength (4800 psi), and with its flexural modulus of 180,000 psi, it will withstand tearing while retaining its stiffness and flexibility. It also has good impact resistance with a Shore D hardness of 75. Both the stiffness and flexibility of the endcap are important operational characteristics. Good flexibility improves safety for players, as they will often come into contact with the posts which protrude into the playing field. At the same time, the posts have sufficient strength to resist breakage due to player impacts. Good flexibility dramatically improves the interlock lock of inserted connection by providing flex on the interior walls of the Port to stretch and hold a Post and maintain a connection. Good rigidity is important as it provides impact resistance. Polypropylene meets both of these requirements, as it provides a balance of enough rigidity and memory to maintain form and function for straight-in insert of the posts. Polypropylene is a good material for the Olympic Game Kit's intended aquatic environment, since it has a twenty-four hour water absorption rate of less than 0.01%, and with a specific gravity of 0.91, it will float. It is light weight with a density of 0.033 lb/cu/in. It is quite amenable to being colored as well, and with the addition of a UV inhibitor, it will hold its color well. While polypropylene is the preferred material, the production material could be any thermoformed compound with properties reasonably close to the properties of polypropylene which will accomplish the obvious goals of the Olympic Game Kit, and are included in the scope of the claimed inventive concepts.

The preferred material for disconnect tool 242 is a moldable thermoformed compound like polycarbonate that can also be blended with other thermoformed compounds and additives to increase resistance to UV and other environmental conditions caused by exterior use in chlorinated swimming pool water. Other known materials with similar properties can obviously be substituted therefor.

The simplest method means of attaching the plastic parts together is a straight-forward manual/mechanical assembly, e.g., screws. However, the use of (1) chemical bonding with adhesives or solvents, (2) ultrasonic and/or vibration welding, and (3) the addition of perimeter snap-fits is well within the claimed concepts.

The obvious alternate assembly methods are incorporating (1) snap-fits, (2) chemical bonding or (3) supplemental mechanical bonding.

Permanent or semi-permanent snap fits can be incorporated almost regardless of material and/or material composition.

Chemical bonding covers the range of using adhesives (glues/epoxies) to using solvents to actually melt the base material and join the parts as one. These sorts of connections are often time permanent and non-serviceable. The use of adhesives or solvents is also dependent on the base part material composition, both chemical and physical, resulting in some thermoformed plastics taking better to the use of bonding agents than others. This is due to the compatibility of the chemistry of the base material and bonding agent, or surface tension of the plastic which results in its ability to allow the bonding agent to permeate and adhere.

A common method of permanent mechanical attachment is ultrasonic welding. Again, this process works better with some material than others. This process "excites" the mating surfaces of the parts to be joined using high frequency vibration, causing a friction of sorts to occur which heats the plastic to a molten state and bonds the two surfaces as one.

It goes without saying, any of the alternate means of attachment could be used to replace the screws/mechanical fasteners to create more permanent part assemblies.

The Olympic Game Kit is a pattern making system for the construction of human scale playing fields that are assembled so that adult players can actively participate in games and contests that occur within the formation. In order to accomplish its general goals, the half-cube snap fit joinery has been specifically designed to simplify and streamline the process of repeated assembly and disassembly of the formations. The development of the half-cube joinery has standardized modular parts and reduced the number of different components needed so that the components are manageable for real life use, easy to handle and snap together, yet strong enough to hold together and withstand reasonable play, and still easy to break down. The joinery has advanced capabilities, but it's development was all about accomplishing function so that it produced a solution for a comprehensive human scale pattern making system that makes it fun and practical to organize group games and active play. The preferred dimensions of the components will place the inventions in that perspective.

The typical dimensions of the Olympic Game Kit are appropriate to its intended function, to be a pattern making kit for adult-sized activities. The preferred full length rigid foam bar has a cross-sectional dimension of approximately three and a half inches squared, is approximately forty-two inches long, and weighs about one and a half pounds. The preferred full length flexible bar has an outside diameter of approximately three inches and is approximately sixty inches long. Naturally, these dimensions have a certain amount of latitude and will still fulfill the goals of the Olympic Game Kit. Rigid bars can have a cross-sectional dimension of approximately three to four inches and be anywhere between three to four feet long. Flexible bars have a similar latitude. In addition, both bars are provided in different standard lengths, e.g., half-lengths, double lengths, and hypotenuse lengths to allow proportional construction of arcs and circles. So long as the basic criteria for proper functioning of the Olympic Game Kit are satisfied, namely, be sufficiently large to construct adult-sized playing fields and be sufficiently sturdy to maintain the integrity of the playing fields when under duress, any suitable dimensions are acceptable and within the scope of the appended claims.

The core components of the adult-sized Olympic Game Kit have been found to have additional applicability as a Mini-Kit for children, simply by reducing the size of each piece to approximately a one-quarter scale. The preferred dimensions for Mini-Kit rigid bars are about one inch square in cross-section and about six inches in length with additional lengths of half-length, double length and hypotenuse length bars also being provided. Flexible Mini-Kit bars are preferably about one inch in outside diameter and six, twelve, or eighteen inches long. Of course other dimensions suitable for children's use are included in the inventive concepts. Where size is not specified in the claims, those claims encompass the Mini-Kit within their purview and scope.

The Mini-Kit fulfills a need for a children's construction kit which can be used in the kiddy-pool at commercial swimming pools and in the bathtub at home. Although designed for use by children, it shares many of the desirable characteristics of the adult-sized Olympic Game Kit. (1) It floats. Children find it an entertaining addition to bath-time, even acting as an incentive to willingly engage in that activity. Its appeal in the kiddy-pool is obvious. Children learn to build structures which float, offering unlimited opportunity for creative entertainment. In addition, they can practice being "grown-ups" by building the patterns used by the adults in the big pool. (2) It is strong. The holding capacities of the post and port joinery are commensurate with the adult version. As a consequence, three-dimensional structures, such as the fort of FIG. 56 can be constructed by children in the bathtub, kiddy-pool, or the living room. Just because it floats does not mean it is limited to play in the water! (3) It is easy to assemble and easy to disassemble and store. Older children have enough strength and dexterity to snap-fit the posts and ports together; younger children may need adult assistance, but that is the way they learn. Adults will probably have to disassemble their creations, but there, too, as they grow older, children will take over this function, in the process learning how to handle tools. The Mini-Kit thereby provides a learning experience mixed in with the entertainment derived from colorful pieces capable of being joined together to create an infinitude of play things.

In its Miniature Kit form, as with any foam product for children's use, a warning to parents and supervisors that the foam presents a rip and tear choking hazard for children under 4 years of age should be prominently included. Proper supervision is always indicated when children utilize any of the Olympic Game Kit's components in any version.

During the development of the best endcap for the Olympic Game Kit, other embodiments were given consideration. Although they are not considered as good as the preferred embodiment described thus far, they do function sufficiently well to be included within the inventive concepts as disclosed and claimed. All of the endcaps are half-cubes and differ mainly in the post and port designs.

Figure 62:
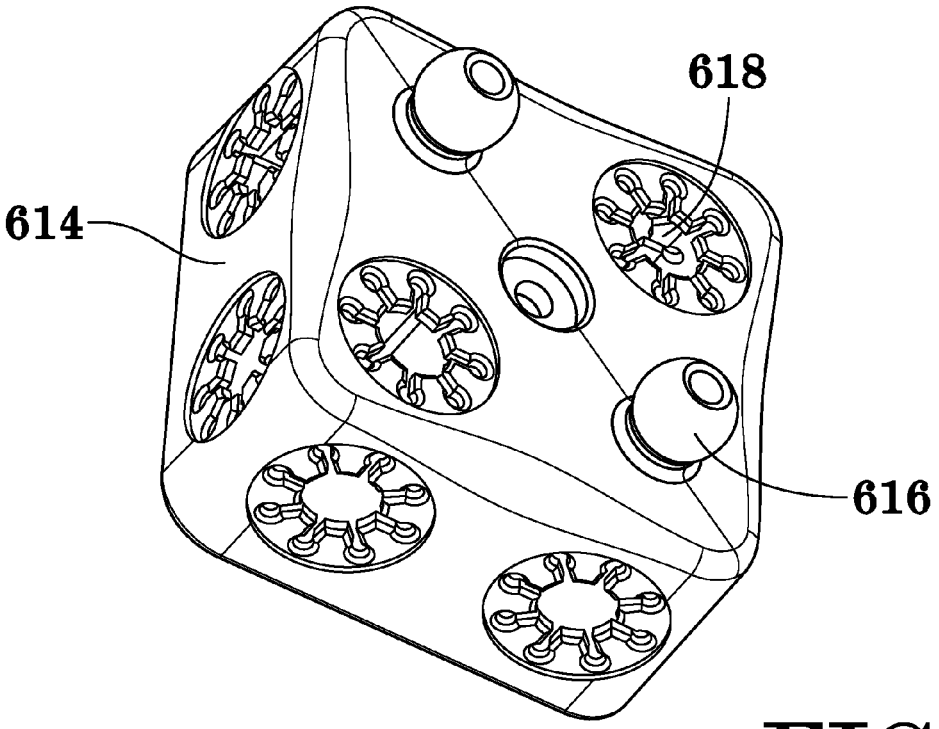
FIGS. 62-65 show alternative embodiments of posts and ports.

FIG. 62 shows an endcap 614 having bulbous posts 616 and a multi-fingered ports 618. Bulbous post 616 proved too resistant to insertion into circular ports, so ports 614 were designed with fingers whose ends defined a through aperture. The design was too complicated, the connection was not strong enough, the fingers were subject to being damaged, and the entire endcap lacked aesthetic appeal.

Figure 63:
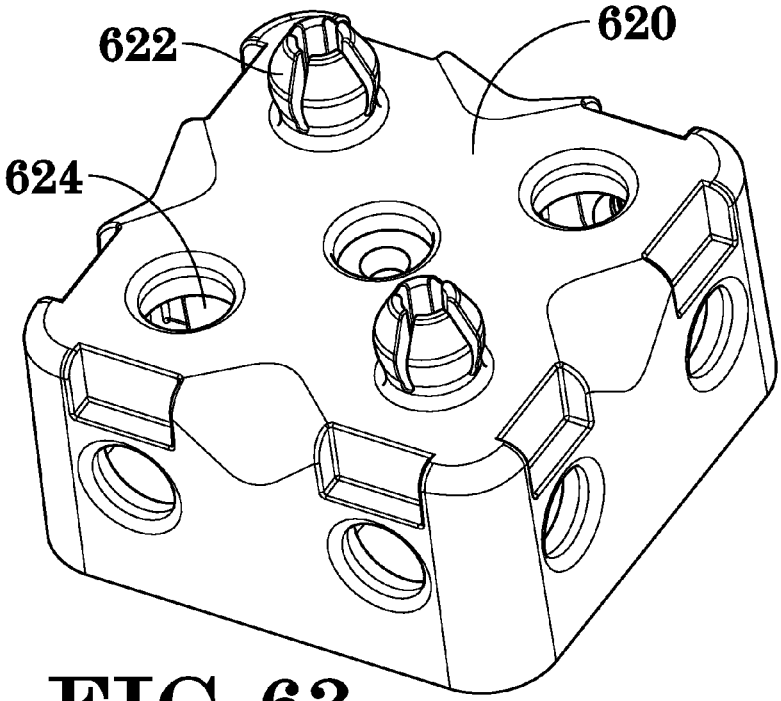

Endcap 620 shown in FIG. 63 embodies four-fingered posts 622 and circular ports 624. The four fingers of posts 622 are individually cantilevered from endcap 620 and as such flex independently. Endcap 620 functioned beautifully, but the open topped spikes gave an unsafe appearance, not so much a functional deficiency as a possible perceptual issue for users, and the four-fingers when exposed were not as resistant to impacts as was desired.

Figure 64:
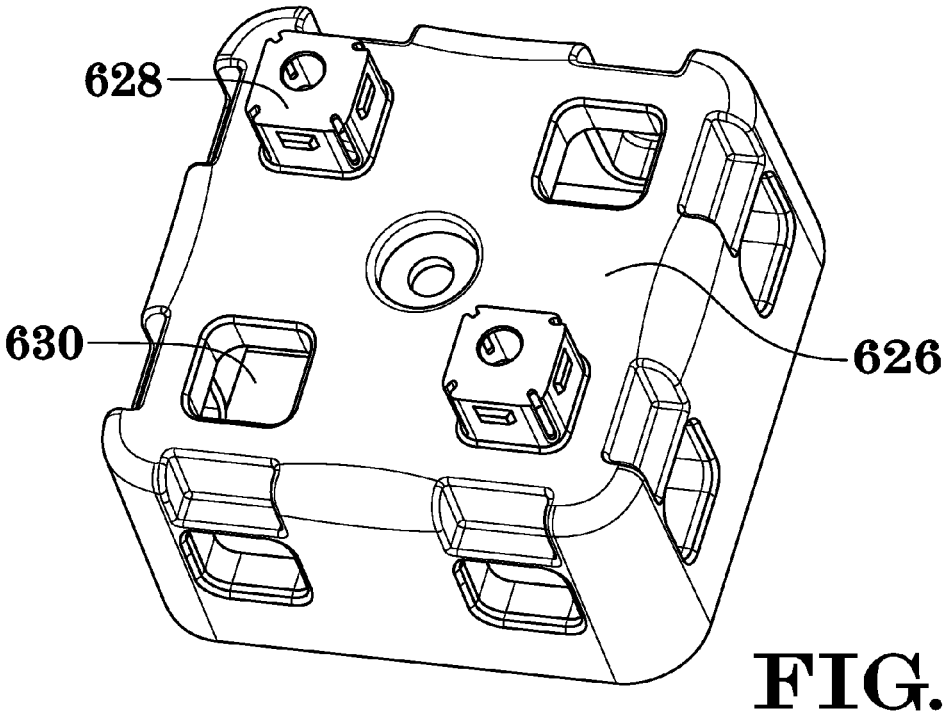

An endcap 626 (FIG. 64) with square posts 628 and square ports 630 functioned well, but it was not as strong as the design of posts 50 and ports 52 ultimately chosen for endcap 12.

Figure 65:
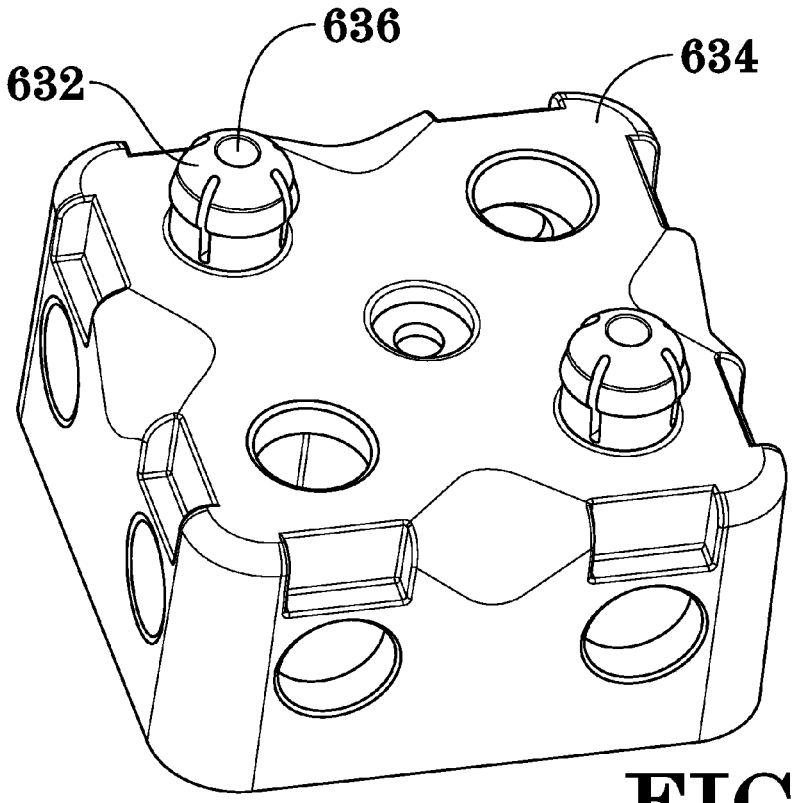

A round post 632 with latches as shown in FIG. 65 on endcap 634 was very close, but the opening 636 in the dome negatively altered the flexibility and deformations of the post, making insertion more difficult.

As can be seen in FIGS. 62-65, each of the posts have open tops, i.e., there is a hole facing upwardly therefrom. The circular opening resisted flexibility of the post when depressed axially, making it feel unduly hard. Closing the hole made the posts more flexible and thereby softer to the touch. It also improved the appearance of the preferred endcap.

CLAIMS

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is it intended to be limiting as to the scope of the invention in any way.

It is to be understood that the disclosure is by way of illustration only and that the scope of the invention is to be limited solely by the following claims:

I claim:

1. A rigid bar, said rigid bar being a modular component in a construction kit, said rigid bar comprising:

a beam of a closed-cell foam material having a generally square-shaped uniform cross-section and axially elongated along a length of said beam, wherein said beam comprises two opposing ends, and wherein said beam has a hollow circular channel positioned centrally along the length of the beam;

a rigid spine, wherein said rigid spine is hollow, and wherein said rigid spine is accommodated in and fixedly bonded to the hollow circular channel of the beam, wherein said rigid spine extends axially along the length of the beam;

a pair of endcaps permanently attached to said opposing ends of the beam, wherein each of the pair of endcaps comprises:

a half-cube shaped structure with four side walls configured to define the half-cube shape, wherein the half-cube shaped structure comprises a closed butt-end and an opposing open end proximal to the beam, and wherein each of the four side walls comprises a plurality of first ports adjacent to one another;

said closed butt-end, comprising:

a pair of posts positioned diagonally opposite to each other;

a pair of second ports positioned diagonally opposite to each other; and an aperture positioned centrally on the butt-end, and configured to receive a fastening element;

a plurality of rounded edges at an intersection of the butt-end and each of the four side walls;

a plurality of recesses positioned at said intersection of the butt-end and the four side walls, and wherein a pair of plurality of recesses defines ridges, wherein said ridges are positioned centrally in said pair of plurality of recesses;

a plurality of beveled slots positioned centrally at the intersection of the butt-end and each of the four side walls; and said opposing open end comprising an underside, comprising:

a dual-stepped peripheral recess, wherein the dual-stepped-peripheral recess is shaped and configured to receive the ends of the beam;

a receptacle positioned centrally within the opposing open end of the half-cube shaped structure, wherein the receptacle is configured to snugly receive the connector; and a plurality of strengthening ribs molded integrally with the four side walls and the butt-end, wherein the plurality of strengthening ribs accommodate a plurality of enlarged posts;

a connector disposed between the rigid spine and each of the pair of endcaps for fixedly attaching the pair of end caps to said rigid spine, wherein said rigid spine is closed at each end by the connector.

2. The rigid bar of claim 1 wherein said endcaps are molded as a one-piece, integral body from a plastic material.

3. The rigid bar of claim 2 wherein said plastic material is a thermoformed compound.

4. The rigid bar of claim 3 wherein said thermoformed compound is polypropylene.

5. The rigid bar of claim 1 wherein said endcaps comprises the pair of posts centered on one of the diagonals of said square face and said second ports being centered on the other of the diagonals of said square face, wherein said posts alternate with said second ports around the four corners of a simulated square, said simulated square being centrally located on said square face of said butt-end, and said posts and second ports being a distance which is equidistant from its neighboring second ports and posts, respectively, wherein said equidistant distance comprises a standard distance and said simulated square comprises a standard simulated square.

6. The rigid bar of claim 5 wherein:

each of said posts comprises:

an arcuately sloped base, said base merging smoothly with the top surface of said butt-end;

a substantially cylindrical body extending away from said butt-end surface;

a closed, domed top, all integrally joined together;

four slots extending from said arcuately sloped base into said domed top, said slots penetrating through said cylindrical body to a hollow interior, said slots dividing said body into four strips, each of which is individually joined at its ends with said base and said domed top;

four latches, each of said latches being molded as a part of one of said four strips, each latch having an outwardly sloping ramp beginning tangentially at the bottom of said domed top and terminating in a slightly rounded tip and a flat step, said step extending orthogonally from said rounded tip back to said strip; and the linear distance of said cylindrical body from the top of said butt-end surface to the underside of said step being a predetermined selected distance;

each of said second ports comprises:

a circular aperture through said butt-end, the diameter of said aperture being equal to the diameter of said cylindrical body of said post;

the external edge of said circular aperture being arcuately shaped complementary to said arcuately sloped base of said post;

the depth of said circular aperture being the same as said predetermined selected distance of said cylindrical body; and the internal edge of said circular aperture being square.

7. The rigid bar of claim 6, wherein each of said four side walls comprises said first ports, said first ports being spaced apart by a standard distance.

8. The rigid bar of claim 7, wherein said beam of a closed-cell foam material is of a relatively soft plastic material which has a smooth, tough outer skin.

9. The rigid bar of claim 8 wherein said beam plastic material is polyethylene.

10. The rigid bar of claim 1, wherein said rigid spine is closed at each end by a connector, and said endcaps are permanently attached to said connectors.

11. The rigid bar of claim 10 wherein said spine and said connector are made of acrylonitrile butadiene styrene (ABS).

12. The rigid bar of claim 10, wherein said connectors are permanently attached to said spine and said endcaps are permanently attached to said connectors.

13. The rigid bar of claim 7 wherein two endcaps facing each other interlock with each other, and wherein said interlocking of said facing endcaps comprises a linear, bar-to-bar connection between two rigid bars.

14. The rigid bar of claim 13 wherein said bar-to-bar connection comprises a four-post joint wherein four posts are snap-fit into four second ports.

15. The rigid bar of claim 13 wherein said bar-to-bar connection juxtaposes four sets of coplanar side walls of said two interlocked endcaps, each of said four sets of coplanar side walls presenting four first ports orthogonally away from said linear bar-to-bar connection, each of said four first ports being spaced apart from its nearest neighboring port by the same distance as said standard distance, and each of said four first ports being centered on the corners of said standard simulated square.

16. The rigid bar of claim 13 wherein said square face has a disconnect slot centrally located on each of its four sides, said disconnect slot having a portion opening into each of the side walls.

17. The rigid bar of claim 16 wherein said disconnect slot tapers from being flush with said surface of said butt-end to a maximum at said portion opening into each of the side walls, so that when two bars are connected bar-to-bar, said disconnect slot forms a funnel-shaped slot leading into the space between said interlocked endcaps.

18. The rigid bar of claim 17 wherein said interlocked endcaps are disconnected by inserting a disconnect tool into said disconnect slot and prying said interlocked endcaps apart.

19. The rigid bar of claim 7 further comprising indicators on two of said four side walls said two side walls being on opposite sides of said endcap, and said two side walls being oriented relative to said posts such that when one of said indicators faces upwardly and said endcaps is viewed end-on, said endcaps has a post at the 10:30 position.

20. The rigid bar of claim 19 wherein each of said two side walls includes two indicators, each of said indicators being adjacent one corner of its side and being aligned with a post and one of said first port and said second port of said endcap.

21. The rigid bar of claim 1, wherein each of said ridges in the sidewall of said endcap are configured to act as a visual marker located within said recess.

22. The rigid bar of claim 21 wherein said marker is both visual and tactual.

23. The rigid bar of claim 21 wherein the other two of said four side walls include similarly located recesses but with no marker therein.

24. A flexible bar, said flexible bar being a modular component in a construction kit, said flexible bar comprising:

a beam:

said beam having an elongated length, said elongated length having an axis along said length; and said beam having a hollow channel axially therethrough, said beam having a circular cross-sectional shape, said circular cross-sectional shape being uniform along said length, and said beam being made from a closed-cell foam material;

a pair of endcaps, one of said endcaps being attached to each end of said beam, each of said endcaps comprising an adaptor and a collar;

said adaptor comprising a butt-end and a shaft;

said butt-end comprising a circular plate having a central axis;

a joinery integrally molded on said circular plate and extending axially away from said butt-end, said joinery comprising an array of posts and ports arranged on said butt-end, wherein all of said posts are substantially identical and all of said ports are substantially identical, wherein said array of posts and ports comprises two posts alternating with two second ports around the four corners of a simulated square, said posts being centered on one of the diagonals of said simulated square and said second ports being centered on the other of the diagonals of said simulated square, said simulated square being centrally located on said circular plate of said butt-end, wherein each of said posts and second ports being spaced apart a fixed, standard distance which is equidistant from its neighboring second ports and posts, respectively;

each of said posts comprises:

an arcuately sloped base, said base merging smoothly with the top surface of said butt-end;

a substantially cylindrical body extending away from said butt-end surface;

a closed, domed top, all integrally joined together;

four slots extending from said arcuately sloped base into said domed top, said slots penetrating through said cylindrical body to a hollow interior, said slots dividing said body into four strips, each of which is individually joined at its ends with said base and said domed top;

four latches, each of said latches being molded as a part of one of said four strips, each latch having an outwardly sloping ramp beginning tangentially at the bottom of said domed top and terminating in a slightly rounded tip and a flat step, said step extending orthogonally from said rounded tip back to said strip; and the linear distance of said cylindrical body from the top of said butt-end surface to the underside of said step being a predetermined selected distance;

each of said second ports comprises:

a circular aperture through said butt-end, the diameter of said aperture being equal to the diameter of said cylindrical body of said post;

the external edge of said circular aperture being arcuately shaped complementary to said arcuately sloped base of said post;

the depth of said circular aperture being the same as said predetermined selected distance of said cylindrical body; and the internal edge of said circular aperture being square;

said shaft being elongated and having an axis;

said shaft being adapted to be fixedly attached within said hollow channel;

said butt-end and said shaft being integrally molded with said circular plate having a central axis and said elongated shaft having an axis being coaxial; and said collar comprising a hollow, cylindrical shell having an axis, and said collar being permanently attached to said adaptor with the axes of said shaft and of said collar being coaxial, said cylindrical shell has a contour that provides a hand-hold where the collar mates to the beam, said hand-hold enables grasping of the beam and force insert of the posts into the ports; and wherein a combination of said beam and endcaps being capable of floating in water.

25. The flexible bar of claim 24, wherein said endcaps are molded as a one-piece, integral body from a plastic material.

26. The flexible bar of claim 25 wherein said plastic material is a thermoformed compound.

27. The flexible bar of claim 26 wherein said thermoformed compound is polypropylene.

28. The flexible bar of claim 24, further comprising two indicators on said collar, said two indicators being located one hundred eighty degrees apart, and said two indicators being located relative to said posts such that when one of said indicators faces upwardly and said array is viewed end-on, said array has a post at the 10:30 position.

29. The flexible bar of claim 28 further comprising four disconnect slots equally spaced around the perimeter of said butt-end, two of said disconnect slots being centered, respectively, on said two indicators.

30. The flexible bar of claim 29, wherein said joinery is capable of firmly but removably connecting two bars linearly bar-to-bar due to one butt-end being removably connected with another butt-end, and when connected bar-to-bar, said disconnect slots face each other to form a funnel-shaped slot leading into the space between said connected butt-ends.

31. The flexible bar of claim 30 wherein said connected butt-end are disconnected by inserting a disconnect tool into said funnel-shape slot and prying said connected butt-ends apart.

32. The flexible bar of claim 24, wherein said shaft has an outside diameter substantially equal to the internal diameter of said hollow channel, and said shaft has fishhook-like barbs molded onto its free end, wherein said barbs smoothly enter said hollow channel but resist withdrawal therefrom.

33. The flexible bar of claim 32 wherein said shaft is adhesively fixed within said hollow channel.

34. The flexible bar of claim 29 wherein said closed-cell foam material has a smooth, tough outer skin.

35. The flexible bar of claim 34 wherein said closed-cell foam material is polyethylene.

36. A hub, said hub being a modular component in a construction kit, comprising:

a half-cube shaped structure comprising a butt-end, four side walls depending from said butt-end, wherein each of the four side walls comprises a plurality of first ports adjacent to one another to provide connectivity on all four exposed sides of the hub, wherein each of said first ports is configured to receive a mating post;

said butt-end having a substantially square face;

each of said four side walls having a length equal to the width of said square face and a width equal to one-half the width of said square face;

a joinery integrally formed with said square face, said joinery comprising an array of posts and second ports arranged on said square face, said array comprising two posts and two second ports, said posts being centered on one of the diagonals of said square face and said second ports being centered on the other of the diagonals of said square face, said posts alternating with said second ports around the four corners of a simulated square, said simulated square being centrally located on said butt-end, and each of said posts and second ports being separated from its neighboring second ports and posts, respectively, by a standard fixed distance, wherein said simulated square comprises a standard simulated square and said array comprises a standard array, wherein all of said posts are substantially identical and all of said second ports are substantially identical;

each of said posts comprises:

an arcuately sloped base, said base merging smoothly with said butt-end;

an axially extending, substantially cylindrical body;

a closed, domed top, all integrally joined together;

four slots extending from said arcuately sloped base into said domed top, said slots penetrating through said cylindrical body to a hollow interior, said slots dividing said body into four strips, each of which is individually joined at its ends with said base and said domed top;

four latches, each of said latches being molded as a part of a respective one of said four strips, each latch having a linearly, outwardly sloping ramp beginning tangentially at the bottom of said domed top and terminating in a slightly rounded tip and a flat step, said step extending from said rounded tip orthogonally back to said strip; and the linear distance of said cylindrical body from the top of said butt-end to the underside of said step being a predetermined selected distance:

each of said second ports comprises:

a circular aperture through said butt-end, the diameter of said aperture being equal to the diameter of said cylindrical body;

the external edge of said circular aperture being arcuately shaped complementary to said arcuately sloped base of said post;

the depth of said circular aperture being the same as said predetermined selected distance of said cylindrical body; and the internal edge of said circular aperture being square;

a cover plate permanently attached to said butt-end of said half-cube shaped structure, wherein said cover plate has four symmetrically placed ports, said four symmetrically placed ports being located at the corners of a standard simulated square, said standard simulated square being centrally located on said cover plate, each of said ports being separated from its neighboring port by a standard fixed distance.

37. The hub of claim 36, wherein each of said four side walls has two first ports, said first ports being spaced apart by said standard distance.

38. The hub of claim 37 wherein said half-cube shaped structure is molded as a one-piece, integral body from a plastic material.

39. The hub of claim 38 wherein said plastic material is a thermoformed compound.

40. The hub of claim 39 wherein said thermoformed compound is polypropylene.

41. The hub of claim 37 wherein said cover plate is fixedly attached to said half-cube shaped structure by fastening element and said cover plate has countersunk, through holes for receiving said fastening element.

42. The hub of claim 41 wherein said hub cover plate is integrally molded as one-piece from polypropylene.

43. The hub of claim 37 further comprising indicators on two of said four side walls, said two side walls being on opposite sides of said body, and said two side walls being oriented relative to said posts such that when one of said indicators faces upwardly and said array is viewed end-on, said array has a post at the 10:30 position.

44. The hub of claim 43 wherein each of said two side walls includes a recess in the side wall of said body and said indicator is a visual marker located within said recess.

45. The hub of claim 44 wherein said marker is both visual and tactual.

46. The hub of claim 43 wherein each of the other two of said four sides includes a recess with no marker therein.

47. The hub of claim 43 wherein each of said two side walls includes two indicators, each of said indicators being adjacent the corners of said two side walls and in line with a post and one of said first port and said second port.

48. The hub of claim 47 wherein said square face has a disconnect slot centrally located on each of its four sides, said disconnect slot having a portion opening into each of said four side walls.

49. The hub of claim 48 wherein said disconnect slot tapers from being flush with the surface of said butt-end to a maximum at said portion opening into each of said four side walls, so that when each of said four side walls is viewed head on, said disconnect slot forms an open, funnel-shaped slot on top of said butt-end.

50. A noodle endcap for converting a commercially available noodle beam into a flexible bar, said flexible bar being a modular component in a construction kit, said commercially available noodle beam including a hollow channel extending axially therethrough, said noodle endcap comprising:

an adaptor and a collar;

said adaptor comprising a butt-end and a shaft;

said butt-end comprising a circular plate having a central axis;

said shaft being elongated and having an axis;

said butt-end and said shaft being integrally molded with said plate axis and said shaft axis being coaxial; and said shaft being adapted to be fixedly attached within said hollow channel of said commercially available noodle beam;

a joinery integrally molded on said circular plate and extending axially away from said butt-end, said joinery comprising an array of posts and ports, wherein said array of posts and ports comprises two posts alternated with two second ports around the four corners of a simulated square, wherein said simulated square is centrally located on said circular plate, wherein said posts are centered on one of the diagonals of said simulated square and said second ports are centered on the other of the diagonals of said simulated square, and wherein each of said posts and second ports is spaced apart a fixed standard distance which is equidistant from its neighboring ports and posts respectively;

each of said posts comprises:

an arcuately sloped base, said base merging smoothly with the top surface of said butt-end;

a substantially cylindrical body extending away from said butt-end surface;

a closed, domed top, all integrally joined together;

four slots extending from said arcuately sloped base into said domed top, said slots penetrating through said cylindrical body to a hollow interior, said slots dividing said body into four strips, each of which is individually joined at its ends with said base and said domed top;

four latches, each of said latches being molded as a part of one of said four strips, each latch having an outwardly sloping ramp beginning tangentially at the bottom of said domed top and terminating in a slightly rounded tip and a flat step, said step extending orthogonally from said rounded tip back to said strip; and the linear distance of said cylindrical body from the top of said butt-end surface to the underside of said step being a predetermined selected distance;

each of said second ports comprises:

a circular aperture through said butt-end, the diameter of said aperture being equal to the diameter of said cylindrical body of said post;

the external edge of said circular aperture being arcuately shaped complementary to said arcuately sloped base of said post;

the depth of said circular aperture being the same as said predetermined selected distance of said cylindrical body; and the internal edge of said circular aperture being square;

said collar comprising a hollow shell having an axis, and said collar being permanently attached to said adaptor with the axes of said shaft and of said collar being coaxial, said cylindrical shell has a contour that provides a hand-hold where the collar mates to the beam, said hand-hold enables grasping of the beam and force insert of the posts into the ports.

51. The noodle endcap of claim 50, wherein said adaptor and said collar are both molded from a plastic material.

52. The noodle endcap of claim 51 wherein said plastic material is a thermoformed compound.

53. The noodle endcap of claim 52 wherein said thermoformed compound is polypropylene.

54. The noodle endcap of claim 50 wherein said shaft has an outside diameter substantially equal to the internal diameter of said noodle hollow channel, and said shaft has fish-hook-like barbs molded onto its free end, wherein said barbs smoothly enter said noodle hollow channel but resist withdrawal therefrom.

55. The noodle endcap of claim 54 wherein said shaft is adhesively fixed within said hollow channel.

56. The noodle endcap of claim 50 further comprising two indicators on said collar, said two indicators being located one hundred eighty degrees apart, and said two indicators being located relative to said posts such that when one of said indicators faces upwardly and said array is viewed end-on, said array has a post at the 10:30 position.

57. The noodle endcap of claim 56 wherein each of said indicators comprises a recess in the sidewall of said endcap and a visual marker located within said recess.

58. The noodle endcap of claim 57 wherein said marker is both visual and tactual.

59. The noodle endcap of claim 56 further comprising four disconnect slots equally spaced around the perimeter of said circular plate, two of said disconnect slots being centered, respectively, on said two indicators.

60. The noodle endcap of claim 59 wherein said disconnect slots taper from being flush with the surface of each of said butt-end to a maximum at a portion opening through the side of said collar, so that when said collar is viewed from the side, said disconnect slot forms an open, funnel-shaped slot leading down said butt-end.

61. A construction kit, comprising:

a plurality of components, said components comprising a plurality of rigid bars, a plurality of flexible bars, and a plurality of hubs;

(1) each of said the plurality of rigid bars comprising a square-shaped beam, a rigid spine, and a pair of endcaps;

(a) said square-shaped beam having an axis extending along the length of said square-shaped beam, a substantially square cross-section from end to end, and said square beam being made of a closed-cell foam material having a specific gravity of less than one, and wherein said square-shaped beam has a hollow circular channel positioned centrally along the length of the square-shaped beam;

(b) said rigid spine being accommodated in and fixedly bonded to the hollow circular channel of the square-shaped beam, wherein said rigid spine axially elongates along the length of the square-shaped beam; and (c) said pair of endcaps being permanently attached to the ends of said rigid spine, each of said endcaps including a half-cube shaped structure comprising a closed butt-end, four side walls depending from said butt-end, and an open bottom;

(i) said butt-end being substantially square with the plane of said butt-end being transverse of and centered on said axis, said butt-end having joinery thereon facing axially away from said square beam;

(ii) each of said four side walls having a transverse length equal to the width of said square butt-end and an axial width equal to one-half the width of said square butt-end, wherein each of said four side walls comprises first ports; and (iii) said open bottom being square and snugly receiving an end of a connector therein;

(d) said connector disposed between the rigid spine and each of the pair of endcaps for fixedly attaching the pair of end caps to the rigid spine, wherein the rigid spine is closed at each end by the connector;

(2) said flexible bar comprising a circular beam and a pair of endcaps, wherein (a) said circular beam being elongated and having an axis extending along the length of said circular beam, a substantially circular cross-section from end-to-end, said circular beam having a hollow channel axially therethrough, and said circular beam being made of a closed-cell foam material having a specific gravity of less than one;

(b) each of said endcaps comprising an adaptor and a collar:

(i) said adaptor comprising a butt-end and a shaft, said butt-end and said shaft being integrally molded:

(A) said butt-end comprising a circular plate having a central axis, said butt-end having joinery integrally molded on said circular plate and extending axially away from said circular beam; and (B) said shaft being elongated and having an axis; with said plate axis and said shaft axis being coaxial and said shaft being adapted to be fixedly attached within said hollow channel of said circular beam;

(ii) said collar comprising a hollow cylindrical shell having circular cross-sections, said collar being permanently attached to said adaptor, and the axes of said plate, of said shaft, and of said collar being coaxial;

(3) each of said hubs comprising:

(a) a half-cube shaped structure, comprising a butt-end, four side walls depending from said butt-end, an open bottom, and a cover plate:

(i) said butt-end being substantially square with joinery integrally formed therewith and facing away from the plane of said butt-end;

(ii) each of said four side walls having a length equal to the width of said square face and a width equal to one-half the width of said plane of said butt-end;

(iii) said open bottom being opposite and parallel to said plane of said butt-end, said open bottom being defined by said four side walls; and (iv) said cover plate being permanently attached to said body and closing said open bottom, wherein said cover plate has four symmetrically placed ports, said four symmetrically placed ports being located at the corners of a standard simulated square, said standard simulated square being centrally located on said cover plate, each of said ports being separated from its neighboring port by a standard fixed distance;

wherein said butt-ends of said rigid bar, said flexible bar, and said hub have substantially identical joinery, and said joinery on any one component being capable of interlocking with any joinery on any facing component.

62. The construction kit of claim 61 wherein said joinery comprises:

an array of posts and ports arranged on each of said butt-ends, said array comprising two posts and two second ports, said posts alternating with said second ports around the four corners of a simulated square, said simulated square being centrally located on each of said butt-ends, and each of said posts and second ports being separated from its neighboring ports and posts, respectively, by a standard fixed distance, wherein said simulated square comprises a standard simulated square and said array comprises a standard array; and all of said posts are substantially identical and all of said second ports are substantially identical, wherein any of said posts on said one component interlock with any of said first and second ports on the facing component.

63. The construction kit of claim 62 wherein each of said posts comprises:

an arcuately sloped base, said base merging smoothly with the top surface of its associated butt-end; a substantially cylindrical body extending away from said butt-end surface; and a closed, domed top, all integrally joined together;

four slots extending from said arcuately sloped base into said domed top, said slots penetrating through said cylindrical body to a hollow interior, said slots dividing said body into four strips, each of which is individually joined at its ends with said base and said domed top;

four latches, each of said latches being molded as a part of one of said four strips, each latch having an outwardly sloping ramp beginning tangentially at the bottom of said domed top and terminating in a slightly rounded tip and a flat step, said step extending orthogonally from said rounded tip back to said strip; and the linear distance of said cylindrical body from the top of said butt-end surface to the underside of said step being a predetermined selected distance;

each of said second ports comprises:

a circular aperture through said butt-end, the diameter of said aperture being substantially equal to the diameter of said cylindrical body of said post;

the external edge of said circular aperture being arcuately shaped complementary to said arcuately sloped base of said post;

the depth of said circular aperture being the same as said predetermined selected distance of said cylindrical body; and the internal edge of said circular aperture being square.

64. The construction kit of claim 63 wherein each of said four side walls of both of said endcaps of said rigid bars and of said bodies of said hubs has two first ports, said first ports being spaced apart by said standard distance, and wherein two endcaps facing each other interlock with each other.

65. The construction kit of claim 64 wherein said interlocking of said facing endcaps of two rigid bars comprises a linear, bar-to-bar connection between said two rigid bars, said bar-to-bar connection juxtaposing four sets of coplanar side walls of said two interlocked endcaps, each of said four sets of coplanar side walls presenting four first ports orthogonally away from said linear bar-to-bar connection, each of said four first ports being spaced apart from its nearest neighboring port by said standard distance, wherein each of said four first ports are centered on the corners of a standard simulated square.

66. The construction kit of claim 64 wherein the interlocking of said facing butt-ends of an endcap and of a hub juxtaposes four sets of coplanar side walls of said endcap and of a hub, each of said four sets of coplanar side walls presenting four first ports orthogonally away from said interlocking of facing butt-ends of an endcap and of a hub, each of said four first ports being spaced apart from its nearest neighboring port by said standard distance, wherein each of said four first ports are centered on the corners of a standard simulated square.

67. The construction kit of claim 64 wherein said interlocking of facing endcaps of two flexible bars comprises a linear, bar-to-bar connection between said two flexible bars.

68. The construction kit of claim 64 further comprising indicators on two of said four side walls, said two side walls being on opposite sides of said butt-ends of each of said rigid bars and each of said hubs, and said two side walls being oriented relative to said posts such that when one of said indicators faces upwardly and when said array is viewed end-on, said array has a post at the 10:30 position.

69. The construction kit of claim 68 wherein each of said indicators comprises a recess in the sidewall of said endcap and a marker located within said recess and wherein the other two of said four sides include similarly located recesses but with no marker therein.

70. The construction kit of claim 69 wherein the surface of each of said butt-ends of both said rigid bar endcap and said hub has a disconnect slot centrally located adjacent each of its four sides, said disconnect slot having a portion opening into each of each of said four side walls of both of said endcaps of said rigid bars and of said bodies of said hubs.

71. The construction kit of claim 70 wherein said disconnect slot tapers from being flush with said surface of said butt-end to a maximum at said portion opening into each of said side walls, so that when two bars are connected bar-to-bar, said disconnect slot forms a funnel shaped slot leading into the space between said interlocked endcaps.

* * * * *